US006993264B2

(12) United States Patent
Oguma et al.

(10) Patent No.: US 6,993,264 B2
(45) Date of Patent: Jan. 31, 2006

(54) PROCESS CARTRIDGE AND ELECTROPHOTOGRAPHIC IMAGE FORMING APPARATUS

(75) Inventors: Toru Oguma, Mishima (JP); Shigeo Murayama, Susono (JP); Daisuke Abe, Shizuoka-ken (JP); Hideyuki Matsubara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 44 days.

(21) Appl. No.: 10/748,330

(22) Filed: Dec. 31, 2003

(65) Prior Publication Data

US 2005/0069338 A1 Mar. 31, 2005

(30) Foreign Application Priority Data

Sep. 30, 2003 (JP) ..... 2003-342607
Dec. 26, 2003 (JP) ..... 2003-435559

(51) Int. Cl.
*G03G 15/00* (2006.01)
*G03G 21/16* (2006.01)

(52) U.S. Cl. ..... 399/90; 399/111
(58) Field of Classification Search ..... 399/88–90, 399/111
See application file for complete search history.

(56) References Cited

U.S. PATENT DOCUMENTS 6,011,941 A * 1/2000 Takashima et al. ..... 399/111
6,097,906 A 8/2000 Matsuzaki et al. ..... 399/90

FOREIGN PATENT DOCUMENTS

JP 62-215278 9/1987
JP 7-77921 3/1995
JP 9-68833 3/1997
JP 10-74030 3/1998

OTHER PUBLICATIONS

English translation of Japanese Patent Document No. 9-68833.
English translation of Japanese Patent Document No. 10-74030.
English translation of Japanese Patent Document No. 7-77921.

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

A process cartridge detachably mountable to a main assembly of an electrophotographic image forming apparatus, the main assembly including an output contact movable between an electrical connecting position and a retracted position retracted from the electrical connecting position. The process cartridge includes a movable operation member movable relative to a cartridge frame, wherein when the process cartridge is inserted into the main assembly of the apparatus, the movable operation member is engageable with a fixed engageable member fixed in the main assembly of the apparatus to move relative to the cartridge frame, and is engageable with a displaceable engaging portion of the displaceable member to move the output contact from the retracted position to the electrical connecting position; and an input electrical contact for receiving a voltage for enabling the process device by engagement with the output contact moved to the electrical connecting position.

30 Claims, 46 Drawing Sheets

(a)

(b)

(a)

(b)

(a)

(b)

(a)

(b)

(a)

(b)

(a)

(b)

(a)

(b)

(a)

(b)

(a)

(b)

(a)

(b)

(a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus to which the process cartridge is demountably mounted.

Here the electrophotographic image forming apparatus is an apparatus for forming the image on a recording material (a recording sheet, an OHP sheet or the like) through an electrophotographic image forming process. It includes an electrophotographic copying machine, an electrophotographic printer or the like.

The process cartridge is a cartridge containing as a unit an electrophotographic photosensitive member and process means including at least one of a charging member and a developing member, which cartridge is detachably mountable to a main assembly of the electrophotographic image forming apparatus.

With the electrophotographic image forming apparatus of the process cartridge type, the process cartridge can be mounted to or demounted from the main assembly of the image forming apparatus by the user without an expert serviceman. Therefore, the operationality of the image forming apparatus is remarkably improved.

In such an electrophotographic image forming apparatus, it is necessary to supply electric voltages to a charging member for electrically charging the electrophotographic photosensitive member (photosensitive drum), a developing member for developing an electrostatic latent image formed on the photosensitive drum, and the like, which are contained in the process cartridge.

Heretofore, the cartridge was provided with an input electrical contact for electrical connection between the cartridge and the main assembly of the apparatus when the cartridge is mounted in place in the main assembly of the image forming apparatus. On the other hand, the main assembly of the apparatus is provided with an output contact. With this structure, when the cartridge is mounted to the main assembly of the apparatus, the input electrical contact is connected with the output contact. By doing so. The voltage can be supplied from the main assembly of the apparatus to the cartridge.

More particularly, the following structure is known.

A movable protection plate covering the contact member (the output contact) is provided in the main assembly of the apparatus. When the printer (image forming apparatus) is subjected to a maintenance operation, the operator and/or a tool is prevented from touching the contact member. By the inserting motion of the cartridge into the main assembly of the apparatus, the protection plate is retracted to a retracted position. By doing so, an electrical connection is permitted between the contact member in the main assembly of the apparatus and the contact member on the cartridge (input electrical contact) (paragraphs ([0012]–[0015], FIG. 1–FIG. 3 of Japanese Laid-open Patent Application Hei 7-77921).

When the unit is dismounted from the main assembly of the apparatus, a connector pin (output contact) is hidden inside a partition wall. By doing so, the serviceman or user is prevented from touching the connector pin. By the insertion of the unit into the main assembly of the apparatus, the connector pin enters the unit insertion space. Thus, the connector pin and the connector portion of the unit (input electrical contact) are electrically connected. (Page 4, bottom left Col., Line 15 to top left Col. Line 15, FIG. 1A, FIG. 1B, FIG. 4A).

In addition, the drum shutter is provided with a regulating portion. The regulating portion is effective to cover the electrical contact (input electrical contact). By doing so, a contact defect which may be caused by deposition of foreign matter on the electrical contact, can be prevented. By the entering of the cartridge into the main assembly of the apparatus, the electrical contact of the cartridge and the electrical contact of the main assembly of the apparatus (output contact) are electrically connected. ([0039]–[0047], FIG. 17 of Japanese Laid-open Patent Application Hei 10-74030).

A contact member (output contact) is provided and is movable between a retracted position and a regular position. By doing so, the contact portion of the cartridge (input electrical contact) and the contact member of the main assembly of the apparatus are contacted with each other in order. Before the cartridge is inserted into the main assembly of the apparatus, the contact member (output contact) is in the retracted position. When the cartridge is mounted to the main assembly of the apparatus, the contact member is moved to the regular position. By this, the two contact portions are electrically connected with each other. ([0016] –[0029], FIG. 1–FIG. 3 of Japanese Laid-open Patent Application Hei 9-68833).

The present invention provides a further improvements in such structures.

SUMMARY OF THE INVENTION

It is a principal object of the present invention to provide a process cartridge and an electrophotographic image forming apparatus providing a reliable electrical connection between an input electrical contact of a process cartridge and an output contact provided in a main assembly of an image forming apparatus when the process cartridge is mounted in the main assembly of the electrophotographic image forming apparatus.

It is another object of the present invention to provide a process cartridge and an electrophotographic image forming apparatus wherein damage of an electric circuit provided in the main assembly of the electrophotographic image forming apparatus can be prevented.

It is a further object of the present invention to provide a process cartridge and an electrophotographic image forming apparatus wherein an impact or shock on the process cartridge from the main assembly of the apparatus when the process cartridge is mounted to the mounting portion of the main assembly of the electrophotographic image forming apparatus, can be reduced.

It is a further object of the present invention to provide a process cartridge and an electrophotographic image forming apparatus wherein an output contact is moved from a retracted position to an electrical connecting position by inserting the operation of the process cartridge into the main assembly of the electrophotographic image forming apparatus.

According to an aspect of the present invention, there is provided a process cartridge detachably mountable to a main assembly of an electrophotographic image forming apparatus, the main assembly including an output contact movable between an electrical connecting position and a retracted position retracted from the electrical connecting position, a displaceable member for moving the output contact, and an elastic function member for elastically urging the displaceable member to urge the output contact toward the retracted position away from the electrical connecting position, the process cartridge comprising an electrophotographic photosensitive drum; process means actable on the electrophotographic photosensitive drum; a movable operation member movable relative to a cartridge frame, wherein when the process cartridge is inserted into the main assembly of the apparatus, the movable operation member is engageable with a fixed engageable member fixed in the main assembly of the apparatus to move relative to the cartridge frame, and is engageable with a displaceable engaging portion of the displaceable member to move the output contact from the retracted position to the electrical connecting position against an elastic force of the elastic function member, after the engagement with the fixed engageable member; and an input electrical contact for receiving a voltage for enabling the process means by engagement with the output contact moved to the electrical connecting position.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 50(*b*) illustrates a schematic view of a structure or the electrical contact portion in the main assembly of the image forming apparatus according to the embodiment of the present invention.

FIG. 52(*b*) is a schematic perspective view that illustrates a structure of the mounting portion of the output contact member in the image forming apparatus according to the embodiment of the present invention.

FIG. 53(*b*) is a schematic front view illustrating a relation between the input electrical contact member of the process cartridge and the displaceable member and the output contact member which are provided in the main assembly or the image forming apparatus.

FIG. 53(*c*) is a schematic front view illustrating a relation between the input electrical contact member of the process cartridge and the displaceable member and the output contact member which are provided in the main assembly of the image forming apparatus.

DESCRIPTION OF THE PREFERRED EMBODIMENTS

A description will be provided as to the embodiments of the process cartridge and the electrophotographic image forming apparatus according to the present invention.

Embodiment 1

(1) General Structure of Process Cartridge

Figure 1:
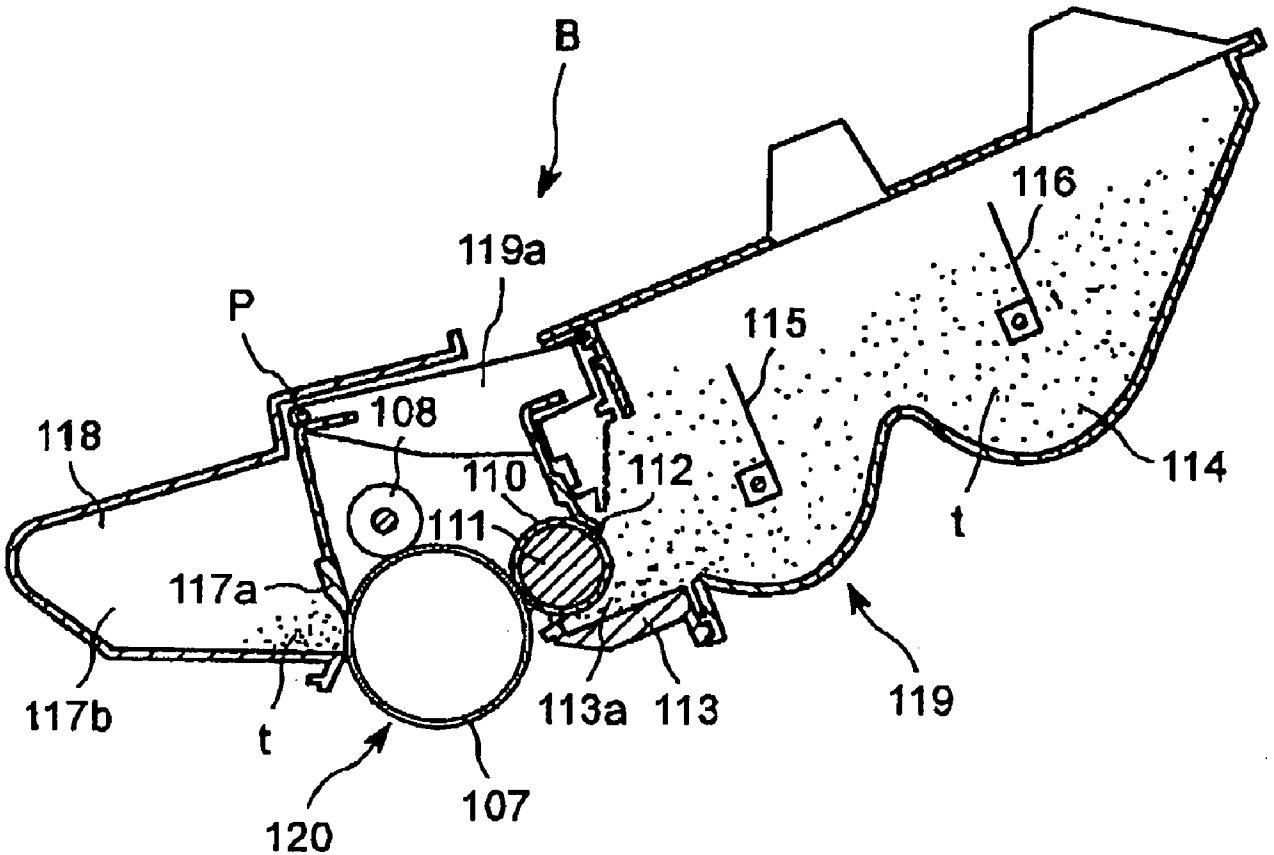
FIG. 1 is a sectional view of the process cartridge according to an embodiment of the present invention.

Referring to FIG. 1, a process cartridge B (cartridge) according to a first embodiment of the present invention will be described. FIG. 1 is a sectional view of the cartridge B.

Figure 2:
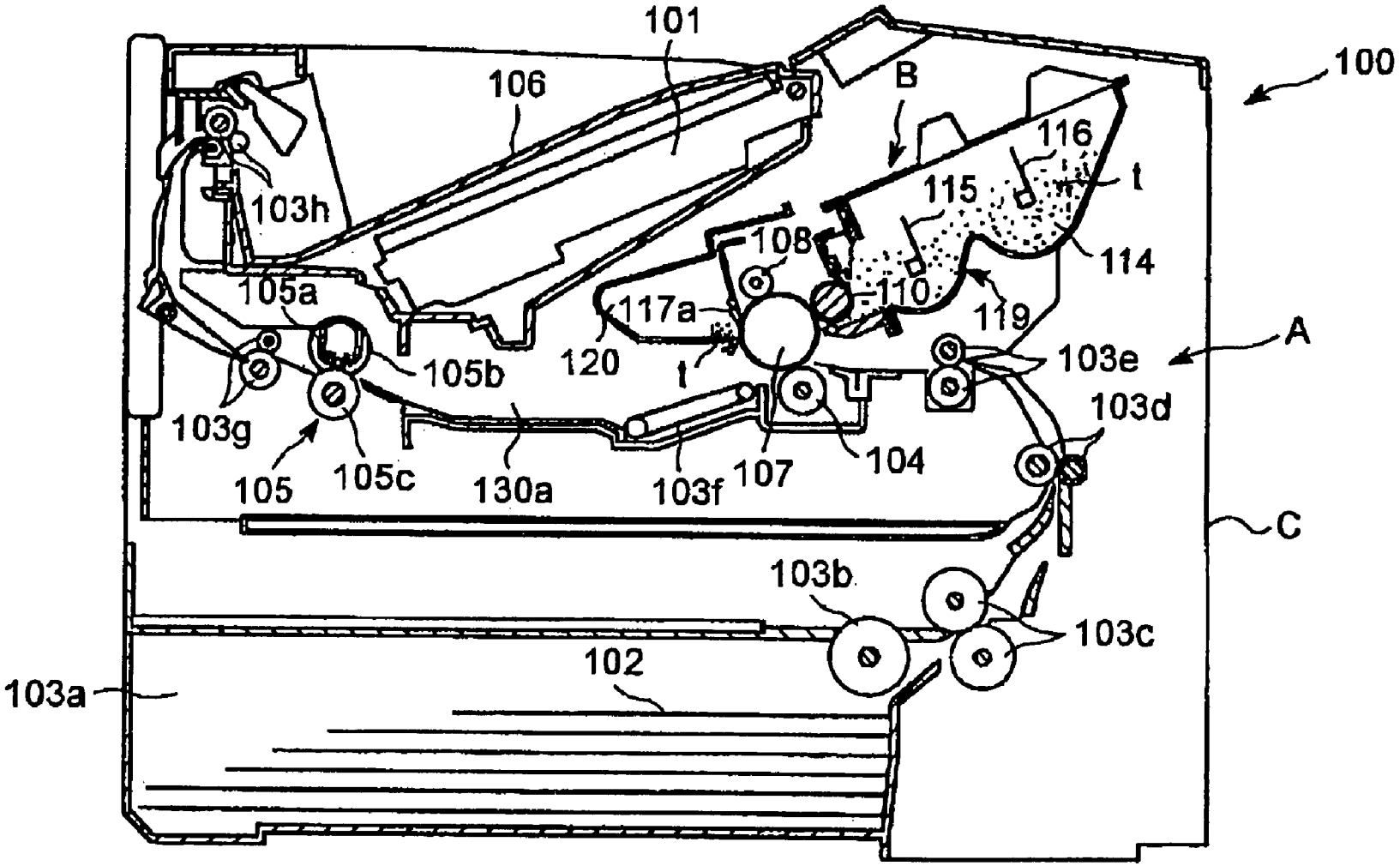
FIG. 2 is a schematic view which illustrates a structure of an image forming apparatus according to an embodiment of the present invention.

In FIG. 1, the cartridge B comprises an electrophotographic photosensitive drum (photosensitive drum) 107. As shown in FIG. 2, when the cartridge B is mounted to the main assembly A of the electrophotographic image forming apparatus (main assembly of the apparatus), the photosensitive drum 107 is rotatable by receiving a driving force from the main assembly A.

Disposed opposed to an outer surface of the photosensitive drum 107 is a charging roller 108 functioning as a charging member. The charging roller 108 is supplied with a voltage from the main assembly A of the apparatus and electrically charges the photosensitive drum 107. The charging roller 108 is contacted to the photosensitive drum 107 and is rotated by the photosensitive drum 107.

Figure 10:
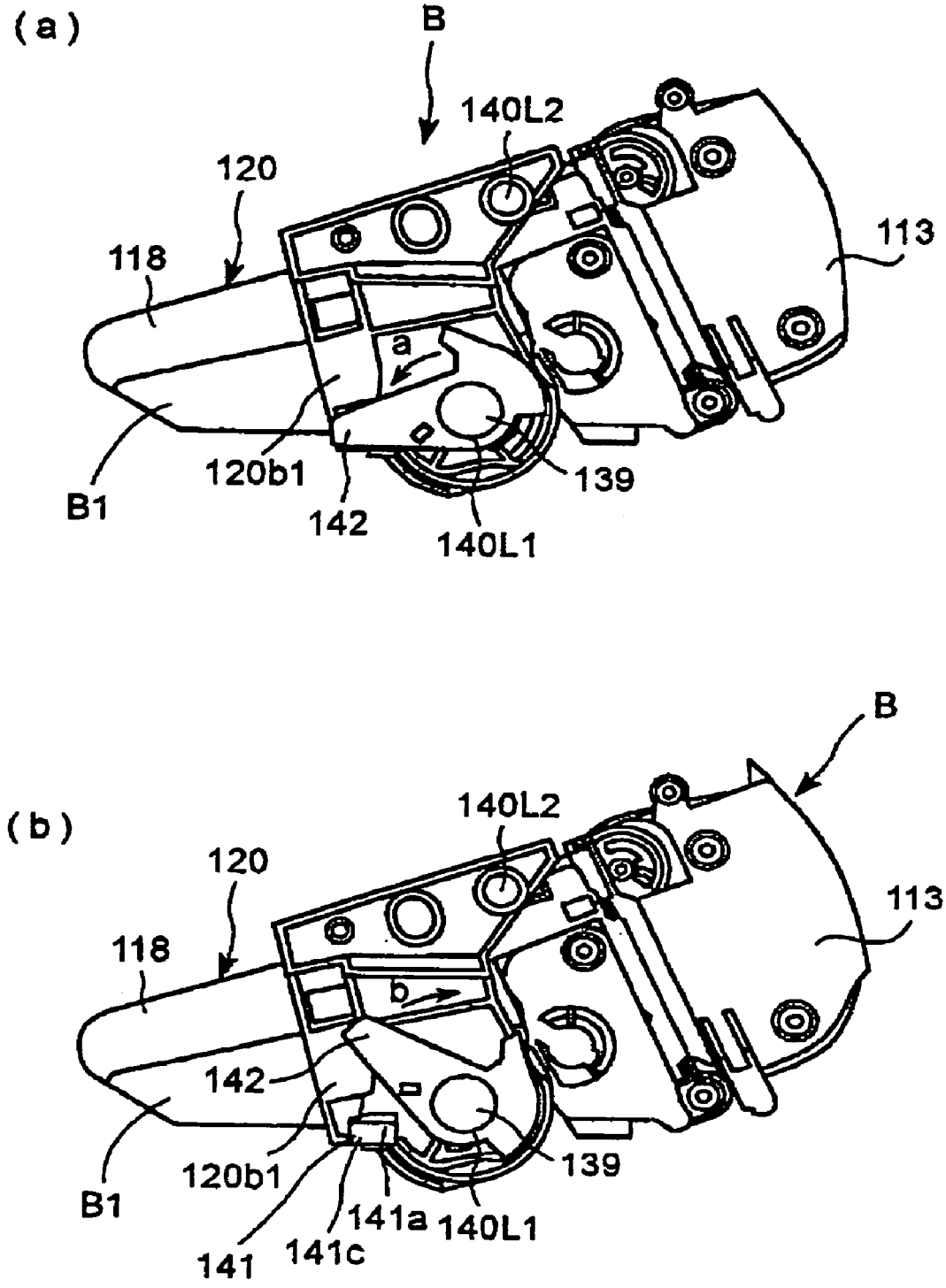
FIGS. 10(*a*) and 10(*b*) are schematic side views which illustrate a structure of a movable operation member of the process cartridge according to the embodiment of the present invention.

When the cartridge B is mounted to the main assembly A of the apparatus, the charging roller 108 is supplied with a voltage from the main assembly 100 of the apparatus through a charging output contact 144*a* (FIG. 4) functioning as an output contact and a charging input electrical contact 141*a* (FIGS. 10(*a*) and 10(*b*)) functioning as an input electrical contact. The charging roller 108 functions by this voltage to electrically charge the photosensitive drum 107.

The cartridge B includes a developing roller 110 functioning as a developing member. The developing roller 110 supplies the developer t into a developing zone adjacent a photosensitive drum 107. The developing roller 110 develops an electrostatic latent image formed on the photosensitive drum 107 with the developer t. The developing roller 110 contains a magnet roller (stationary magnet) 111.

Figure 40:
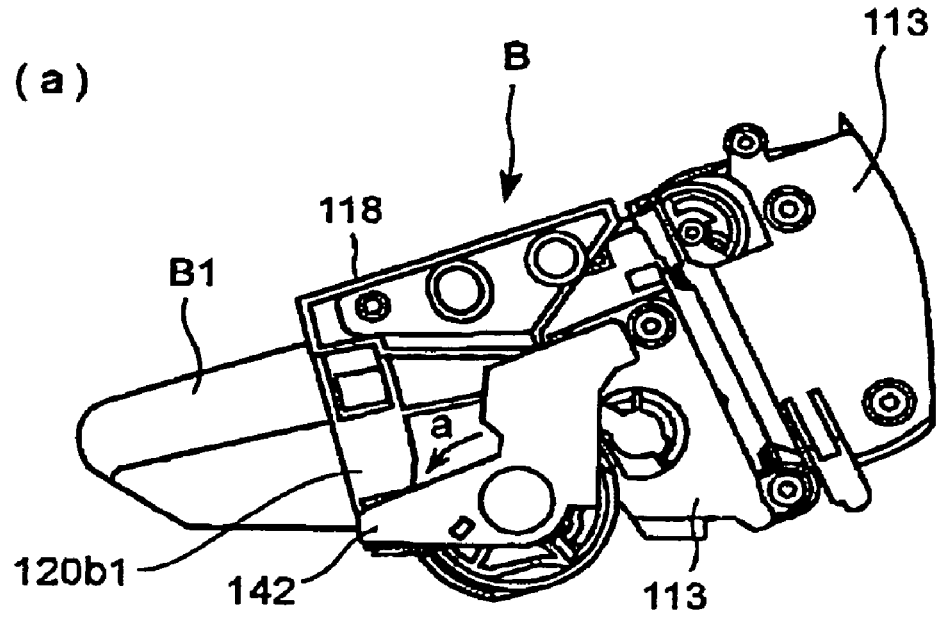
FIGS. 40(*a*) and 40(*b*) illustrate a structure of the movable operation member of the process cartridge according to the embodiment of the present invention.
Figure 40:
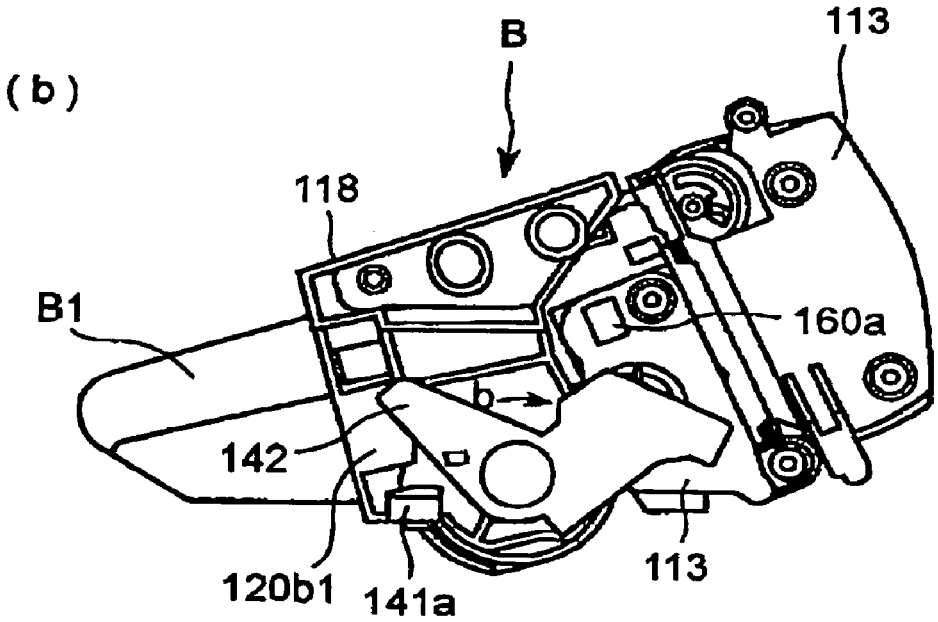
Figure 41:
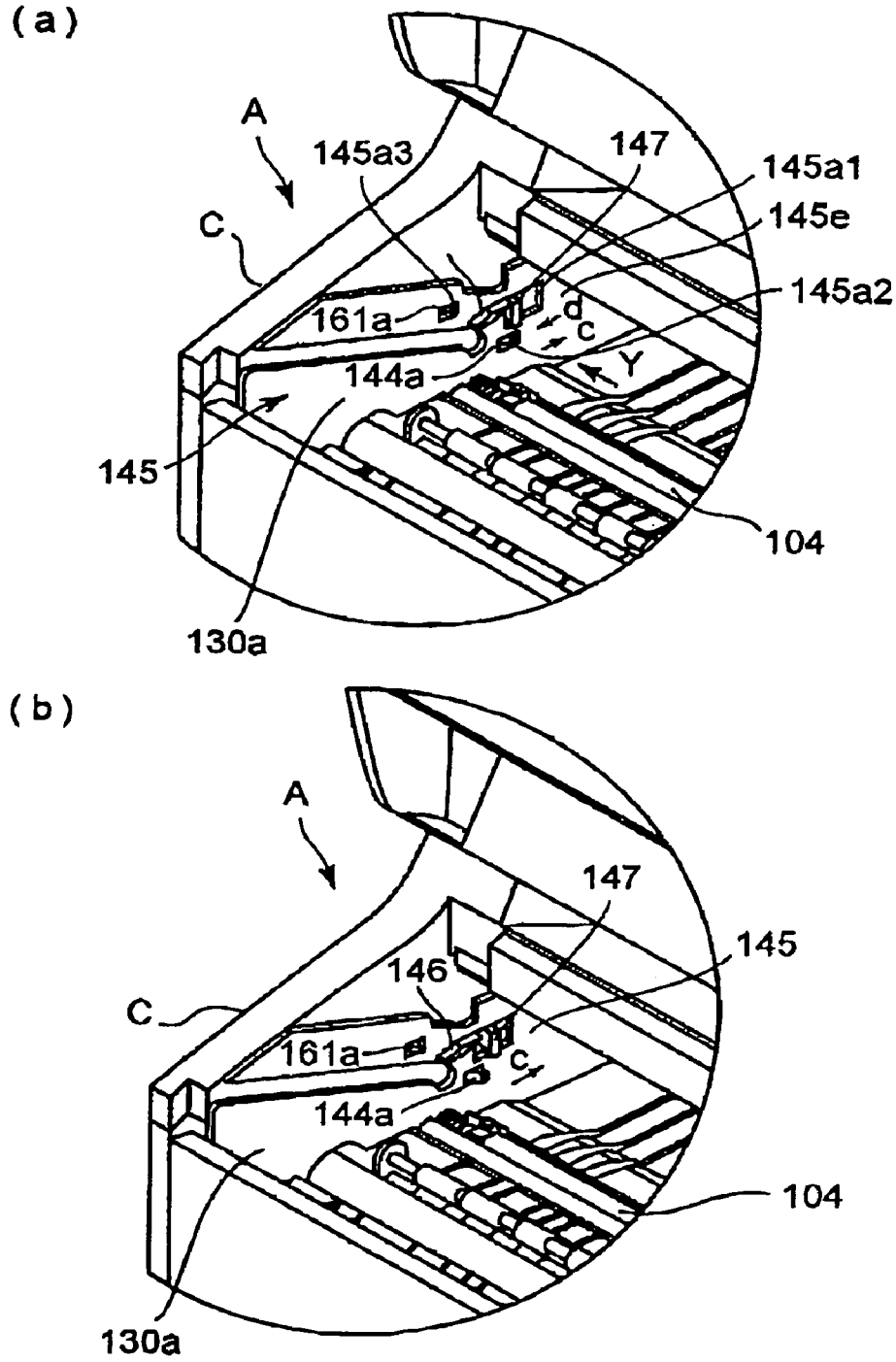
FIGS. 41(*a*) and 41(*b*) are schematic perspective views that illustrate a structure of an electrical contact portion in the main assembly of the image forming apparatus according to the embodiment of the present invention.

When the cartridge B is mounted to the main assembly A of the apparatus, the developing roller 110 is supplied with a voltage from the main assembly 100 of the apparatus through a development output contact 161*a* (FIGS. 41(*a*) and 41(*b*)) functioning as an output contact and a development input electrical contact 160*a* (FIG. 40(*b*)) functioning as an input electrical contact. The developing roller 110 functions by the thus applied voltage to develop the electrostatic latent image.

To the peripheral surface of the developing roller 110, a developing blade 112 is contacted. The developing blade 112 functions to regulate an amount of the developer t deposited on the peripheral surface of the developing roller 110. The developing blade 112 also functions to triboelectrically charge the developer t.

The developer t accommodated in the developer accommodating container 114 is supplied out into the developer chamber 113*a* by rotation of the stirring members 115, 116. The developing roller 110 supplied with the voltage through the electrical contact 160*a* is rotated. By doing so, a layer of the developer having the triboelectric charge applied by the developing blade 112 is formed on the surface of the developing roller 110. The developer t is transferred onto the photosensitive drum 107 in accordance with the pattern of the latent image. Thus, the latent image is developed.

The developed image on the photosensitive drum 107 is transferred onto a recording material 102 by a transfer roller 104.

Disposed opposed to the outer surface of the photosensitive drum 107 is an elastic cleaning blade 117*a*. The cleaning blade 117*a* has an edge which is contacted to the photosensitive drum 107. The blade 117*a* functions to remove the developer t remaining on the photosensitive drum 107 after transfer of the developed image onto the recording material 102. The developer t removed from the surface of the photosensitive drum 107 by the blade 117*a* is accommodated in a removed developer container 117*b*.

The cartridge B is constituted integrally by the developing unit 119 and the drum unit 120.

The developing unit 119 is constituted by the developing device frame 113 which is a part of the cartridge frame B1. The developing unit 119 contains the developing roller 110, the developing blade 112, the developer chamber 113*a*, the developer accommodating container 114 and stirring members 115, 116. A development input electrical contact 160*a* is provided to be exposed from the developing device frame 113.

A drum unit 120 is constituted by a drum frame 118 which is a part of the cartridge frame B1. The drum unit 120 contains the photosensitive drum 107, the cleaning blade 117*a*, the removed developer container 117*b* and the charging roller 108. The charging input electrical contact 141*a* is provided exposed from the drum frame 118. The electrical contact 141*a* is disposed at a lower part of the drum frame 118. More particularly, the electrical contact 141*a* is disposed at a lower part of the drum frame 118 when the cartridge B is placed in the main assembly A of the apparatus.

One end of the photosensitive drum 107 is supported by the drum frame 118. An outer end of the drum shaft 139 functions as a cartridge guide 140L1 which will be described hereinafter referring to FIG. 7.

Figure 6:
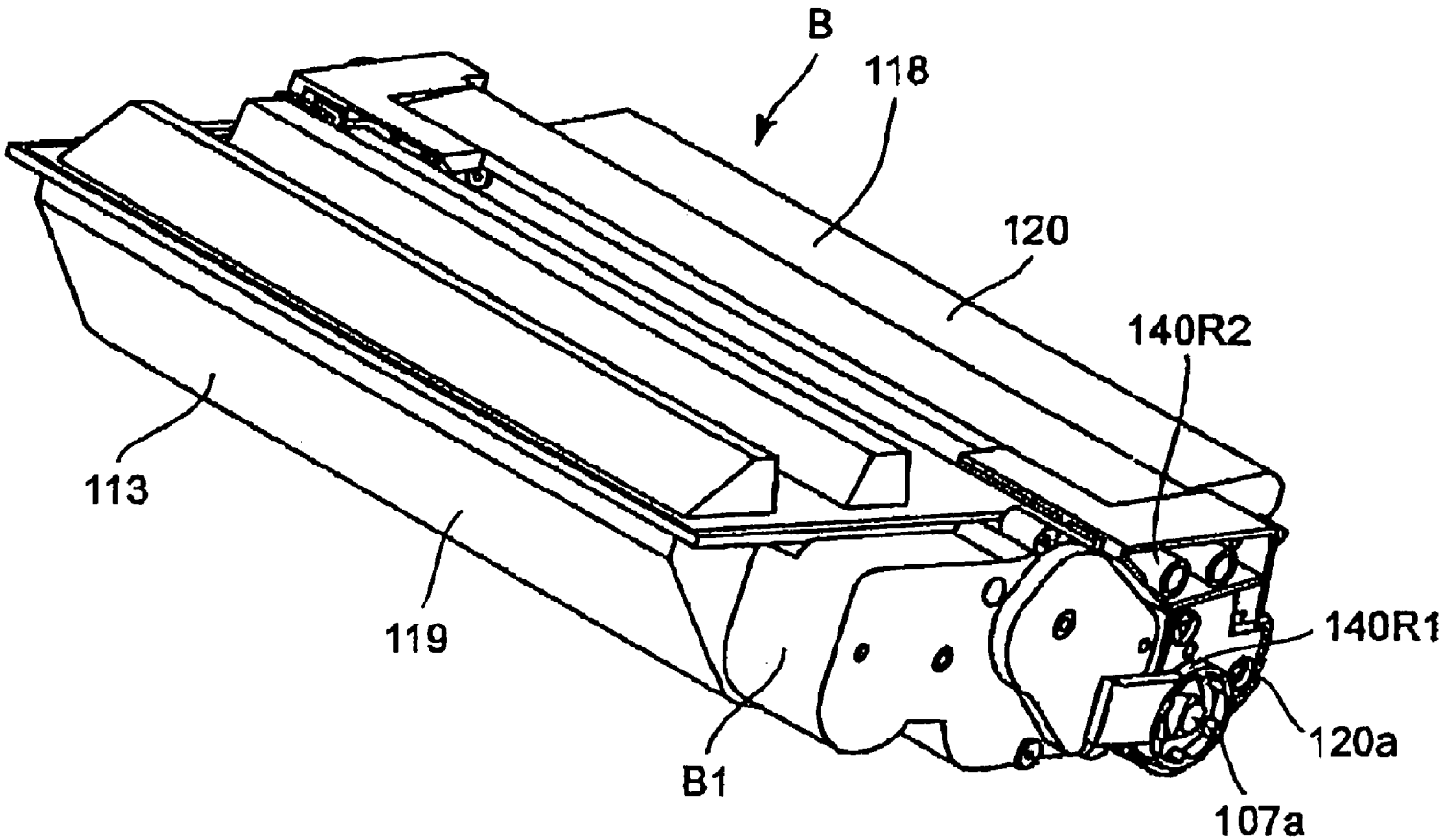
FIG. 6 is a perspective view of a process cartridge according to the embodiment of the present invention.
Figure 7:
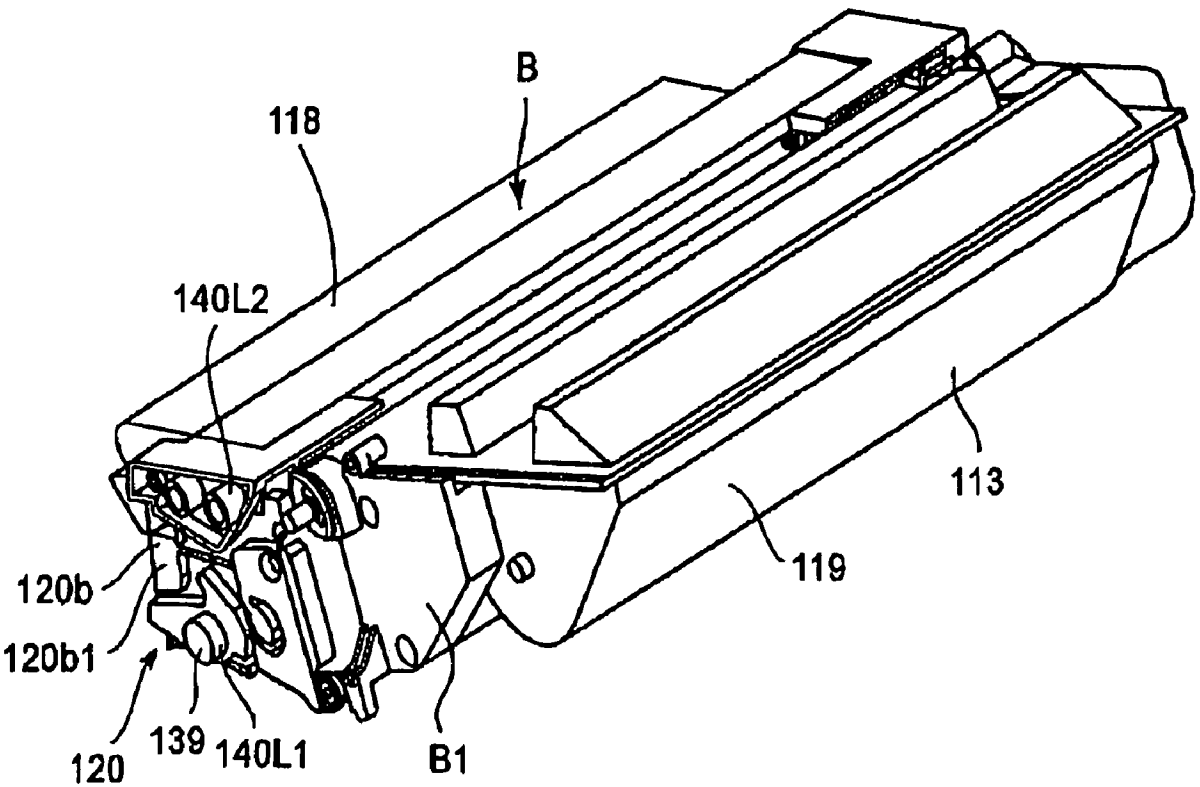
FIG. 7 is a perspective view of a process cartridge according to the embodiment of the present invention.

As will be understood from FIG. 6, cartridge guides 140R1, 140R2 are provided at one longitudinal end 120*a* of the drum unit 120. As shown in FIG. 7, a cartridge guide 140L1 and another cartridge guide 140L2 are provided at the other longitudinal end 120*b*.

The developing unit 119 and the drum unit 120 are rotatably coupled with each other by pins P. The developing roller 110 is urged to the photosensitive drum 107 by an elastic member (unshown) which is provided between the units 119, 120. Designated by 119*a* is an arm which is provided in the developing unit 119. The arm 119*a* is engaged with the drum unit 120, and the pin P are set in the holes formed in the units 119, 120.

(2) Electrophotographic Image Forming Apparatus

Referring to FIG. 2, a description will be provided as to the electrophotographic image forming apparatus 100 with which the cartridge B is usable. FIG. 2 shows a general arrangement of an electrophotographic image forming apparatus (image forming apparatus) 100.

A description will be provided as to a laser beam printer which is an exemplary image forming apparatus 100.

In the image forming operation, a surface of the photosensitive drum 107 is uniformly charged by the charging roller 108. A laser beam is emitted from a laser diode and is projected onto the photosensitive drum 107 in accordance with image information with optical means 101 including a polygonal mirror, lenses and deflection mirrors (unshown). By doing so, an electrostatic latent image is formed on the photosensitive drum 107 corresponding to the image information. The latent image is developed by the developing roller 110 which has been described hereinbefore.

On the other hand, in synchronism with the formation of the developed image, a recording material 102 in a cassette 103*a* is fed out by pick-up roller 103*b* and is fed to a transfer position by pairs of feeding rollers 103*c*, 103*d*, 103*e*. At the transfer position, a transfer roller 104 (transferring means) is provided. The transfer roller 104 is supplied with a voltage. By this, the developed image formed on the photosensitive drum 107 is transferred onto the recording material 102.

The recording material 102 now having the developed image transferred thereto is fed to fixing means 105 through a guide 103*f*. The fixing means 105 includes a driving roller 10*c* and a fixing roller 105*b* containing a heater 105*a* therein. The fixing means 105 applies heat and pressure to the recording material 102 passing therethrough to fix the developed image on the recording material 102. The recording material 102 is fed by pairs of rollers 103*g* and 103*h* onto a tray 106. The roller 103*b*, the pair of feeding rollers 103*c*, 103*d*, 103*e*, the guide 103*f*, the pair of rollers 103*g*, 103*h* and so on constitute feeding means for the recording material 102.

The cartridge B is mounted into or demounted from the main assembly A of the apparatus in the following manner.

Figure 3:
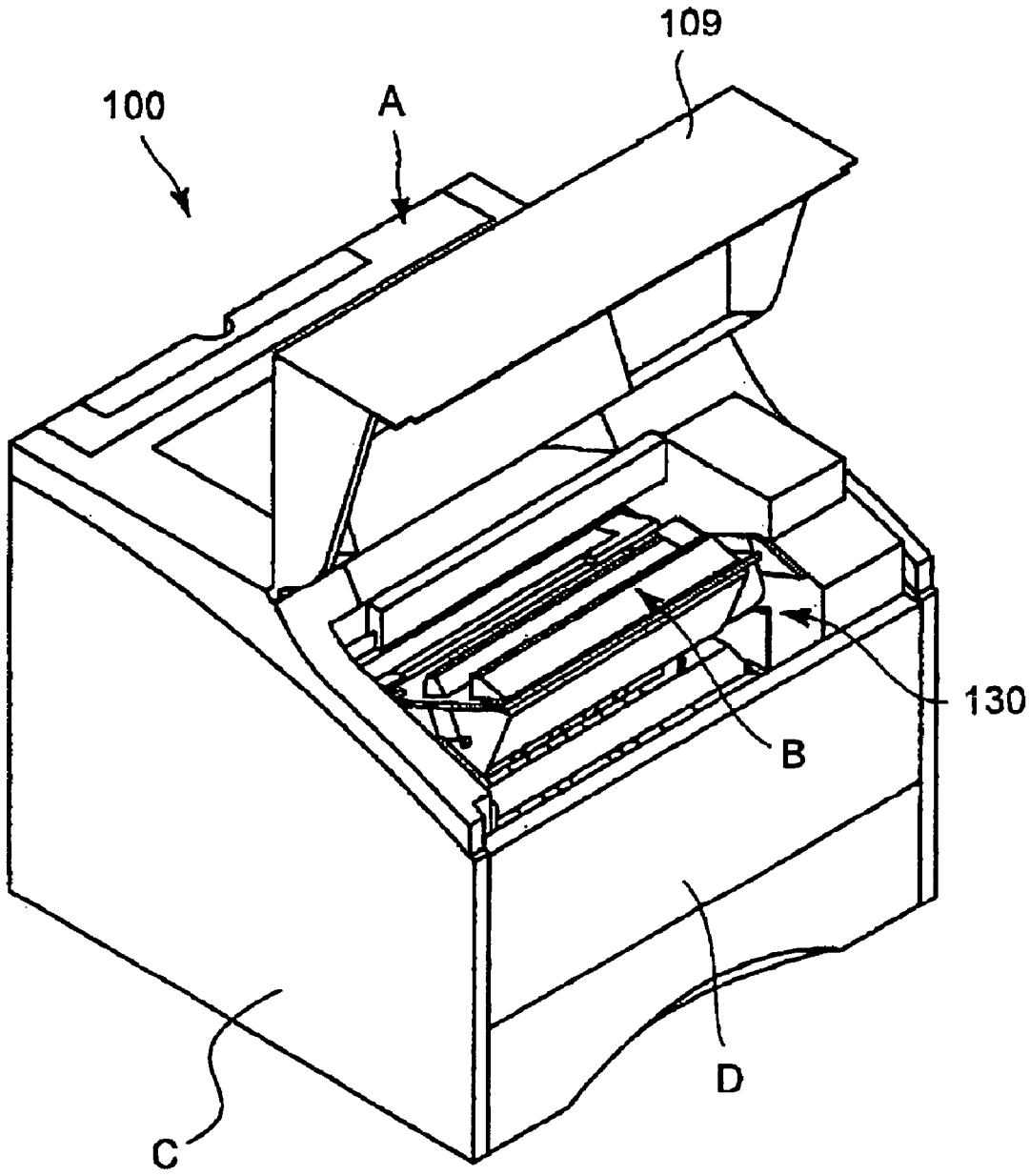
FIG. 3 is a perspective view of the image forming apparatus according to the embodiment of the present invention.

As shown in FIG. 3, the operator opens a door 109 provided in the main assembly A of the apparatus. The cartridge B is demountably mounted to is cartridge mounting means 130 provided in the main assembly A of the apparatus.

Figure 4:
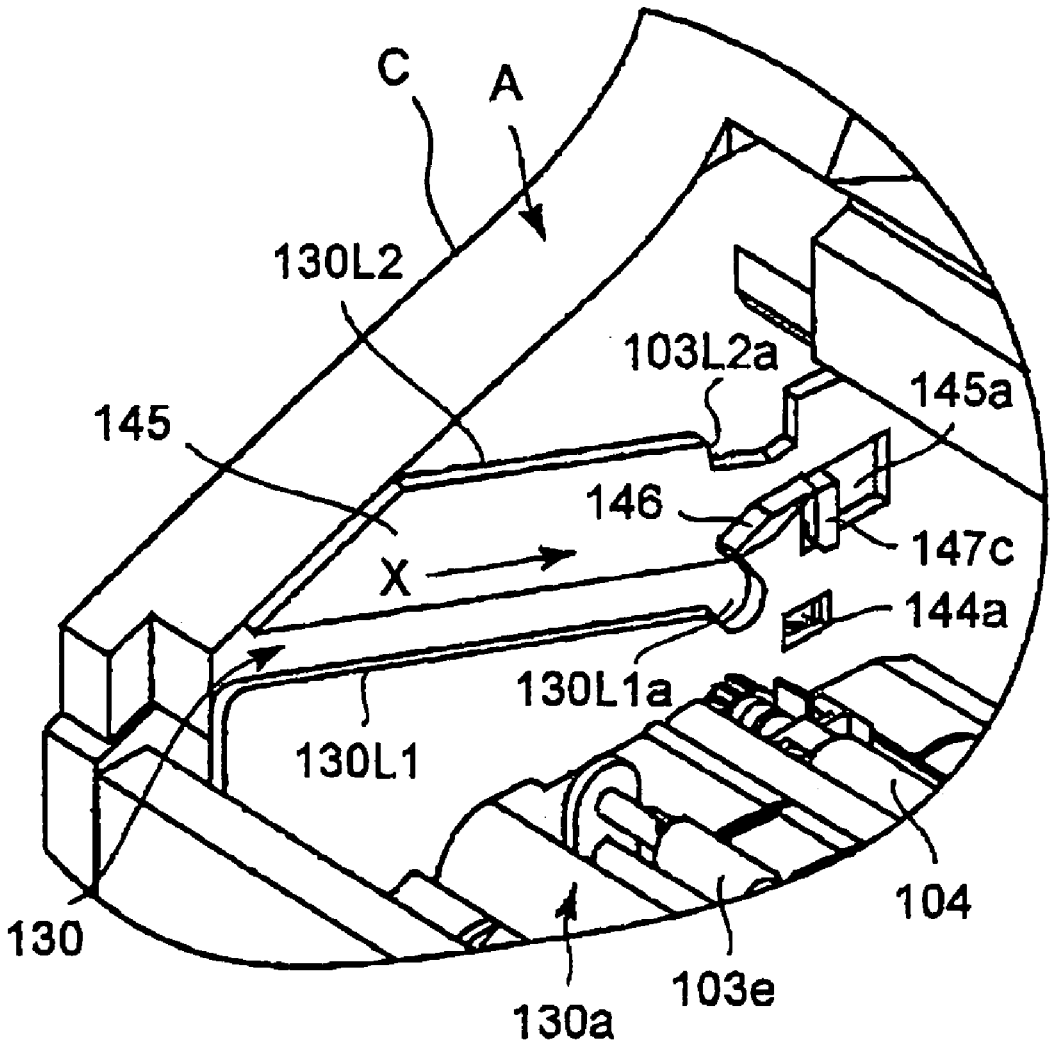
FIG. 4 is a perspective view which shows a mounting portion of the main assembly of the apparatus to accept the process cartridge according to the embodiment of the present invention.
Figure 5:
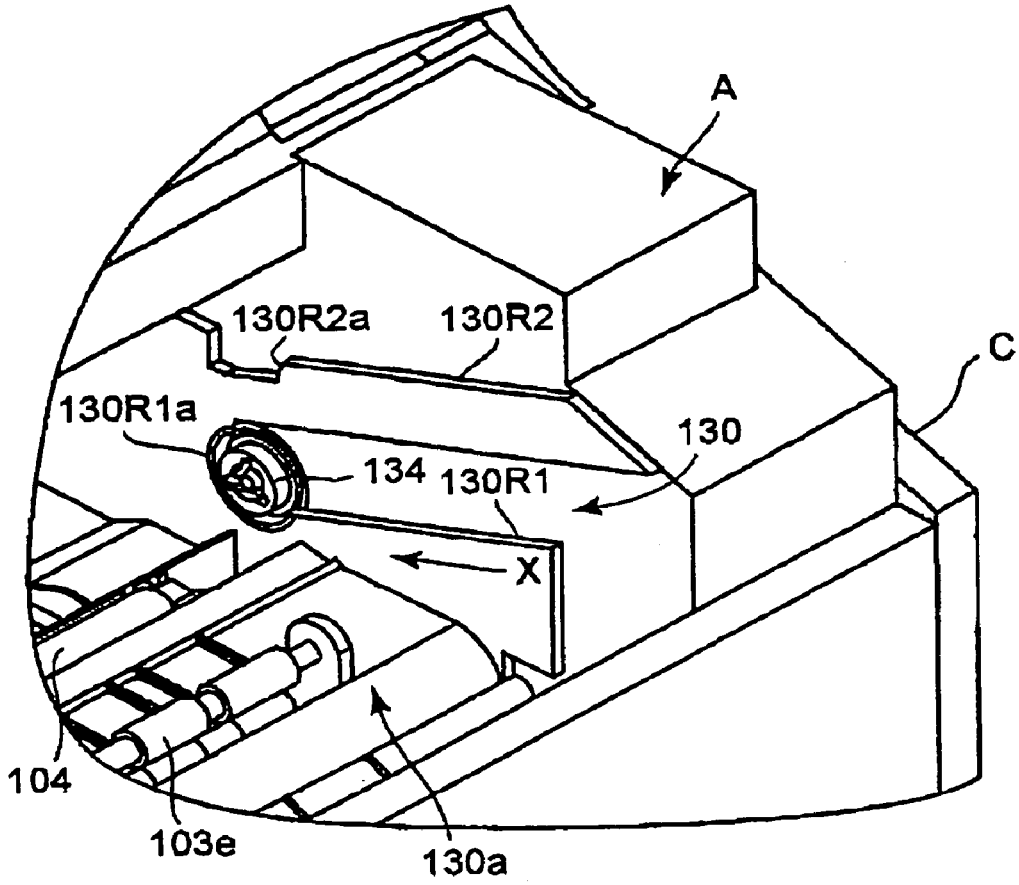
FIG. 5 is a perspective view which shows a mounting portion of the main assembly of the apparatus to accept the process cartridge according to the embodiment of the present invention.

As shown in FIGS. 4 and 5, the mounting means 130 of this embodiment includes main assembly guides 130R1, 130R2, 130L1, 130L2 in the main assembly A of the apparatus. When the cartridge B is mounted to the main assembly A of the apparatus, it is inserted toward the cartridge mounting portion 130*a* such that cartridge guides 140R1, 140R2 (FIG. 6) are guided by the main assembly guides 130R1, 130R2, and the cartridge guides 140L1, 140L2 (FIG. 7) are guided by the main assembly guides 130L1, 130L2.

The cartridge guide 140R1 is engaged with the positioning portion 130R1*a* of the main assembly guide 130R1, and the cartridge guide 140R2 is abutted to the positioning portion 130R2*a* of the main assembly guide 130R2; and the cartridge guide 140L1 is engaged with the positioning portion 130L1*a* of the main assembly guide 130L1, and the cartridge guide 140L2 is abutted to the positioning portion 130L2*a* of the main assembly guide 130L2. At this time, the cartridge B is demountably mounted to the cartridge mounting portion 130*a* by the mounting means 130. By the cartridge B mounted in place in the cartridge mounting portion 130*a*, the image forming operation is enabled. Here, the cartridge mounting portion 130*a* is the space occupied by the cartridge B which is mounted in place to the main assembly A of the apparatus by the mounting means 130.

When the cartridge R is mounted, a coupling 134 (FIG. 5) functioning as a driving force transmitting portion is at a retracted position, so that it does not interfere with the cartridge B which is being inserted for mounting. When the cover 109 is closed, the coupling 134 provided in the main assembly A or the apparatus is brought into engagement with a coupling 107*a* (FIG. 6) of the drum 107 of the cartridge B functioning as a driving force receiving portion. Then, the process cartridge is capable of receiving a driving force for rotating the photosensitive drum 107 from the main assembly A of the apparatus. As described in the foregoing, the electrophotographic image forming apparatus 100 comprises a main assembly A and a process cartridge B demountably mounted to the main assembly A.

(3) Charging Input Electrical Contact Member of Cartridge B

A description will be provided as to an input electrical contact member 141, provided in the cartridge B, for receiving a voltage for charging the photosensitive member.

Figure 8:
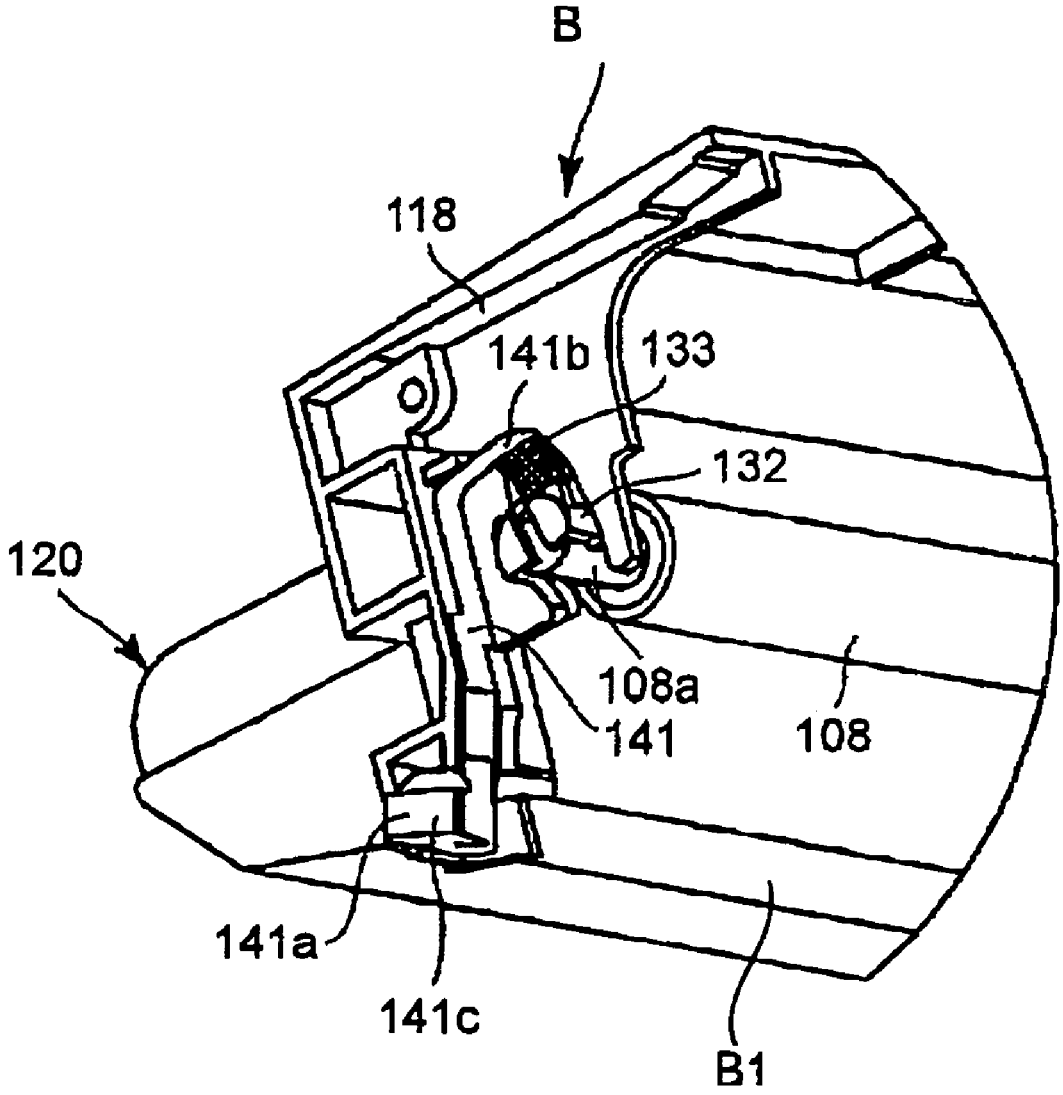
FIG. 8 is a perspective view which illustrates a structure of a drum unit of the process cartridge in the embodiment of the present invention.

FIG. 8 is a perspective view wherein a side of the drum frame 118 has been removed so that the inside of the drum frame 118 can be seen. FIGS. 10(*a*) and (*b*) are side views of the cartridge B.

As shown in FIGS. 8, 10(*a*), and 10(*b*), the drum unit 120 is provided with the input electrical contact member (input electrical contact member) 141 for receiving a charging voltage to be supplied to the charging roller 108 from the main assembly A of the apparatus (charging input electrical contact member). The input electrical contact member 141 is mounting on the drum frame 118. A charging input electrical contact (input electrical contact) 141*a*, which is a part of input electrical contact member 141, is provided on a side surface 120*b*1 at the other longitudinal (longitudinal direction of the drum 107) end 120*b* of the drum frame 118 (FIG. 7), and is exposed there.

More particularly, the input electrical contact 141*a* is disposed at a position downstream of the drum shaft 139 with respect to a direction X in which the cartridge B is inserted into the main assembly A of the apparatus. The input electrical contact member 141 is electrically connected with the charging roller 108 within the drum unit 120.

As shown in FIG. 8, a metal shaft 108*a* of the charging roller 108 is rotatably supported by charging roller bearings 132 made of electroconductive resin material. In this manner, the charging roller 108 is mounted on the drum frame 118. Between the bearing 132 and the drum frame 118, a metal spring (elastic member) 133 is provided. This spring 133 provides an elastic force to press the charging roller 108 against the photosensitive drum 107 (not shown in FIG. 8).

The input electrical contact member 141 includes an electrical contact 141*a* for contact with the output contact 144*a* and an electrical contact 141*b* for contact with the spring 133. The input electrical contact member 141 is constituted by an integral metal plate and is mounted to the drum frame 118.

Therefore, the input electrical contact 141*a* is electrically connected with the charging roller 108 through the electrical contact 141*b*, the spring 133, bearing 132 and the metal shaft 108*a*.

As shown in FIG. 10(*b*), one end of the input electrical contact member 141 is exposed at substantially the bottom end of the drum unit 120 and the side surface 120*b*1. In the exposed region 141*c* in which the input electrical contact member 141 is exposed, the input electrical contact 141*a* is disposed. However, in this embodiment, the input electrical contact 141*a*, which is exposed at the side surface 120*b*1, is covered by a cartridge movable operation member 142 as shown in FIG. 10(*a*), when the cartridge B is not mounted to the main assembly A of the apparatus (rest position). The input electrical contact member 141 is disposed within the drum unit 120 except for the portion exposed at the bottom and side surface 120*b*1 of the drum unit 120. The stand-by position is the position where rotation of the movable operation member 142 in the direction of an arrow a is stopped, and is the position shown in FIG. 10(*a*). The structure of the movable operation member 142 will be described in detail hereinafter.

(4) Movable-Operation Member of Cartridge B

Figure 9:
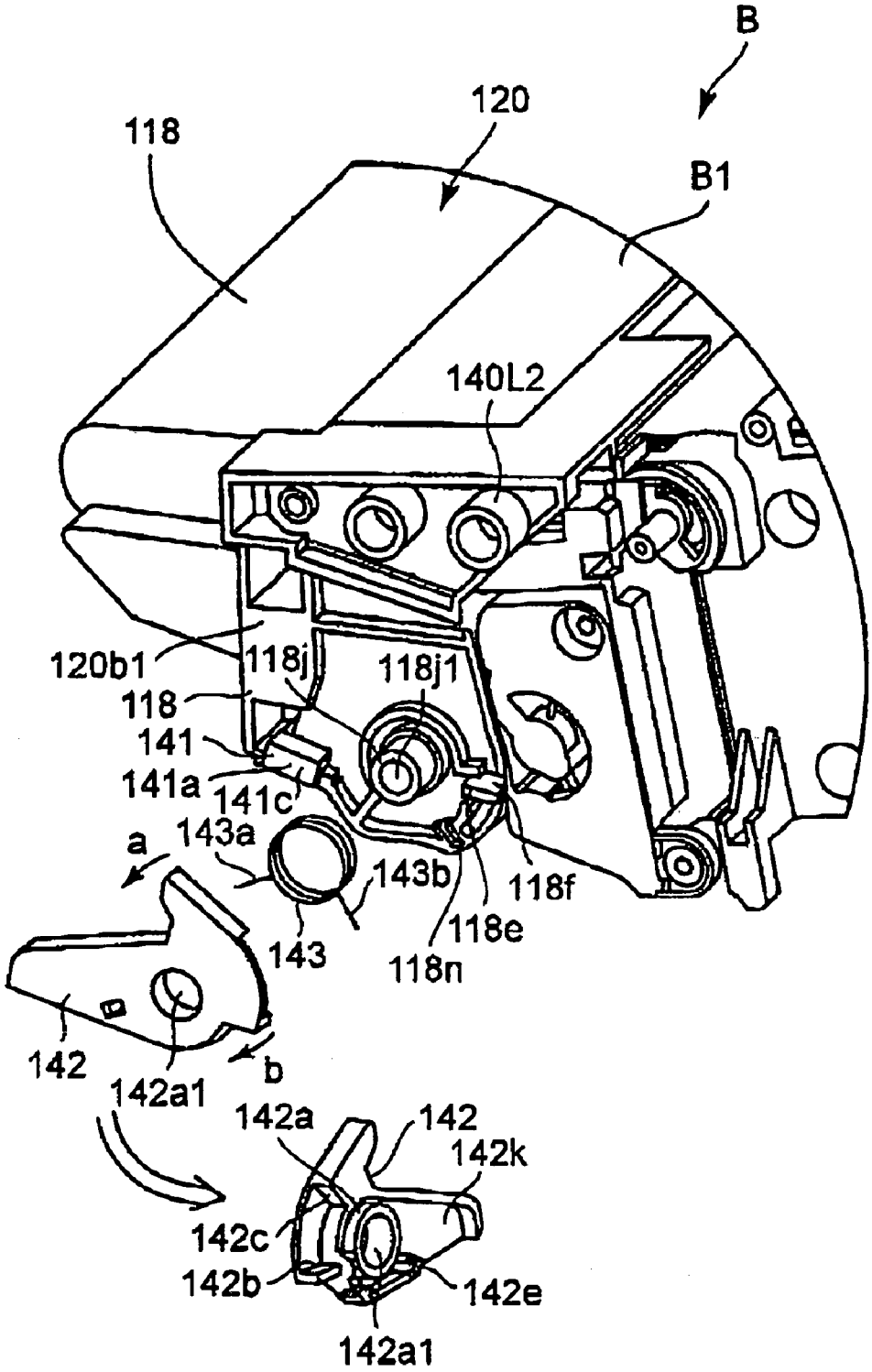
FIG. 9 is an exploded perspective view which illustrates a structure of a movable operation member of the process cartridge according to the embodiment of the present invention.

Referring to FIG. 9, the description will be made as to the structure of the movable operation member 142 mounted on the cartridge B.

As shown in FIG. 9, the drum unit 120 is provided with the movable operation member 142. The movable operation member 142 is rotatably mounted on the side surface 120*b*1 of the drum frame 118. A shaft 118 is provided on the side surface 120*b*1 and is engaged with a hole 142*a*1 of a cylindrical portion 142*a* provided in a back side 142*k* of the movable operation member 142. Thereafter, the drum shaft 139 (FIG. 7) is press-fitted in the hole 118*j*1 of the shaft 118*j*. By doing so, the movable operation member 142 is rotatably mounted in the drum frame 118 by the drum shaft 139. The movable operation member 142 is thus mounted coaxially with the rotational axis of the photosensitive drum 107.

In this manner. The movable operation member 142 is rotatable about the shaft 118*j*, and therefore, when the cartridge B is mounted into or demounted from the main assembly A of the apparatus, the movable operation member 142 can be rotated. In addition, since the movable operation member 142 is engaged with the shaft 118*j*, the movable operation member 142 can be easily assembled with the drum frame 118. Furthermore, since the shaft 139 is also a photosensitive drum shaft, the cartridge B can be downsized. This is because there is no need to provide an additional shaft and no need to prepare a space therefor. In addition, the movable operation member 142 is mounted on a side surface 120*b*1 of the cartridge B, and therefore, assembling is easy.

The cylindrical portion 142*a* is provided with an elastic function member (for example, a coil spring) 143. One end of the arm portion 143*a* of the member 143 is hooked on a locking portion 142*e* provided on a back side of the movable operation member 142. The other end of the arm portion 143*b* of the elastic function member 143 is engaged with a groove 118*n* formed in the side surface 120*b*1. By doing so, the elastic function member 143 urges by the elastic force thereof the movable operation member 142 in a rotational direction indicated by an arrow a FIGS. 9, and 10(*a*). The back side abutting portion 142*b* on the back side 142*k* of the movable operation member 142 urged by the elastic function member 143 abuts an abutting portion 118*e* of the drum frame 118. Thus, the movable operation member 142 is limited in the rotation range in the direction of the arrow a.

When the movable operation member 142 rotated in the direction indicated by an arrow b in FIGS. 9, and 10(*b*), the abutting portion 142*c* on the back side 142*k* is abutted to an abutting portion 118*f* provided on the drum frame 118. In this manner, the movable operation member 142 is limited in the rotation range in the direction of the arrow b.

The rotating operation of the movable operation member 142 will be described hereinafter.

In this embodiment, the provision of the elastic function member 143 is not inevitable. For example, the movable operation member 142 may be kept at the stand-by position by providing a relatively large frictional force between the drum frame 118 and the sliding surface of the back side 142*k* of the movable operation member 142 or by using a snap fit structure or the like. However, the use of the elastic function member 143 is advantageous as will be described hereinafter. FIGS. 10(*a*) and (*b*) illustrate the states wherein the movable operation member 142 is rotated in the direction of arrow a and in the direction of arrow b. In the state of FIG. 10(*a*), the movable operation member 142 has been rotated in the direction of arrow a and is kept at the stand-by position. In this stand-by state, the exposed region 141*c* of the input electrical contact member 141 is covered by the movable operation member 142. In the state shown in FIG. 10(*b*), the movable operation member 142 has been rotated in the direction of arrow b. In this state, the exposed region 141*c* is exposed.

When the cartridge B is not mounted in place in the main assembly A of the apparatus, the movable operation member 142 takes the position shown in FIG. 10(*a*). In this state, the electrical contact 141*a* located at the exposed region 141*c* is covered by the movable operation member 142. Therefore, the operator is protected from inadvertently touching the exposed region 141*c*, inter alia, the input electrical contact 141*a*. In addition, foreign matter is prevented from being depositing there.

Here, it is not inevitable to cover the exposed region 141*c* by the movable operation member 142. This will be described hereinafter.

(5) Charging Output Contact Member 144

A description will be provided as to a charging output contact member 144 provided in the main assembly A of the apparatus.

Figure 11:
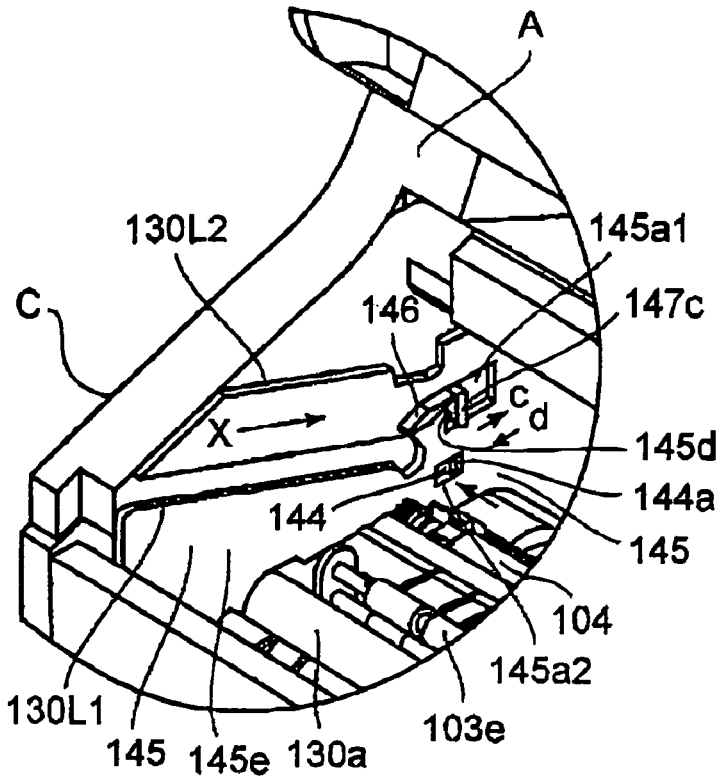
FIGS. 11(*a*) and 11(*b*) are perspective views which illustrate a structure of an electrical contact portion provided in the main assembly of the image forming apparatus according to the embodiment of the present invention.
Figure 11:
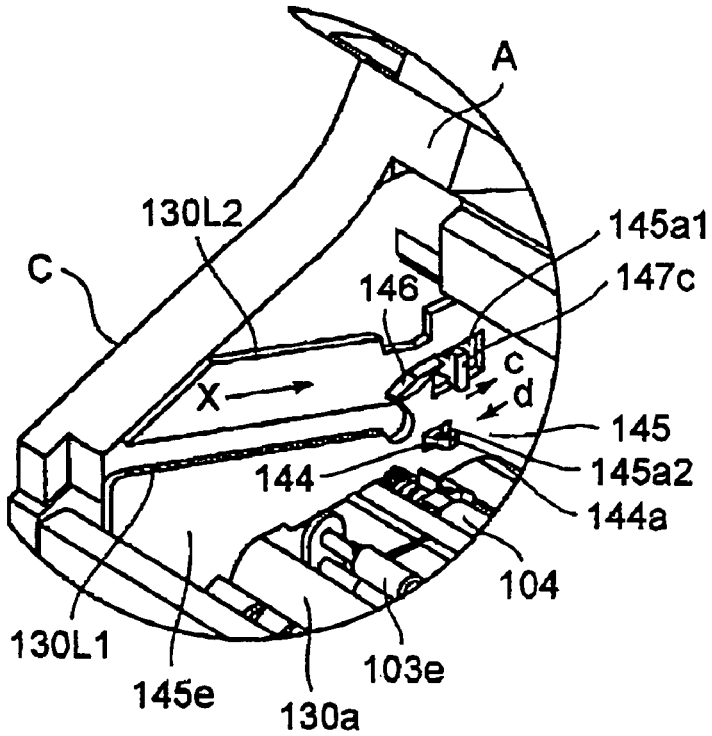

As shown in FIGS. 11(*a*) and 11(*b*), on an inside side plate 145 of the main assembly A of the apparatus is provided with a charging output contact member (output contact member) 144, contacted to the input electrical contact 141*a*, for applying a charging voltage to the input electrical contact 141*a*.

A charging output contact (output contact) 144*a*, which is a part of the output contact member 144, is contacted to the input electrical contact 141*a*. When the cartridge B is not mounted in the main assembly A of the apparatus, the output contact 144*a* is placed at a retracted position with respect to the outer surface of the inside side surface 145*e* of the side plate 145 in the main assembly A of the apparatus. That is, the output contact 144*a* is at the retracted position which is behind the side surface 145*e* so that it is not projected into the cartridge mounting portion 130*a*.

By doing so, even if the operator inserts his or her hand into the main assembly A of the apparatus for a maintenance operation or the like for the main assembly A, the hand does not easily touch the output electrical connection member 144, inter alia, the output contact 144*a*. Therefore, the contact member 144 and the electrical contact 144*a* are protected from the deposition of foreign matter. Also, they are protected from being damaged. There is a possibility that the operator could inadvertently touch the contact member 144 and the electrical contact 144*a* with the result that electric circuit E, which will be described hereinafter, may be damaged by electrostatic discharge from a charged human body. This damage can be avoided by this structure. Therefore, the reliability of the electrical connection between the cartridge B and the main assembly A of the apparatus can be improved.

In addition, the output contact member 144 is electrically connected by lead lines with the electric circuit (voltage source circuit) E (FIG. 16) provided on an electrical circuit board EC. More particularly, the output contact 144*a* is movable between the electrical connecting position and the retracted position where it is retracted from the electrical connecting position and is placed in the cartridge mounting portion 130*a*, and the output contact 144*a* is electrically connected with the voltage source S (FIG. 16) through the electric circuit E.

As will be best seen in FIGS. 11(*a*), 11(*b*), 12, 13(*a*) and 13(*b*), the side plate 145 is provided with a fixed engageable member 146 which is fixed to the side plate 145 and is projected toward the cartridge mounting portion 130*a*. At the downstream side of the fixed engageable member 146 with respect to the mounting direction X of the cartridge B, there is provided a displaceable engaging portion 147*c* (FIG. 13(*b*)) provided at one end of the displaceable member 147, and it projects toward the mounting portion 130*a* through an opening 145*a*1 formed in the side plate 145.

More particularly, the displaceable member 147 is provided with the displaceable engaging portion 147*c*. The displaceable member 147 displaces the output contact 144*a* between the retracted position and the electrical connecting position. The engaging portion 147*c* is disposed downstream of the fixed engageable member 146 with respect to the inserting direction X in which the cartridge B is inserted into the main assembly A of the apparatus. In other words, at least a part of the engaging portion 147*c* with respect to the inserting direction X, is positioned behind the engageable member 146.

Accordingly, even if the operator inserts his or her hand into the main assembly A of the apparatus for the purpose of maintenance operations of the main assembly A of the apparatus, the probability of the hand inadvertently touching the engaging portion 147*c* can be decreased. Therefore, the output contact 144*a* is prevented from moving into the electrical connecting position in the state that cartridge D is not mounted to the mounting portion 130*a*. In this manner, the above-described advantageous effects can be provided.

With this structure, as shown in FIGS. 11(*a*) and (*b*), the engaging portion 147*c* moves in the direction of the arrow c or the direction of arrow d in interrelation with mounting and demounting of the cartridge B.

As shown in FIG. 11(*b*), the engaging portion 147*c* is pushed by the movable operation member 142 (FIGS. 10(*a*) and 10(*b*)) in the direction of arrow c in the process of mounting the cartridge B into the main assembly A of the apparatus. Then, the output contact 144*a* interrelated with the operation of the displaceable member 147 having the engaging portion 147*c*, pops into the cartridge mounting portion 130*a* or space through the opening 145*a*2 formed in the side plate 145.

By doing so, the output contact 144*a* is brought into contact with the input electrical contact 141*a* in the process of mounting of the cartridge B into the main assembly A of the apparatus. Thus, the charging roller 108 is capable of receiving the voltage from the main assembly A of the apparatus through the electric circuit E in response to the control operation of the CPU200 (FIG. 16) provided in the circuit board EC.

Figure 13:
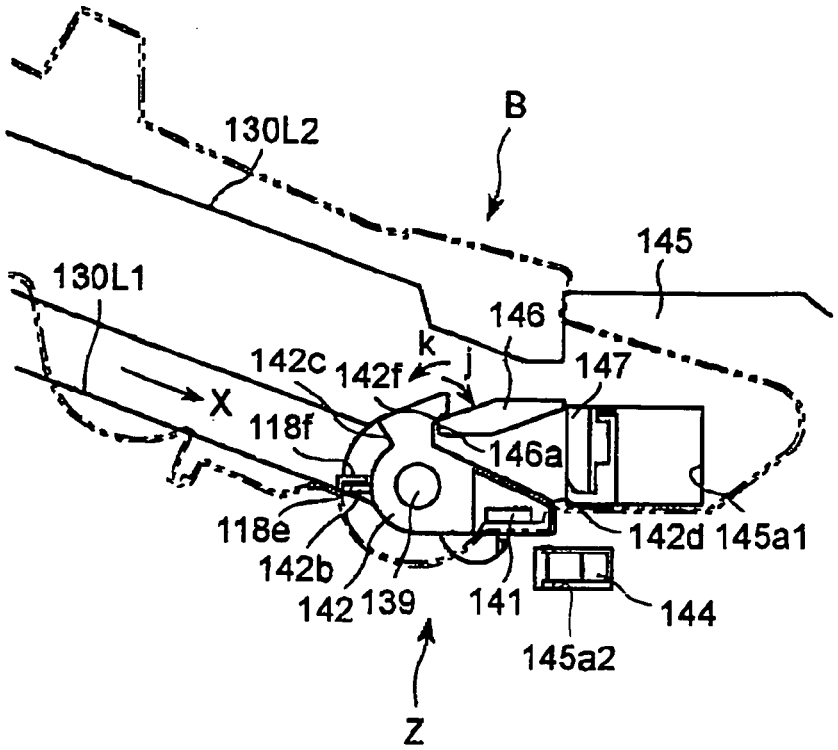
FIGS. 13(*a*) and 13(*b*) are schematic views which illustrate structures of the movable operation member and the electrical contact of the image forming apparatus according to the embodiment of the present invention.
Figure 13:
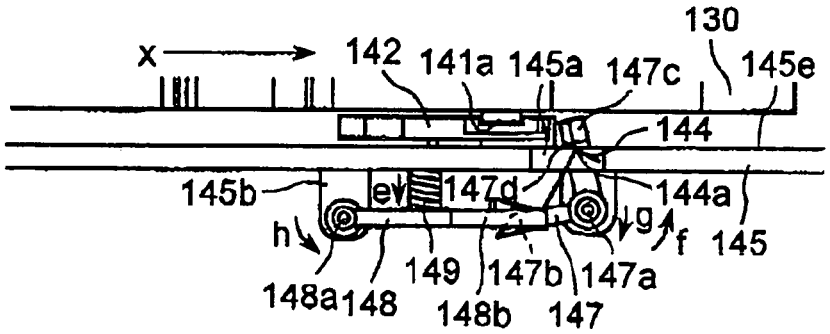

When the cartridge B is not placed in the main assembly A of the apparatus, the displaceable engaging portion 147*c* moves in the direction of arrow d in FIG. 11(*b*) by an elastic force provided by the elastic function member (for example, compression spring) 149 (FIG. 13(*b*)). In interrelation with the operation of the displaceable member 147, which is integral therewith, the output contact 144*a* is retracted to the outside of the side plate 145, namely, opposite from the mounting portion 130*a* with respect to the side plate 145 (FIG. 11(*a*)). As will be understood from FIG. 11(*a*), the movement of the engaging portion 147*c* in the direction of arrow d is limited by an edge of the opening 145*a*1 formed in the side plate 145. When the process cartridge B is dismounted from the main assembly A of the apparatus, the operations and movements of the elements are opposite from those during the mounting or inserting operation.

(6) Internal Structure of Main Assembly an of Apparatus

Figure 12:
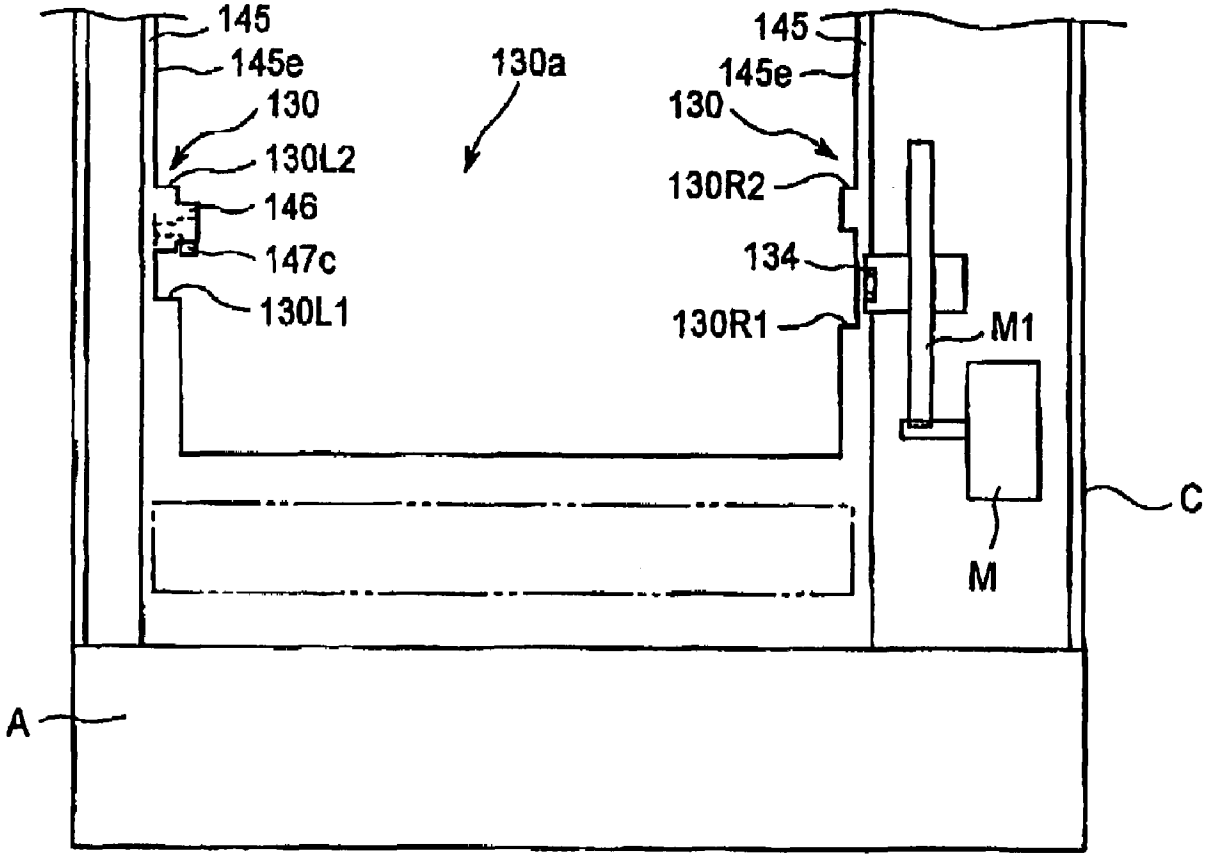
FIG. 12 is a schematic front view which illustrates a structure of a mounting portion provided in the main assembly of the image forming apparatus according to the embodiment of the present invention.

Referring to FIG. 12, a description will be provided as to the internal structure of the main assembly A of the apparatus. FIG. 12 is a front view of the inside of the main assembly A of the apparatus as seen from the front side D, that is, in the direction of mounting the cartridge B (FIG. 3).

Figure 16:
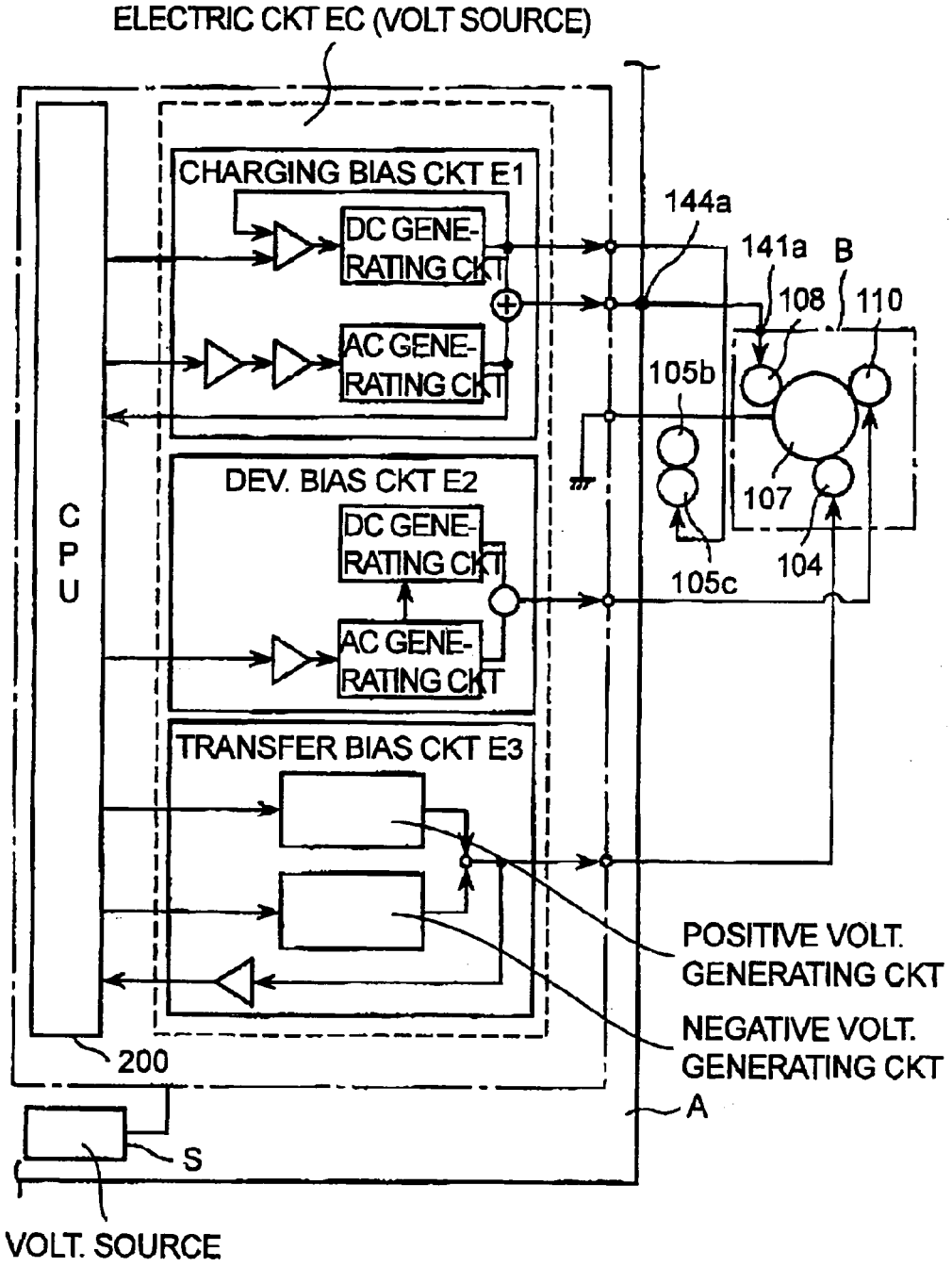
FIG. 16 illustrates a structure of a circuit board in the image forming apparatus according to the embodiment of the present invention.

On the inner bottom surface of the main assembly A of the apparatus, that is, the bottom surface of the cartridge mounting portion 130*a*, there is a circuit board EC (FIG. 16). At one lateral side of the mounting portion 130*a* with respect to the mounting direction, there is disposed a motor M and a driving gear train (driving force transmitting means) M1 for transmitting the driving force from the motor M to the coupling 134 or the like, outside the inside side surface 145*e* of the inner side plate 145.

At the opposite lateral side of the mounting portion 130*a*, the displaceable engaging portion 147*c* is disposed downstream of the fixed engageable member 146 with respect to the inserting direction X of the cartridge B relative to the main assembly A of the apparatus. In addition, at least a part of the engaging portion 147*c* is overlapped with the fixed engageable member 146 as seen in the inserting direction X. In other words, a part of the engaging portion 147*c* is behind the fixed engageable member 146 as seen in the inserting direction X.

For this reason, even if the operator inserts his or her hand from the front side side D into the main assembly A of the apparatus for the purpose of maintenance (jam clearance operation or the like) after the cartridge B is dismounted, the hand is blocked by the fixed engageable member 146. Therefore, the displaceable engaging portion 147*c* is protected from inadvertently being accessed by the operator. The output contact 144*a* (not shown in FIG. 12) placed in the retracted position is prevented from moving unintentionally to the electrical connecting position.

(7) Operations of Movable Operation Member and Charging Output Contact Member

A description will be provided as to the operations of the movable operation member 142 and the charging output contact member 144. FIGS. 13(*a*), 13(*b*), 14(*a*), 14(*b*), 15(*a*), and 15(*b*) are schematic illustrations of operations when the cartridge B is inserted into the image forming apparatus 100.

Figure 14:
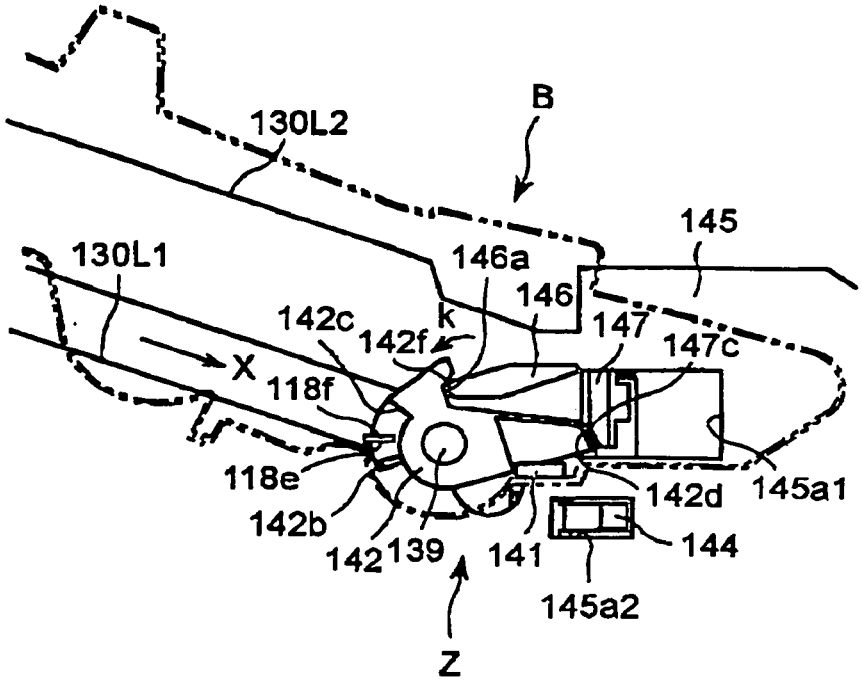
FIGS. 14(*a*) and 14(*b*) are schematic views which illustrate structures of the movable operation member and the electrical contact of the image forming apparatus according to the embodiment of the present invention.
Figure 14:
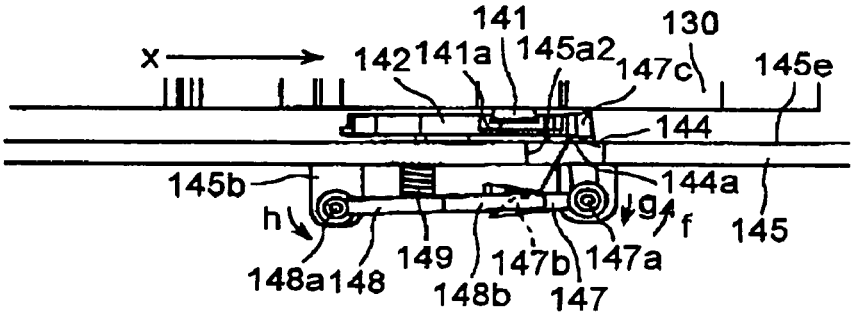
Figure 15:
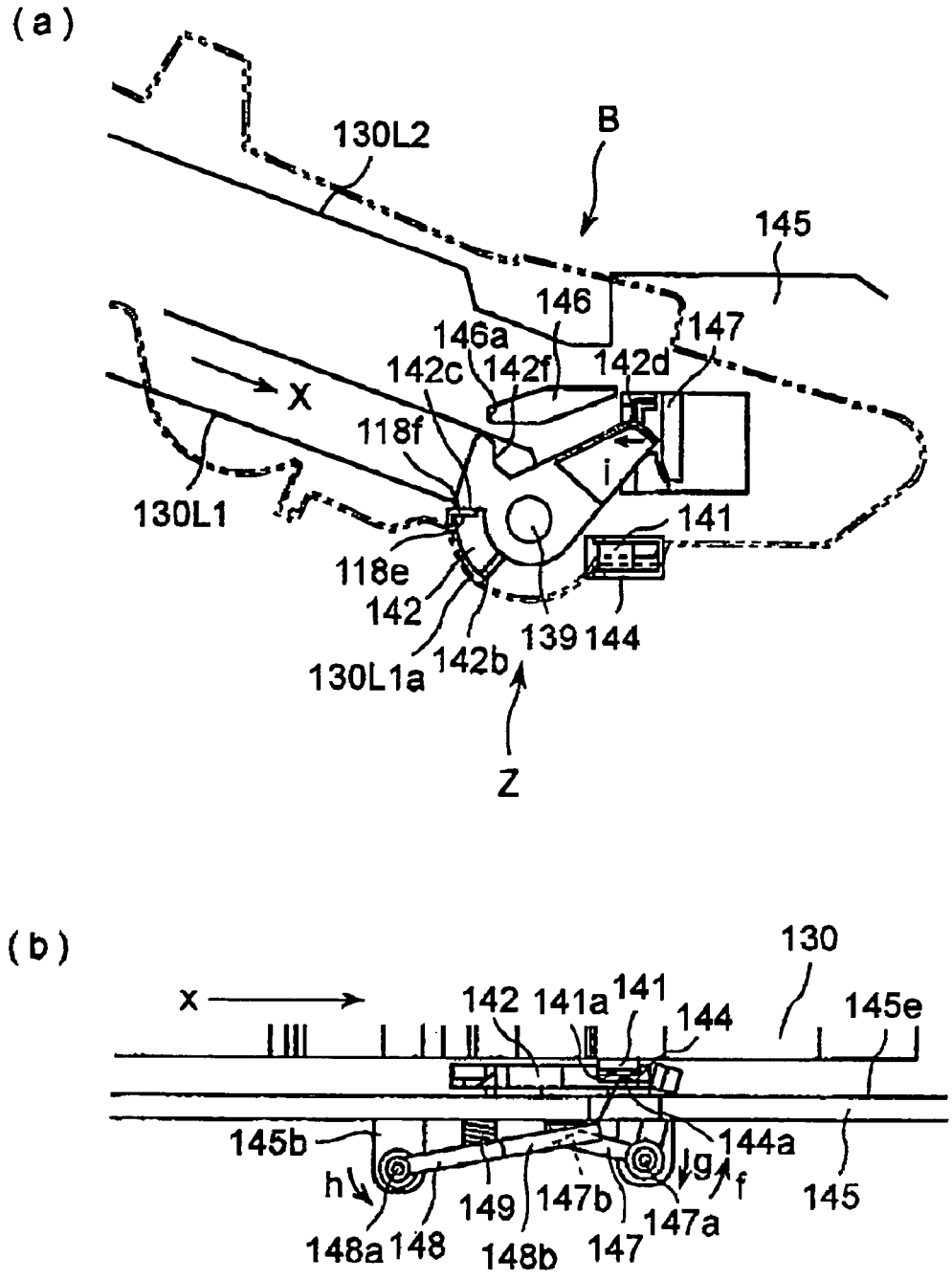
FIGS. 15(*a*) and 15(*b*) are schematic views which illustrate structures of the movable operation member and the electrical contact of the image forming apparatus according to the embodiment of the present invention.

FIG. 13(*a*), FIG. 14(*a*) and FIG. 15(*a*) are views as seen in the direction from the mounting portion 130*a* to the side plate 145. FIG. 13(*b*), FIG. 14(*b*) and FIG. 15(*b*) are views as seen in the direction of an arrow Z in FIG. 13(*b*), FIG. 14(*b*) and FIG. 15(*b*), respectively.

As will be understood from these figures, the displaceable engaging portion 147*c* is rotatably mounted on the outside of the side plate 145 (opposite side from the side having the mounting portion 130*a* with respect to the side plate 145). The displaceable engaging portion 147*c* is rotatable about the shaft portion 147*a*.

The output contact member 144 is mounted on the supporting member 148. The supporting member 148 is mounted, for rotation about the shaft portion 148*a*, to the mounting portion 145*b* of the side plate 145. The supporting member 148 is urged in the direction of an arrow e (FIG. 13(*b*)) by an elastic force provided by the elastic function member (for example, compression spring) 149. The displaceable member 147 and the supporting member 148 are abutted to each other at the abutting portions 147*b*, 148*b* thereof. Therefore, the displaceable member 147 and the supporting member 148 are interrelated with each other.

By the urging of the supporting member 148 in the direction of arrow e by the elastic function member 149 (FIG. 13(*b*)), the displaceable member 147 is rotated in the direction of an arrow f. Then, the abutting portion 147*d* is abuted to the edge of the opening 145*a*1 of the side plate 145. By this, the displaceable member 147 is correctly positioned. At this time, the output contact 144*a* is placed in the retracted position where it is not projected beyond the side plate 145 into the inside of the main assembly A of the apparatus, that is, the output contact 144*a* is retracted from the electrical connecting position where the output contact 144*a* is electrically connected with the input electrical contact 141*a*. In other words, the output contact 144*a* is positioned out of the mounting portion 130*a*. Thus, the elastic function member 149 functions to elastically urge the displaceable member 147 to move the output contact 144*a* to the retracted position from the electrical connecting position and keep it there.

FIGS. 13(*a*) and (*b*) illustrate the states in the process of inserting the cartridge B into the main assembly A of the apparatus. More particularly, in FIGS. 13(*a*) and (*b*), the cartridge B has been inserted to such a position that the movable operation member 142 is in a position just before contacting to the fixed engageable member 146. The cartridge B is inserted in the direction of the arrow X along the mounting guide portions 130L1, 130L2.

As has been described in the foregoing, the movable operation member 142 is urged in the direction of the arrow j (FIG. 13(*a*)) by the elastic force provided by the elastic function member 143. The abutting portion 142*b* of the movable operation member 142 is abutted to the abutting portion 118*e*. As has been described, the output contact 144*a* is kept in the retracted position where it is not-projected out beyond the side plate 145 into the mounting portion 130*a*.

In FIGS. 14(*a*) and (*b*), the cartridge B has been further inserted from the position shown in FIGS. 13(*a*) and 13(*b*). In the state of FIGS. 14(*a*) and 14(*b*), a first engaging portion 142*f* of the movable operation member 142 is brought into contact to the engaging portion 146*a* of the fixed engageable member 146. By this, the movable operation member 142 starts rotating in accordance with further insertion of the cartridge B in the direction of an arrow k (FIG. 14(*a*)). In this manner, the operation member 142 moves relative to the drum frame 118 (cartridge frame). This causes the abutting portion 142*b* to separate from the abutting portion 118*e*.

By the movement of the movable operation member 142 relative to the drum frame 118, the movable operation member 142 moves or rotates to such a position that movable operation member 142 is capable of passing under the engaging portion 146, and the second engaging portion 142*d* abuts the displaceable engaging portion 147*c* (FIG. 14(*a*)). Thus, when the cartridge B is inserted into the main assembly A of the apparatus, the first engaging portion 142*f* is brought into engagement with the fixed engageable member 146 and is rotated thereby, by which the second engaging portion 142*d* at the free end of the operation member 142 is moved to a position of engagement to the engaging portion 147*c*.

With further insertion of the cartridge B, the second engaging portion 142*d* pushes the engaging portion 147*c* of the displaceable member 147. This rotates the displaceable member 147 in the direction of an arrow g (FIG. 14(*b*)). By this, the supporting member 148 is rotated in the direction of an arrow b (FIG. 14(*b*)). Therefore, the output contact 144*a* is projected beyond the side plate 145 into the inside of the main assembly A of the apparatus, that is, into the cartridge mounting portion 13*a*.

In this manner, the operation member 142 is rotated by the contact with the engaging portion 146*a* so that it can pass under the engaging member 146.

When the engageable member 142*d* is engaged with the engaging portion 147*c*, the operation member 142 is disengaged from the engageable member 146 and not contacted therewith. Therefore, the movement of the operation member 142 is not limited by the engageable member 146, so that second engaging portion 142*d* can be assuredly engaged with the engaging portion 147*c*.

On the other hand, the movable operation member 142 moves from the position covering the input electrical contact 141*a* (FIG. 10(*a*)) to the position exposing the contact 141*a* (FIG. 10(*b*)).

FIGS. 15(*a*) and (*b*) show the state in which the cartridge B is further inserted to the complete set position in the main assembly A of the apparatus. With the insertion of the cartridge B, the second engaging portion 142*d* further rotates the displaceable member 147 in the direction of the arrow g (FIG. 15(*b*)). In interrelation therewith, the output contact 144*a* is further projected into the main assembly A of the apparatus beyond the side plate 145. The output contact 144*a* is then brought in to contact to the exposed input electrical contact 141*a*. At this time, the movable operation member 142 passes under the fixed engageable member 146 and is separated from the fixed engageable member 146. The movable operation member 142 receives a reaction force from the displaceable member 147 in the direction of an arrow i (FIG. 15(*a*)), by which the abutting portion 142*c* is abutted to the abutting portion 118*f* and is correctly positioned.

Thus, the movable operation member 142 is movable relative to the drum frame 118 (cartridge frame). When the cartridge B is inserted into the main assembly A of the apparatus, the movable operation member 142 is engaged with the fixed engageable member 146 fixed on the main assembly A of the apparatus and is moved relative to the drum frame 118. After the movable operation member 142 is engaged the fixed engageable member 146, it is engaged with the engaging portion 147*c* of the displaceable member 147 to move the output contact 144*a* from the retracted position to the electrical connecting position against the elastic force of the elastic function member 149. More particularly, when the cartridge B is inserted into the main assembly of the apparatus, the operation member 142 is engaged with the engaging member 146, and moves the engaging member 146 relative to the drum frame 118 to a retractable position to permit the further insertion of the cartridge B. The operation member 142, after engaging with the engaging member 146, engages with the displaceable engaging portion 147*c* to push the displaceable engaging portion 147*c*. By this, the contact 144*a* is moved from the retracted position to the electrical connecting position.

The movable operation member 142 further includes the elastic function member 143 for applying an elastic force to the movable operation member 142, and when it is engaged with the fixed engageable member 146, it moves relative to the drum frame 118 against the elastic force of the elastic function member 143.

The movable operation member 142 includes the first engaging portion 142*f* engageable with the fixed engageable member 146 and the second engaging portion 142*d* engageable with the displaceable engaging portion 147*c*. When the movable operation member 142 is inserted into the main assembly A of the apparatus, the movable operation member 142 is moved relative to the drum frame 118 by engagement of the first engaging portion 142*f* with the fixed engageable member 146. The movable operation member 142 moves the output contact 144*a* from the retracted position to the electrical connecting position by engagement of the second engaging portion 142*d* with the engaging portion 147*c* of the displaceable member 147 after the engagement of the first engaging portion 142*f* with the fixed engageable member 146.

The electrical connecting position in this specification is a position where the input electrical contact 141*a* and the output contact 144*a* are electrically connected to each other. More particularly, it is the position where when the cartridge B is mounted to the mounting portion 130*a*, the input electrical contact 141*a* and the output contact 144*a* are electrically connected to each other.

The retracted position is a position where the output contact 144*a* is present when the cartridge B is not placed in the main assembly A of the apparatus. In the case that contact is at the retracted position, when the operators hand or the like enters the main assembly A of the apparatus, the hand or the like less easily touches the contact 144*a* than when the electrical contact 144*a* is at the electrical connecting position. Thus, when the electrical contact 144*a* is at the retracted position, the probability of the hand touching the contact 144*a* is lower than when the electrical contact 144*a* is at the electrical connecting position. In the specification, there are shown examples in which the retracted position is outside (opposite from the mounting portion 130*a* with respect to the side plate 145) the inner side surface 145*a* of the side plate 145 provided in the main assembly A of the apparatus, or the electrical contact 144*a* is disposed opposite from the mounting portion 130*a* with respect to the cover portion 171 (Embodiment 2), or the electrical contact 144*a* is disposed between vertical plates 145*f* (Embodiment 9), but this is not limiting, an may be at another position provided that above-described conditions are satisfied.

As described in the foregoing, according to this embodiment, in this embodiment, when the cartridge B is inserted into the main assembly A or the apparatus, the output contact 144*a* which has been kept in the retracted position is brought into contact with the input electrical contact 141*a* by the operations of the movable operation member 142, the displaceable member 147 and the supporting member 148. By the control of the CPU200 (FIG. 16), the voltage is supplied from the voltage source S (FIG. 16) to charging roller 108 through the electric circuit E, the output contact 144*a* and the input electrical contact 141*a*. In this embodiment, the voltage source S and the electrical contact 144*a* are always connected electrically with each other through the electric circuit E.

The input electrical contact 141*a* is contacted with the output contact 144*a* placed at the electrical connecting position to receive the voltage for operating the charging roller 108 (said process means).

(8) Circuit Board (Electric Circuit E)

Referring to FIG. 16, a description will be provided as to the circuit board EC provided in the main assembly A of the apparatus in this embodiment. The circuit board EC is disposed below the cartridge mounting portion 130*a*. The circuit board EC comprises the CPU200 and the electric circuit E (voltage source circuit).

The circuit board EC, more particularly, the electric circuit E is connected with the voltage source S. The electric circuit E is constituted by a charging bias circuit E1, a developing bias circuit E2 and a transfer/charging bias circuit E3.

The charging bias circuit E1 generates a negative DC voltage and an AC voltage. It applies a voltage in the form of a sum of these voltages to the charging roller 108. The charging roller 108 which receives the voltage and charges the photosensitive drum 107.

The charging bias circuit E1 applies the negative DC voltage also to the fixing roller 105*b* through a driving roller 105*c*. The developing bias circuit E2 generates a negative DC voltage and an AC voltage. The developing roller 110 is supplied with a voltage in the form of a sum of these voltages. The developing roller 110 receives the voltage to develop the electrostatic latent image with the developer. The transfer bias circuit E3 generates a positive or negative DC voltage. It applies positive or negative DC voltage to the transfer roller 104.

Thus, the charging roller 108 is supplied with the voltage from the voltage source S through the charging bias circuit E1. The fixing roller 105*b* and the driving roller 105*c* are supplied with the voltage from the voltage source S through the charging bias circuit E1. The developing roller 110 is supplied with the voltage from the voltage source S through the developing bias circuit E2. The transfer roller 104 is supplied with the voltage from the voltage source S through the transfer/charging bias circuit E3.

These circuits E1, E2, E3 are on-off-controlled in response to instructions from the CPU200 provided on the circuit board EC.

As described in the foregoing, according to this embodiment, even if the operator inserts his or her hand into the main assembly A of the apparatus for the purpose of jam clearance (removal of the recording material 102 from the main assembly A when the recording material 102 is jammed in the main assembly A) or for the purpose of the maintenance operation, the output contact 144*a* is not easily touched by the hand. This is because the output contact 144*a* is retracted to the retracted position. Therefore, (1) the output contact 144*a* is protected from the deposition of foreign matter (developer, grease, sweat or the like deposited on the hand). It is possible that grease or the developer on parts in the main assembly A of the apparatus contaminates the operator's hand, and if this occurs, it is liable to contaminate the output contact 144*a*. (2) Or, the output contact 144*a* is not damaged. (3) or, elements in the electric circuit E in the main assembly A of the apparatus (FIG. 16) can be prevented from receiving the damage which may be caused by the electrostatic noise. This is because static electricity of the human body may be applied on the output contact 144*a*. This is an electrostatic noise, which, however, can be avoided according to this embodiment.

Accordingly, an electrical conduction defect from the voltage source S (FIG. 16) to the charging roller 108 can be suppressed by (1), (2) and (3). In this manner, the reliability of the electrical connection between the output contact 144*a* and the input electrical contact 141*a* can be improved.

As described in the foregoing, the engaging portion 147*c* of the displaceable member 147 is disposed downstream of the fixed engageable member 146 with respect to the inserting direction X, and at least a part of the engaging portion 147*c* as seen in the direction of the inserting direction X. Namely, as seen in the direction of the inserting direction X, at least part of the engaging portion 147*c* is positioned behind the engageable member 146. Therefore, even if the operator inserts his or her hand into the main assembly A of the apparatus for the purpose of a maintenance operation, such as jam clearance or the like, the engageable member 146 is effective to prevent the hand from touching the engaging portion 147*c*.

Thus, unintentional movement of the output contact 144*a* from the retracted position to the electrical connecting position can be avoided.

As has been described, in the process of insertion of the cartridge B into the main assembly A of the apparatus, the engaging portion 147*c* is moved against the elastic force of the elastic function member 149.

Therefore, a shock or impact on the cartridge B upon mounting to the mounting portion 130*a* by insertion of the cartridge B into the main assembly A of the apparatus can be buffered or eased by the elastic force. Thus, the shock or impact received by the cartridge B from the main assembly A of the mounting upon the mounting to the mounting-portion 130*a* can be reduced.

This is effective to prevent the damage of the main assembly A of the apparatus and the cartridge B attributable to such an impact. In addition, leakage of the developer from the cartridge B to the outside can be prevented. Furthermore, an impact upon contact or abutment between the output contact 144*a* and the input electrical contact 141*a* can be reduced. This is effective to prevent the damage of the contact members 141, 144.

Additionally, according to the foregoing embodiment, the movable operation member 142 is elastically urged toward the front side, that is, in the direction opposite to the inserting direction X by the elastic force of the elastic function member 143. When the cartridge B is inserted into the main assembly A of the apparatus, the operation member 142 is moved against the elastic force. Therefore, the impact can be reduced by the elastic force. In such a case, the impact can be buffered by a sum of the elastic force of the elastic function member 143 and the elastic force of the elastic function member 149. Thus, the adverse affect of the impact can be minimized.

In summary, this embodiment can provides the following advantageous effects:

(1) Even if the operator inserts his or her hands into the main assembly of the image forming apparatus for the purpose of a jam clearance operation or the like when the process cartridge is not mounted in the main assembly of the image forming apparatus, the electrical contact is not easily touched by the hand, since the output contact is not projected into the inside of the main assembly A of the apparatus beyond the inner side surface. As seen in the direction of insertion of the process cartridge into the main assembly of the image forming apparatus, the displaceable engaging portion which is effective to project the output contact is disposed behind the rear surface of the fixed engageable member which is fixed to the main assembly. Therefore, the operator cannot easily touch the displaceable engaging portion in the main assembly of the apparatus, either. Therefore, a conduction defect, which can be caused by deposition of sweat or grease or the like, on the electrical contacts can be avoided. In addition, the output contact member in the main assembly of the apparatus can be protected from the application of electrostatic noise, and therefore, failure of elements in the electric circuit in the main assembly of the apparatus can be avoided.

(2) By interrelating the motion of the movable operation member with the mounting and demounting operation of the cartridge, the operator does not need to do something particular in order to contact the electrical contacts.

(3) The contact member is disposed at the side opposite to the driving side, and therefore, the space in the main assembly of the image forming apparatus can be effectively utilized, thus accomplishing downsizing of the apparatus.

(4) The electrical contact of the process cartridge is disposed at the lower position, improving the assembling property of the apparatus. In this case, by moving the movable operation member upwardly, the movable operation member is not projected toward the main assembly of the image forming apparatus, so that main assembly of the image forming apparatus can be downsized.

(5) The movable operation member rotates about the shaft, and therefore, the motion of the movable operation member when the process cartridge is mounted to or demounted from the main assembly of the image forming apparatus can be made smooth.

(6) Since the movable operation member is engaged with the shaft, the assembling operation is easy.

(7) The movable operation member is urged by an elastic function member, such as a twisted coil spring, and when the process cartridge is inserted into the main assembly of the image forming apparatus, the movable operation member is moved against the elastic force. Thus, the impact upon the mounting of the process cartridge into the main assembly of the image forming apparatus can be minimized. By doing so, the damage to the process cartridge and/or the main assembly of the image forming apparatus, and/or the developer leakage can be prevented. By easing the impact upon the abutment between the electrical contact of the main assembly and the electrical contact of the process cartridge, the damage to the contact members can be avoided.

(8) In the case that the movable operation member is co-axial with the rotation shaft of the photosensitive drum, there is no need to use an additional rotational shaft so that the process cartridge can be downsized. By disposing the movable operation member on a side surface, the assembling property is improved.

Embodiment 2

Figure 17:
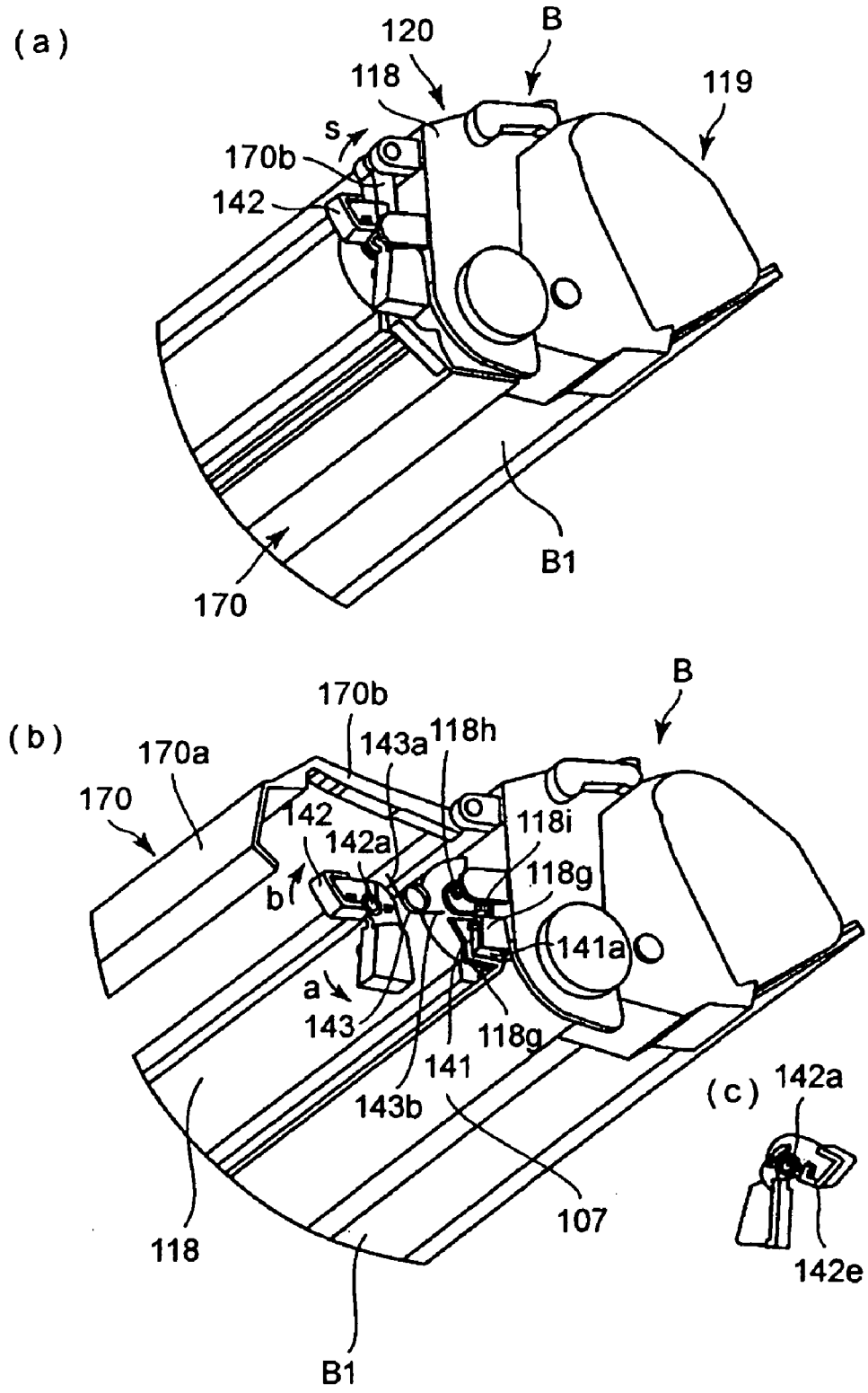
FIGS. 17(*a*)–17(*c*) are schematic perspective views which illustrate a structure of a movable operation member of a process cartridge according to another embodiment of the present invention.

Referring to FIGS. 17(*a*)–21(*b*), the second embodiment will be described.

In this embodiment, the structure of the cartridge B and the image forming apparatus 100 are similar to those of Embodiment 1 (FIGS. 1 and 2). The same reference numerals as in Embodiment 1 are assigned to the elements having the corresponding functions in this embodiment, and the detailed description thereof is omitted for simplicity.

(1) Movable Operation Member of Cartridge B

FIGS. 17(*a*)–19(*b*) are perspective views of a leading side portion of the cartridge B with respect to direction in which the cartridge B is mounted to the main assembly A of the apparatus according to this embodiment.

In this embodiment, the cartridge B comprises a drum unit 120 and a developing unit 119 integrally.

Adjacent a longitudinal end at a leading side of the cartridge B with respect to the mounting direction, there is provided an electrical contact 141*a* of a charging input electrical contact member 141 for applying a charging bias voltage to the charging roller 108. The electrical contact 141*a* is not projected beyond the surface of the drum frame 118 by the rib 118*g* surrounding it. A region adjacent a corner portion of the input electrical contact member 141 functions as a contact 141*a* for contact with the charging output contact 144*a* provided in the main assembly A of the apparatus.

Figure 18:
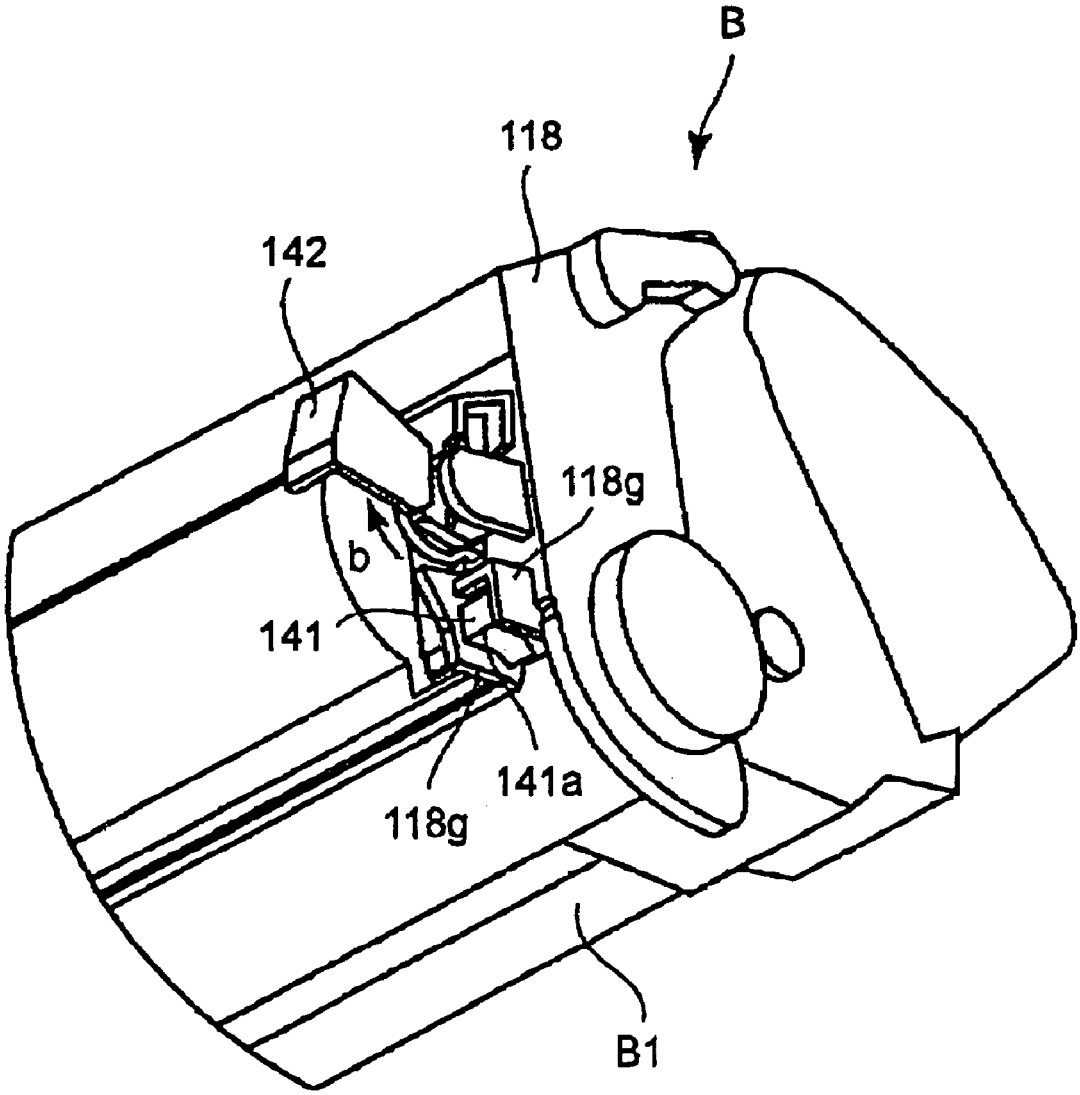
FIG. 18 is a schematic perspective view which illustrates a structure of the movable operation member of the process cartridge according to the embodiment of the present invention.

The drum frame 118 is provided with a drum shutter 170 for protecting a photosensitive drum 107. The drum shutter 170 has a shutter portion 170*a* covering the photosensitive drum 107 and supporting arms 170*b* at the opposite ends (only one end is shown), and is rotatable about a pivot. The drum shutter 170 rotates in the direction of an arrow s in interrelation with the cartridge B mounting operation into the main assembly A of the apparatus and moves from a protection position for protecting the photosensitive drum 107 (FIG. 17(*a*)) to an exposing position for exposing the photosensitive drum 107 (FIG. 17(*b*)). In FIGS. 18(*a*) and 18(*b*), the drum shutter 170 is omitted for simplicity.

In this embodiment, the drum frame 118 is provided with a movable operation member 142 which is rotatably mounted thereon by a shaft 118*h*. The movable operation member 142 is disposed outside of a path of the rotating supporting arm 170*b* with respect to the direction of the rotational shaft of the drum shutter 170.

To the movable operation member 142, a coll spring 143 (elastic function member) is mounted on a cylindrical portion 142*a* thereof, and one arm portion 143*a* thereof is hooked on a locking portion 142*e*. The other arm portion 143*b* is hooked on a locking portion 118*i* of the drum frame 118. By such a spring 143, the movable operation member 142 is biased in the rotational direction of arrow a. The movable operation member 142 urged by the spring 143 is positioned in the rotational direction by abutment of the abutting portion 142*b* to the abutting portion 118*e* of the drum frame 118 (FIG. 19(*a*)).

Figure 19:
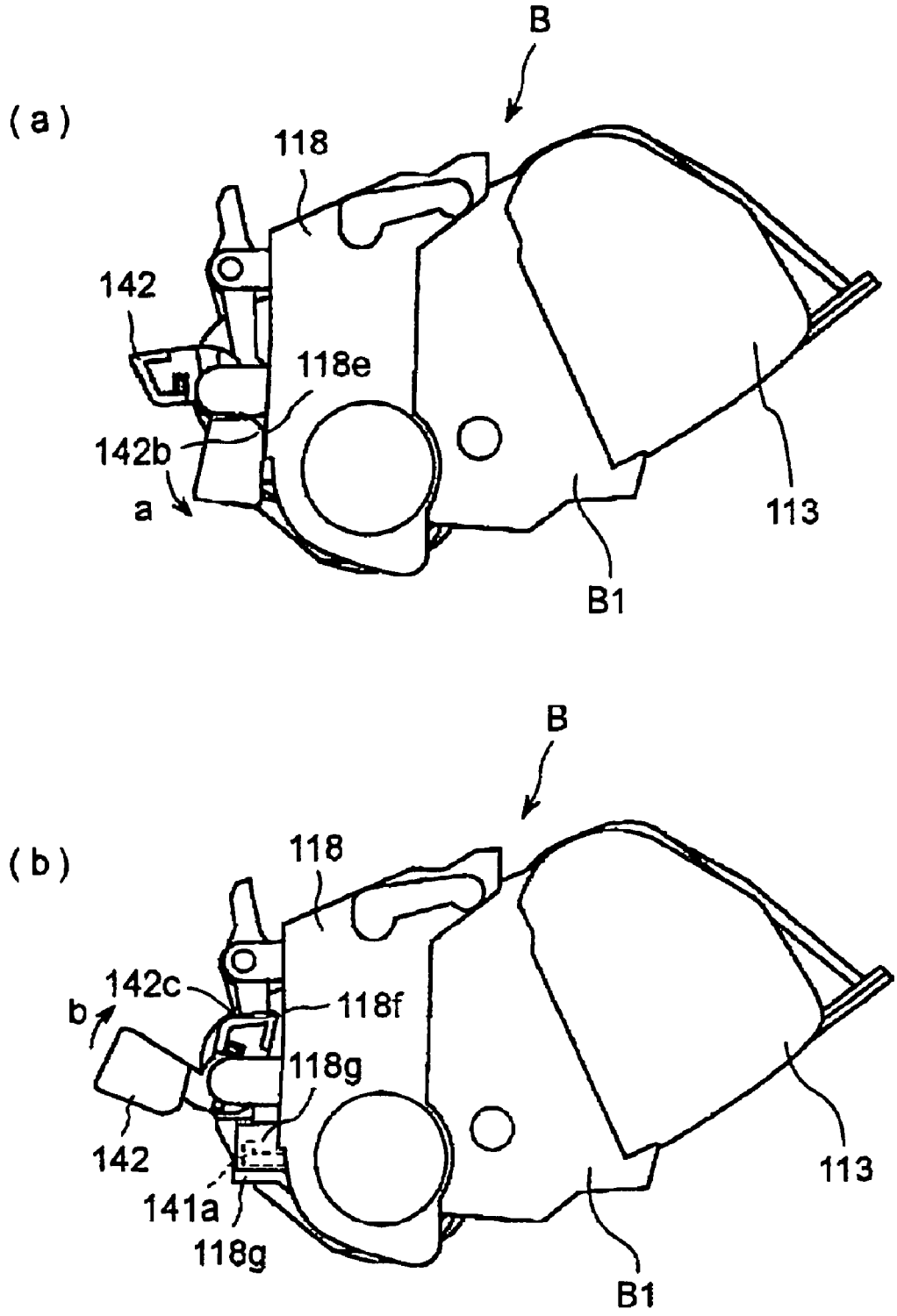
FIGS. 19(*a*) and 19(*b*) are schematic views which illustrate a structure of the movable operation member of the process cartridge according to the embodiment of the present invention.

The movable operation member 142 is rotatable in the direction of arrow b until the abutting portion 142*c* abuts the abutting portion 118*f* of the drum frame 118 (FIG. 19(*b*)).

(2) Charging Output Contact 144*a* of Main Assembly an of Apparatus

A description will be provided as to the main assembly A of the apparatus to which the cartridge B is mountable.

Figure 20:
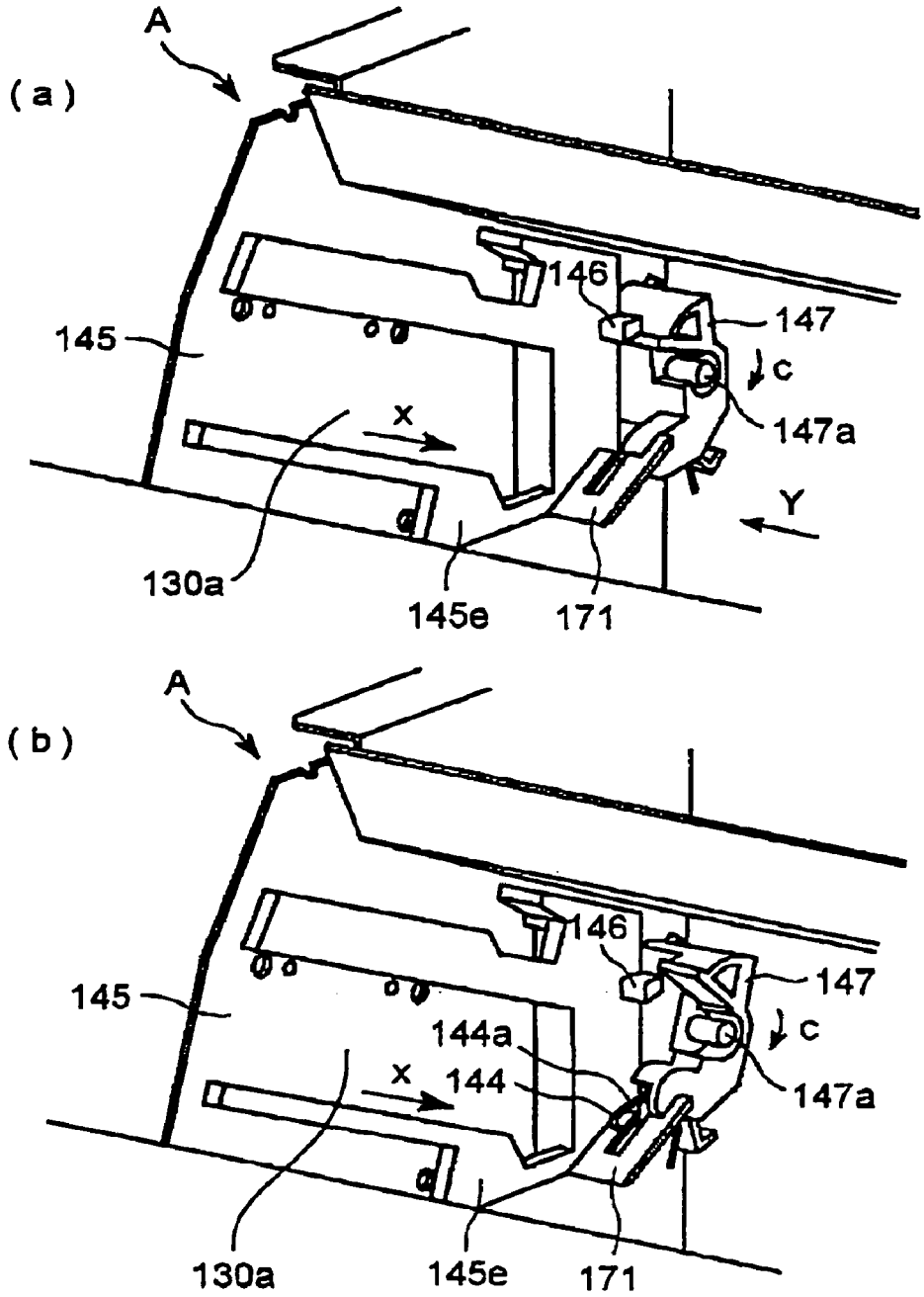
FIGS. 20(*a*) and 20(*b*) are schematic perspective views which illustrate a structure of an electrical contact portion in the main assembly of the image forming apparatus according to the embodiment of the present invention.

As shown in FIGS. 20(*a*) and 20(*b*), the inner side plate 145 of the main assembly A of the apparatus is provided with a charging output contact member 144 for applying the charging bias voltage through contact with the input electrical contact member 141 of the cartridge B.

When the cartridge B is not mounted in the main assembly A of the apparatus, the output contact member 144 is placed at a retracted position where it does not project into the inside of the main assembly A of the apparatus beyond the cover portion 171 which is provided on an inner side surface 145*e* of the inner side plate 145 of the main assembly A of the apparatus (FIG. 20(*a*)). Namely, the electrical contact 144*a* is retracted to the side opposite from the cover member 171 with respect to the inner side plate 145. The output contact member 144 is connected to an electric circuit E (FIG. 16) within the inside of the main assembly A of the apparatus through a lead wire or the like.

In the main assembly A of the apparatus, there is provided a fixed engageable member 146 for rotating the movable operation member 142 in interrelation with mounting operation of the cartridge B, and the fixed engagable member 146 is projected from the inside side surface 145*e* toward the inside. Downstream of the fixed engageable member 146 with respect to the mounting direction of the cartridge B, there is provided a displaceable member 147.

In this embodiment, the displaceable member 147 is rotatable about the shaft portion 147*a*. The displaceable member 147 rotates in interrelation with mounting and demounting operation of the cartridge B. As shown in (FIG. 20(*b*)), when the cartridge B is inserted into the main assembly A of the apparatus, the displaceable member 147 is urged by the movable operation member 142 of the cartridge B and rotates in the direction of arrow c. By this, the output contact member 144 projects to the outside electrical connecting portion beyond the cover portion 171. And, the output contact 144*a* is brought into contact to the contact 141*a* of the input electrical contact member 141 of the cartridge B.

(3) Operations of Movable Operation Member and Charging Output Contact

A description will further be provided as to the operations of the movable operation member 142 of the cartridge B and the charging output contact member 144 provided in the main assembly A of the apparatus.

Figure 21:
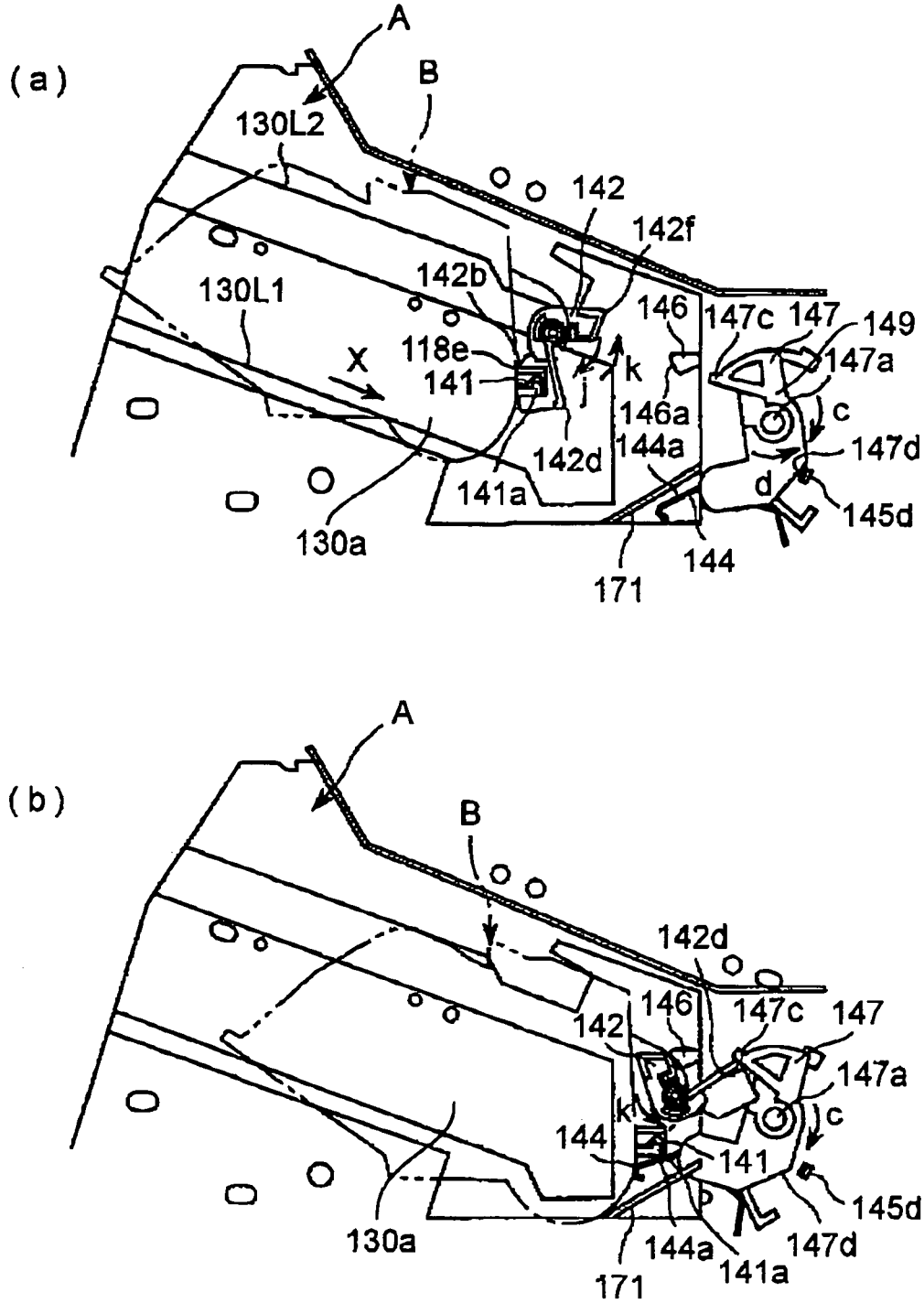
FIGS. 21(*a*) and 21(*b*) are schematic views that illustrate structures of the movable operation member and the electrical contact of the image forming apparatus.

FIGS. 21(*a*) and 21(*b*) are schematic illustrations of operations when the cartridge B is inserted into the main assembly A of the apparatus.

FIGS. 21(*a*) and 21(*b*) are views of the inner side plate 145 of the main assembly A of the apparatus as seen from inside of the main assembly A of the apparatus (FIG. 20(*a*) in the direction of arrow Y). FIG. 21(*a*), shows a state in the process of insertion of the cartridge B into the main assembly A FIG.21(*b*) shows a state in which the cartridge B is mounted in place in the main assembly A of the apparatus.

As shown in FIG. 21(*a*), the displaceable member 147 is mounted on the side plate 145 for rotation about the shaft portion 147*a*. The output contact member 144 is mounted on the member 147. The displaceable member 147 is urged by the coil spring 149 (elastic function member) in the direction of arrow d, so that abutting portion 147*d* is abutted to the abutting portion 145*d* of the side plate 145 and is kept there. At this time, the output contact member 144 is positioned at the retracted position such that it does not project beyond the cover portion 171 of the side surface 145*e* into the main assembly A of the apparatus. In other words, the electrical contact member 144 is placed at an outside position (retracted position) opposite from the mounting portion 130*a* with respect to the cover portion 171.

The cartridge B is inserted in the direction of an arrow X along the main assembly guides 130L1, 130L2.

When the cartridge is at the position shown in FIG. 21(*a*), the movable operation member 142 is biased in the direction of an arrow j by the elastic function of the coil spring 143 (elastic function member), as described hereinbefore. And, the operation member 142 is kept at the position where the abutting portion 142*b* is abutted to the abutting portion 118*e* of the drum frame 118. In addition, the output contact member 144 is kept at the retracted position where it does not project beyond the cover portion 171, as described hereinbefore.

When the cartridge B is further inserted from the position shown in FIG. 21(*a*), a first engaging portion 142*f* of the movable operation member 142 is brought into contact to the contact portion 146*a* of the fixed engageable member 146 provided fixed on the main assembly A of the apparatus. Thus, the operation member 142 is rotated in the direction of an arrow k. And, the second engaging portion 142*d* of the operation member 142 urges the displaceable engaging portion 147*c* or the displaceable member 147 upwardly. This rotates the displaceable member 147 in the direction of an arrow c. Thus, the charging output contact member 144 is projected beyond the cover portion 171. In accordance with these events, the electrical contact 144*a* is moved to an electrical connecting position from the retracted position.

As shown in FIG. 21(*b*), when the cartridge B is mounted completely to the mounting portion 130*a*, the output contact 144*a* projected beyond the cover portion 171 is contacted to the input electrical contact 141*a* of the cartridge B. This enables the supply of the charging bias to the charging roller 108 of the cartridge B from the main assembly A of the apparatus.

In Embodiment 2, similarly to the above-described Embodiment 1, the operation member 142 is movable relative to the cartridge frame B1. When the cartridge B is inserted into the main assembly A of the apparatus, the operation member 142 is engaged with the fixed engageable member 146 provided fixed in the main assembly A of the apparatus to move relative to the cartridge frame B1. The operation member 142, after engaging with the fixed engageable member 146, is brought into contact with the displaceable engaging portion 147*c* of the displaceable member 147 to move the output contact 144*a* from the retracted position to the electrical connecting position against the elastic force of the coil spring 149 (the elastic function member).

In addition, it has the input electrical contact 141*a* for receiving the voltage for operating the charging roller 108 (said process means) through engagement with the output contact 144*a* placed at the electrical connecting position.

It further includes a spring 143 (elastic function member) for applying an elastic force to the operation member 142. When the operation member 142 is engaged with the engageable member 146, the operation member 142 moves relative to the cartridge frame B1 against the elastic force of the spring 143.

The operation member 142 includes a first engaging portion 142*f* engageable with the engageable member 146 and a second engaging portion 142*d* engageable with the displaceable engaging portion 147C. The first engaging portion 142*f* of the operation member 142, when the cartridge B is inserted into the main assembly of the apparatus, is engaged with the engageable member 146, so that it moves relative to the cartridge frame B1, and after the first engaging portion 142*f* is engaged with the engageable member 146, the second engaging portion 142*d* is engaged with the displaceable engaging portion 147*c*. By this arrangement, the output contact 144*a* is moved from the retracted position to the electrical connecting position.

When the cartridge B is inserted into the main assembly A of the apparatus, the first engaging portion 142*f* is engaged with the engageable member 146 and is rotated. So, the second engaging portion 142*d* provided at the leading end of the operation member 142 moves to the position for engagement with the displaceable engaging portion 147*c* and engages with the displaceable engaging portion 147*c*. When the second engaging portion 142*d* is not engaged with the displaceable engaging portion 147*c*, the operation member 142 is engaged with the engageable member 146 and is not contacted therewith.

Similarly to Embodiment 1, a main assembly A of electrophotographic image forming apparatus includes a cartridge mounting portion 130*a* for detachably mounting the process cartridge B; a fixed engageable member 146; an output contact 144*a* movable between an electrical connecting position and a retracted position retracted from the electrical connecting position; and a displaceable member 147 having a displaceable engaging portion 147*c* for moving the output contact, wherein the displaceable engaging portion 147*c* is disposed downstream of the fixed engageable member 146, and at least a part of the displaceable engaging portion 147*c* is overlapped with the fixed engageable member 146 with respect to a direction in which the process cartridge B is inserted; and an elastic function member 149 for elastically urging the displaceable member 147 to urge the output contact 144*a* toward the retracted position away from the electrical connecting position.

This embodiment also provides the advantageous effects similar to Embodiment 1.

In this embodiment, the operation member 142 is disposed outside the movement path of the supporting arm 170*b* with respect to the rotational shaft of the drum shutter 170. Therefore, it is not necessary to pay attention to the opening and closing timing relations between the shutter 170 and the operation member 142 upon the mounting and demounting of the cartridge B.

Embodiment 3

Figure 22:
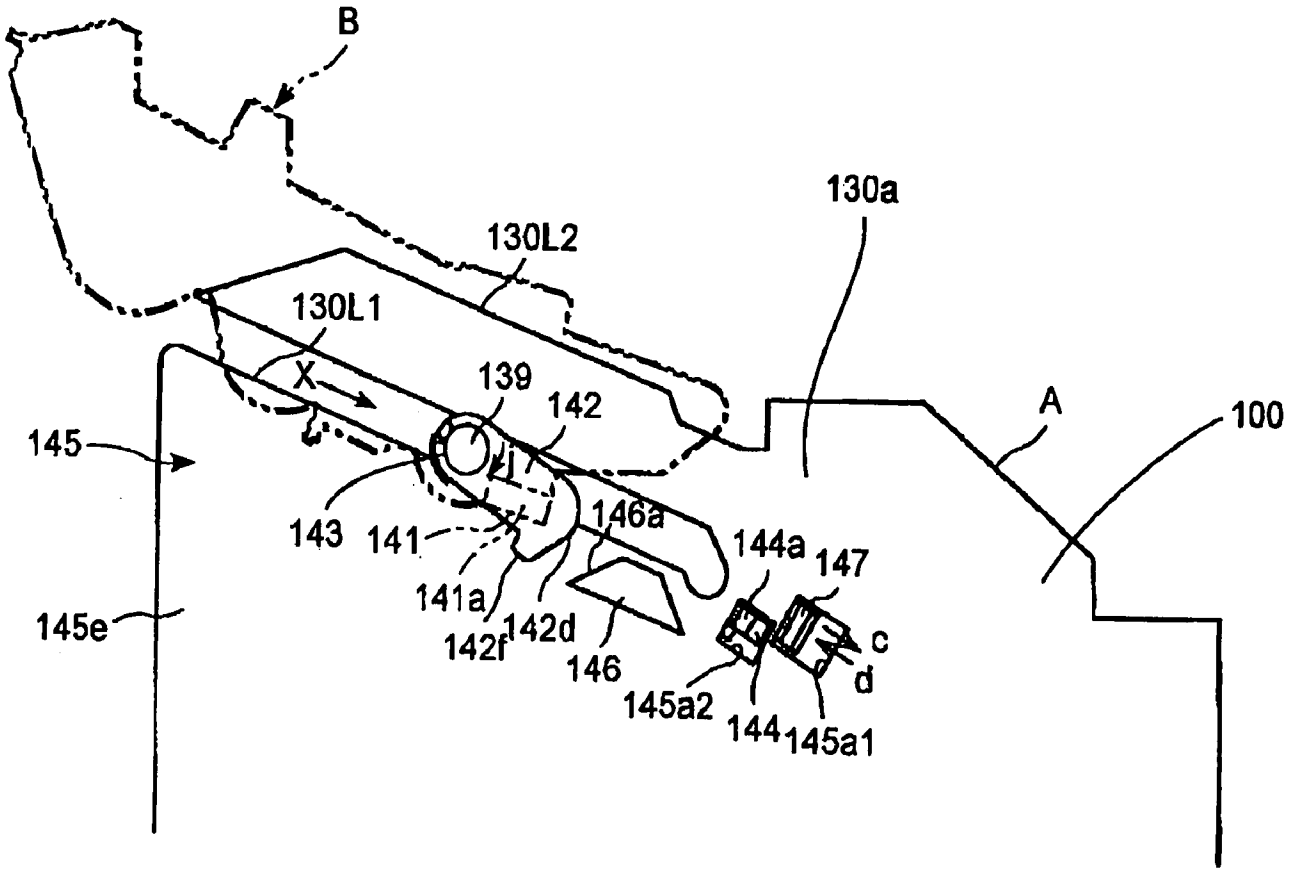
FIG. 22 is a schematic view that illustrates structures of the movable operation member and the electrical contact of the image forming apparatus according to a further embodiment of the present invention.
Figure 24:
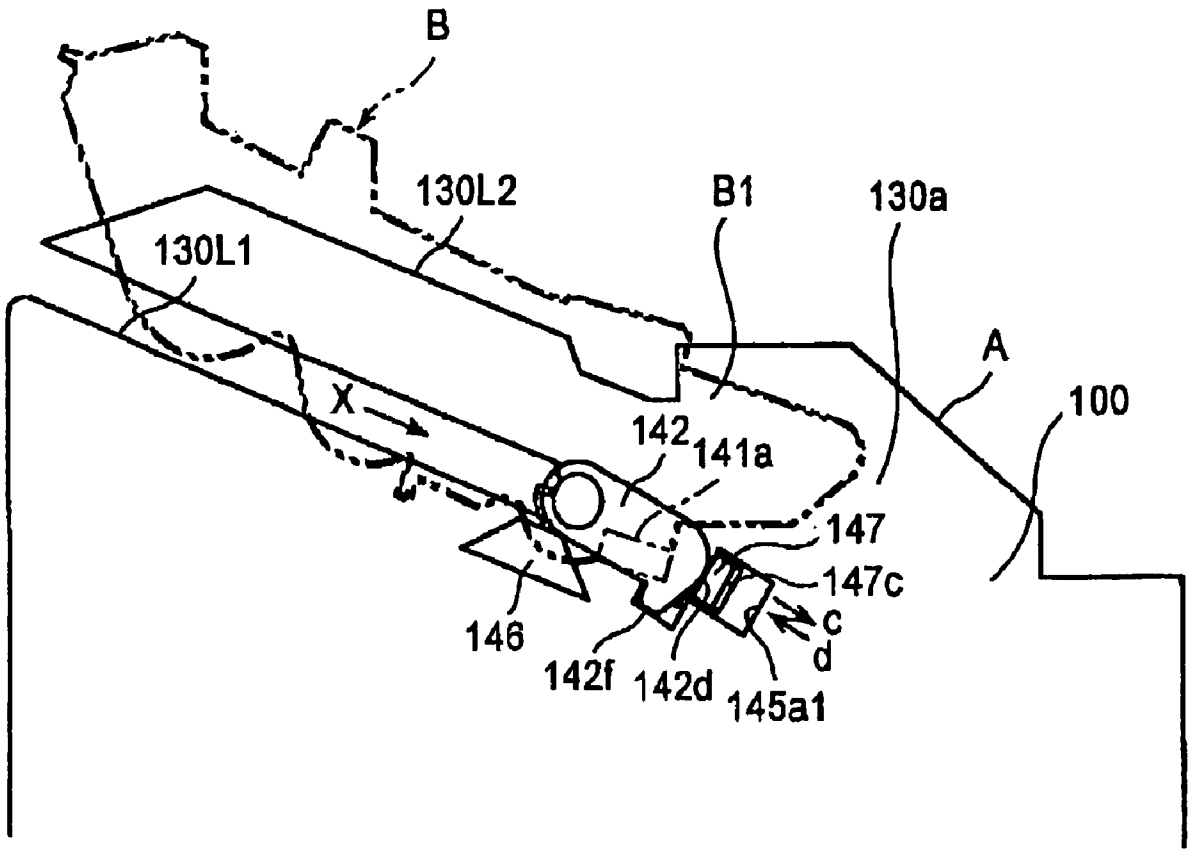
FIG. 24 is a schematic view that structures of the movable operation member and the electrical contact of the image forming apparatus according to the embodiment of the present invention.
Figure 25A:
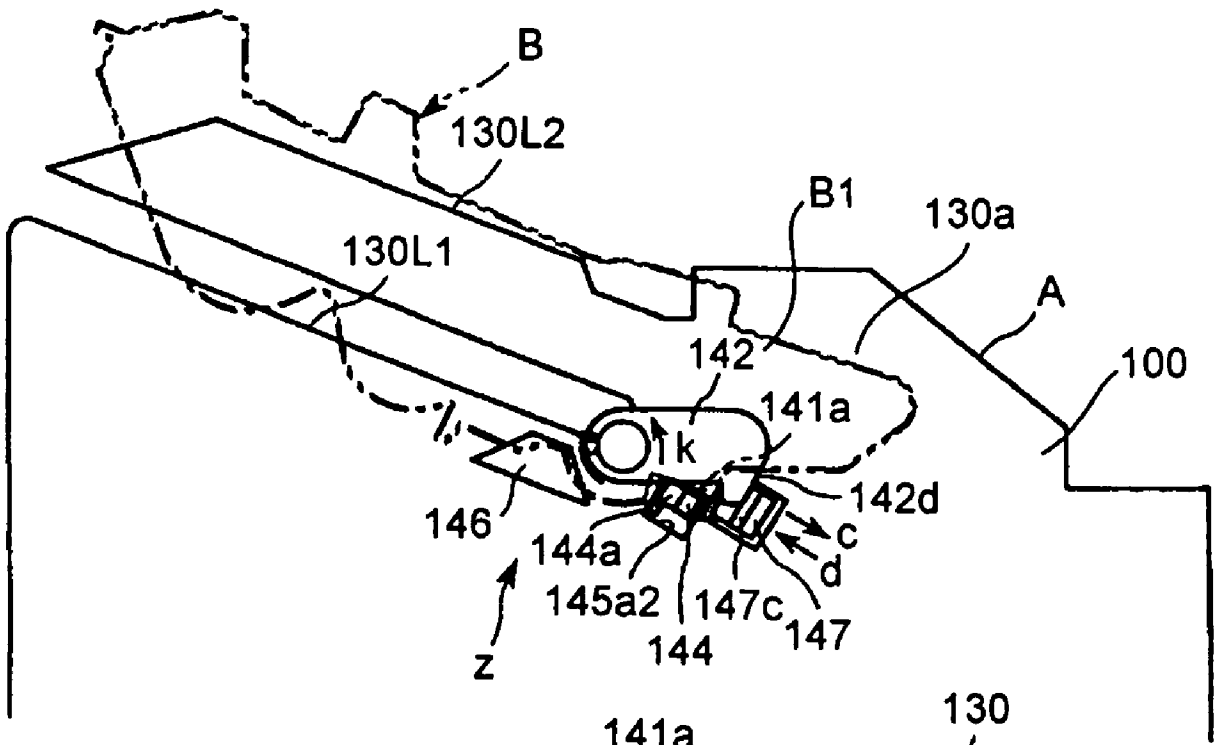
FIG. 25 is a schematic view that illustrates structures of the movable operation member and the electrical contact of the image forming apparatus and FIG. 25(*b*) is a schematic view as seen in the direction of arrow Z in FIG. 25(*a*).
Figure 25B:
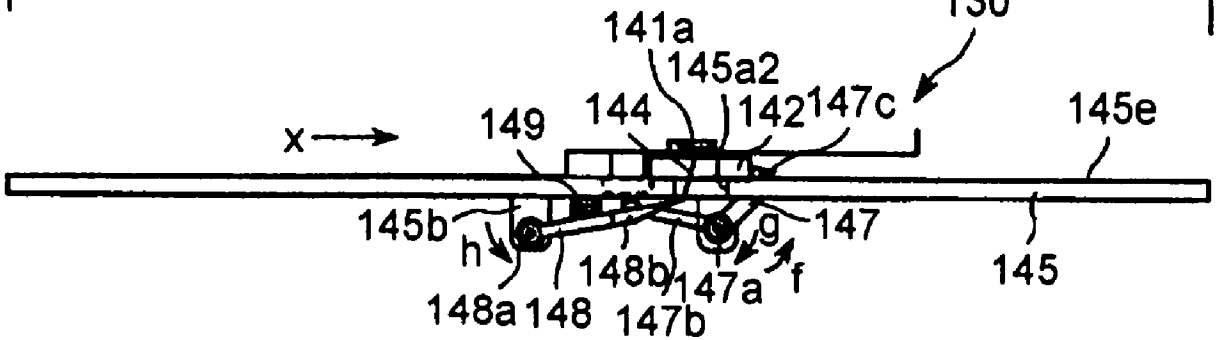

Referring to FIG. 22, FIG. 24 and FIGS. 25(*a*) and 25(*b*), a description will be provided as to a third embodiment of the present invention.

In this embodiment, the general arrangements or the cartridge B and the image forming apparatus 100 are the same as those described with respect to the is first embodiment. The same reference numerals as in Embodiment 1 are assigned to the elements having the corresponding functions in this embodiment, and the detailed description thereof is omitted for simplicity.

In this embodiment, the cartridge B and the main assembly A of the apparatus also comprise a movable operation member 142, a displaceable member 147, a charging input electrical contact member 141, and charging output contact member 144 and so on, and these members have the respective structures and functions which are similar to those with Embodiment 1. Therefore, the detailed descriptions of these members have been omitted for simplicity, and the same reference numeral are assigned to the corresponding elements.

FIGS. 22–24, 25(*a*), and 25(*b*) are schematic view illustrating operations when the cartridge B is inserted into the main assembly A of the apparatus.

In this embodiment, the cartridge B is provided with the movable operation member 142 which is rotatably mounted on a side surface of the drum frame 118. In this embodiment, similarly to Embodiment 1, the side surface of the cartridge B has a contact 141*a* of the charging input electrical contact member 141 for applying a charging bias voltage to the charging roller 108.

As shown in FIG. 22, the movable operation member 142 is biased or urged in the clockwise direction (the direction of an arrow j) in the drawing by a coil spring 143 (elastic function member). When the cartridge B is not mounted in the main assembly A of the apparatus, the input electrical contact 141*a* is covered by the operation member 142.

Similar to the above-described embodiment, the inner side plate 145 of the main assembly A of the apparatus is provided on the side surface 145*e* with an output contact member 144 for applying a charging bias voltage to the charging roller (unshown) by electrical contact with the input electrical contact 141*a*. The fixed engageable member 146 and the displaceable member 147 have the similar structures to those in Embodiment 1.

The displaceable member 147 moves in the directions of an arrows c, d in interrelation with mounting and demounting of the cartridge B. When the cartridge B is inserted into the main assembly A of the apparatus, the displaceable member 147 is pushed in the direction of an arrow c by the operation member 142. In interrelation with operation of the displaceable member 147, the output contact 144*a* is projected through the opening 145*a*2 of the inner side plate 145 and is brought into contact with the charging input electrical contact 141*a*. The structure is similar to that of Embodiment 1.

A description will be provided as to the operations of the movable operation member 142 and the output contact member 144.

As described hereinbefore, FIG. 22–FIG. 24, FIG. 25(*a*) and FIG. 25(*b*) are schematic views illustrating the operation when the cartridge B is inserted into the main assembly A of the apparatus.

FIGS. 22, 23, 24, and 25(*a*) are views of the inner side plate 145 or the main assembly A of the apparatus as seen from the inside of the main assembly A of the apparatus, and FIG. 25(*b*) is the view as seen in the direction of an arrow Z in FIG. 25(*a*).

FIG. 22 shows the state in the process of insertion of the cartridge B into the main assembly A of the apparatus. More particularly, FIG. 22 shows a state in which the cartridge B has been inserted immediately before the operation member 142 is contacted to the fixed engageable member 146. The cartridge B is inserted in the direction of an arrow X along the main assembly guides 130L1, 130L2.

As described hereinbefore, the movable operation member 142 is urged in the clockwise direction (the direction of an arrow j) in FIG. 22 by the elastic force of the elastic function member 143.

Figure 23:
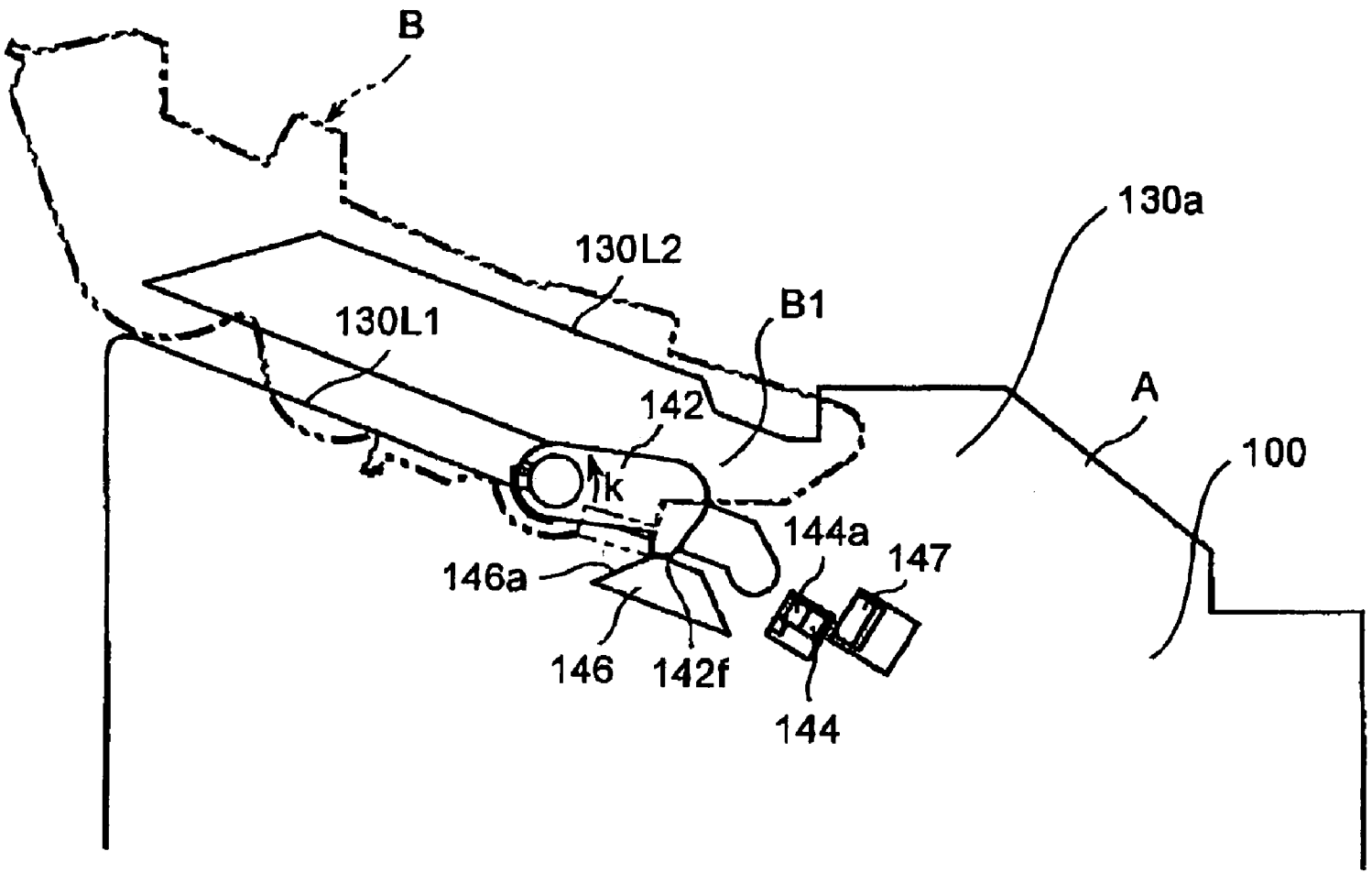
FIG. 23 is a schematic view that illustrates structures of the movable operation member and the electrical contact of the image forming apparatus.

FIG. 23 shows a state in which the cartridge B has been inserted further in the direction X (inward) from the position shown in FIG. 22. As shown in FIG. 23, the abutting portion of the operation member 142, that is, the first engaging portion 142*f* is brought into contact with the abutting portion 146*a* of the fixed engageable member 146 mounted on the main assembly A of the apparatus. The operation member 142 rides on the upper surface of the abutting portion 146*a*. Then, the operation member 142 rotates in the counterclockwise direction (the direction of an arrow k) in accordance with insertion of the cartridge B. In this state, the output contact 144*a* is at the retracted position where it is not projection beyond the side plate 145 toward the mounting portion 130(*a*).

In accordance with the further insertion of the cartridge B, the first engaging portion 142*f* rides over the fixed engageable member 146. As shown in FIG. 24, the first engaging portion 142*f* is then disengaged from the fixed engageable member 146. As shown in FIGS. 25(*a*) and (*b*), by the further insertion of the cartridge B thereafter, second engaging portion 142*d* of the operation member 142 is brought into contact with the displaceable engaging portion 147*c*.

After the contact, the further insertion of the cartridge B causes the operation member 142 to push the displaceable member 147 in the direction of the arrow c.

With this structure of this embodiment, when the second engaging portion 142*d* is abuted to the displaceable engaging portion 147*c*, the impact or shock can be reduced.

As described hereinbefore, the displaceable member 147 is rotated in the direction of an arrow g (FIG. 25(*b*)) by the operation member 142 pushing the displaceable member 147 in the direction of the arrow c. By this, the supporting member 148 is rotated in the direction of an arrow h (FIG. 25(*b*)). Therefore, the output contact 144*a* is projected out of the outside (retracted position) of the side plate 145 into the inside (electrical contact position) of the main assembly A of the apparatus, that is, into the cartridge mounting portion 130*a*.

On the other hand, as shown in FIG. 25(*a*), by the movement of the operation member 142 as described above, the operation member 142 is rotated in the couterclockwise (arrow k) direction by the displaceable member 147. Therefore, the operation member 142 moves relative to the cartridge frame B1 from the position covering the input electrical contact 141*a* (FIG. 22–FIG. 24) to the position exposing the contact 141*a* (FIGS. 25(*a*) and (*b*)).

In other words, FIGS. 25(*a*) and (*b*) show the state in which the cartridge B is further inserted and is completely mounted to the main assembly A of the apparatus. With the insertion of the cartridge B, the second engaging portion 142*d* further rotates the displaceable member 147 in the direction of the arrow g (FIG. 25(*b*)). In interrelation therewith, the output contact 144*a* is further projected beyond the side plate 145. The output contact 144*a* is then brought into contact with exposed input electrical contact 141*a*.

Thus, the movable operation member 142 is movable-relative to the drum frame 118 (cartridge frame B1). When the cartridge B is inserted into the main assembly A of the apparatus, the movable operation member 142 is engaged with the fixed engageable member 146 fixed on the main assembly A of the apparatus and is moved relative to the drum frame 118. After the movable operation member 142 is engaged the fixed engageable member 146, it is engaged with the engaging portion 147*c* of the displaceable member 147 to move the output contact 144*a* from the retracted position to the electrical connecting position against the elastic force of the elastic function member 149.

As described in the foregoing, in this embodiment, when the cartridge B is inserted into the main assembly A of the apparatus, the output contact 144*a* retracted in the retracted position is brought into contact with the input electrical contact 141*a* by the operations of the movable operation member 142, the displaceable member 147 and the supporting member 148. By the control of the CPU200 (FIG. 16), the voltage is supplied from the voltage source S (FIG. 16) to charging roller 108 through the electric circuit E, the output contact 144*a* and the input electrical contact 141*a*.

In other words, the input electrical contact 141*a* is engaged with the output contact 144*a* positioned at the electrical connecting position and receives the voltage for operating the charging roller 108 (the process means).

In this embodiment, the advantageous effects of the first embodiment are provided.

Embodiment 4

Figure 26:
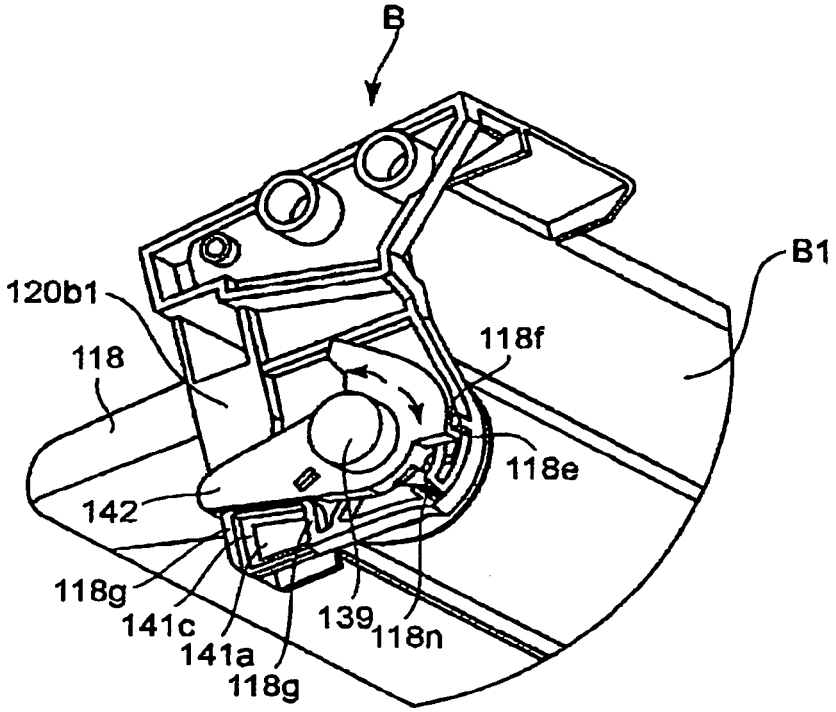
FIG. 26 is a schematic perspective view that illustrates a structure of the movable operation member of the process cartridge according to a further embodiment of the present invention.
Figure 27:
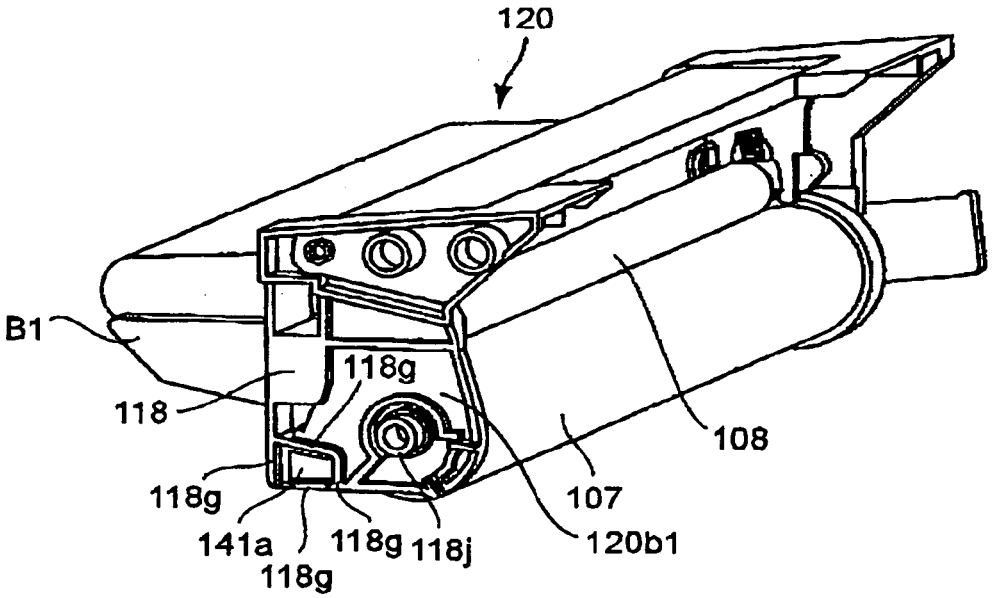
FIG. 27 is a schematic perspective view that illustrates a structure of the drum unit in the embodiment of the present invention.

Referring to FIGS. 26 and 27, a description will be provided as to a fourth embodiment of the present invention.

In this embodiment, the structure of the cartridge B and the image forming apparatus 100 are similar to those of Embodiment 1 (FIGS. 1 and 2). The same reference numerals as those used for Embodiment 1 are assigned to the elements having the corresponding functions, and the detailed descriptions for such is elements are omitted for simplicity.

In Embodiment 1, as shown in FIG. 10(*a*), when the operation member 142 is in the stand-by state (positioned after the rotation in the direction of an arrow a), the region 141*c* to be exposed of the input electrical contact member 141 is covered by the movable operation member 142. In the operating state shown in FIG. 10(*b*), the region 141*c* is exposed.

Thus, when the cartridge B is not mounted to the main assembly A of the apparatus, the operation member 142 is in the position shown in FIG. 10(*a*). Therefore, the electrical contact 141*a* in the region 141*c* is covered by the operation member 142. For this reason, there is an advantage that the input electrical contact 141*a* is protected from contact with the operator to the region 141*c*, particularly the input electrical contact 141*a*.

However, it is not inevitable to cover the exposure region 141*c* with the operation member 142.

As shown in FIGS. 26 and 27, in the present embodiment, an operation member 142 having the structures and the functions which are similar to those of Embodiment 1 is mounted to the side surface 120*b*1, using the drum shaft 139 and a shaft 118*j* (FIG. 27) on the side surface 120*b*1 of the drum frame 118. Similarly to Embodiment 1, after engagement of the hole of the cylindrical portion 142*a* (FIG. 9) formed in the movable operation member 142, the drum shaft 139 is press-fitted into the hole of the shaft 118*j*. By doing so, the operation member 142 is rotatably mounted coaxially with the rotational axis of the photosensitive drum 107.

In this embodiment, the operation member 142 is also rotatable in the directions of the two arrows shown in FIG. 26.

However, in this embodiment, when the operation member 142 is in the stand-by state (FIG. 26), the exposed region 141*c* of the input electrical contact member 141 is not covered by the movable operation member 142. Namely, In the stand-by position shown in FIG. 26, the exposed region 141*c* is actually exposed.

As will best be understood from FIG. 27, the input electrical contact 141*a* in this embodiment is provided on a surface surrounded by a rib 118*g* such that input electrical contact 141*a* does not project out beyond the side surface of the drum frame 118.

Therefore, according to this embodiment, the Input electrical contact 141*a* is hard to touch by the operator, when the cartridge B is handled. Therefore, the contact 141*a* is protected from a conduction defect which may otherwise be caused by sweat, grease or the like of the user. Thus, the contact 141*a* is protected without use of the operation member 142 covering the contact 141*a*.

In this embodiment, the advantageous effects of the first embodiment are provided.

Embodiment 5

Referring to FIG. 28–FIG. 32, fifth embodiment will be described.

In this embodiment, the structure of the cartridge B and the image forming apparatus 100 are similar to those of Embodiment 1 (FIGS. 1 and 2). The same reference numerals as those used for Embodiment 1 are assigned to the elements having the corresponding functions, and the detailed descriptions for such elements are omitted for simplicity.

In Embodiment 4, as shown in FIG. 27, the input electrical contact 141*a* ls surrounded by the rib 118*g*, so that it is not projected beyond the side surface of the drum frame 118. By doing so, the exposed input electrical contact 141*a* is hard to touch.

In this embodiment, another structure of the movable operation member 142 is employed to prevent the operator from inadvertently touching the input electrical contact 141*a*.

FIG. 28 to FIG. 32 show various examples of the movable operation member 142 according to this embodiment.

In these examples, the side surface 120*b*1 of the drum frame 118 is provided with a contact 141*a* of the input electrical contact member 141 similarly to Embodiments 1 and 4. Similarly to the foregoing embodiments, the movable operation member 142 is supported and positioned.

Figure 28:
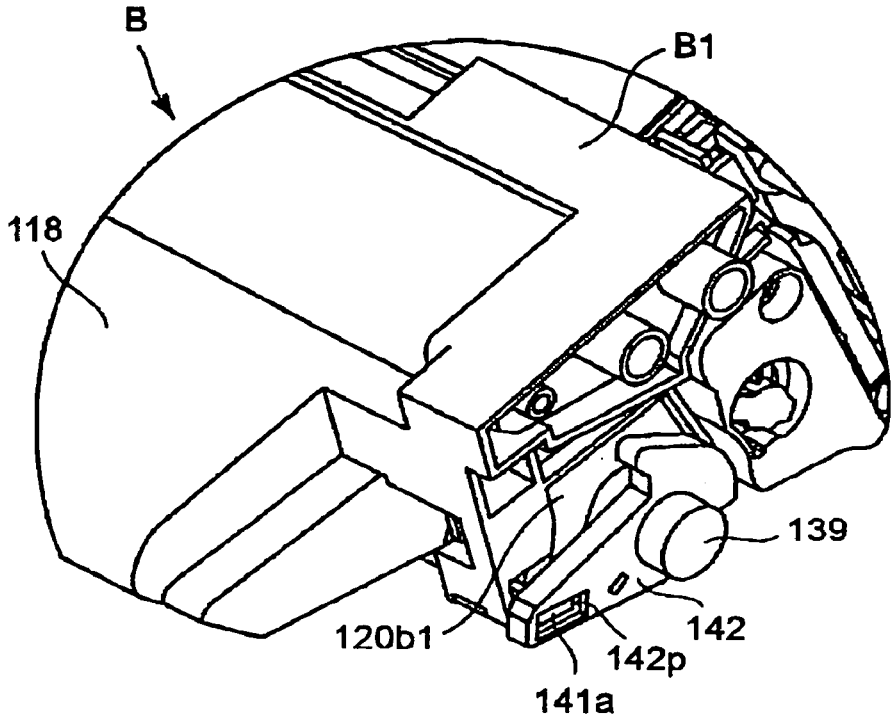
FIG. 28 is a schematic perspective view that illustrates a structure of the movable operation member of the process cartridge according to the embodiment of the present invention.

In the example shown in FIG. 28, the movable operation member 142 is positioned in the stand-by state so as to cover the contact 141*a* similarly to Embodiment 1. However, the movable operation member 142 facing the contact 141*a* is provided with an opening 142*p*. In other words, the contact 141*a* is not covered by the operation member 142, but there is a surface of the operation member 142 at a position higher than the surface of the contact 141*a*.

Figure 29:
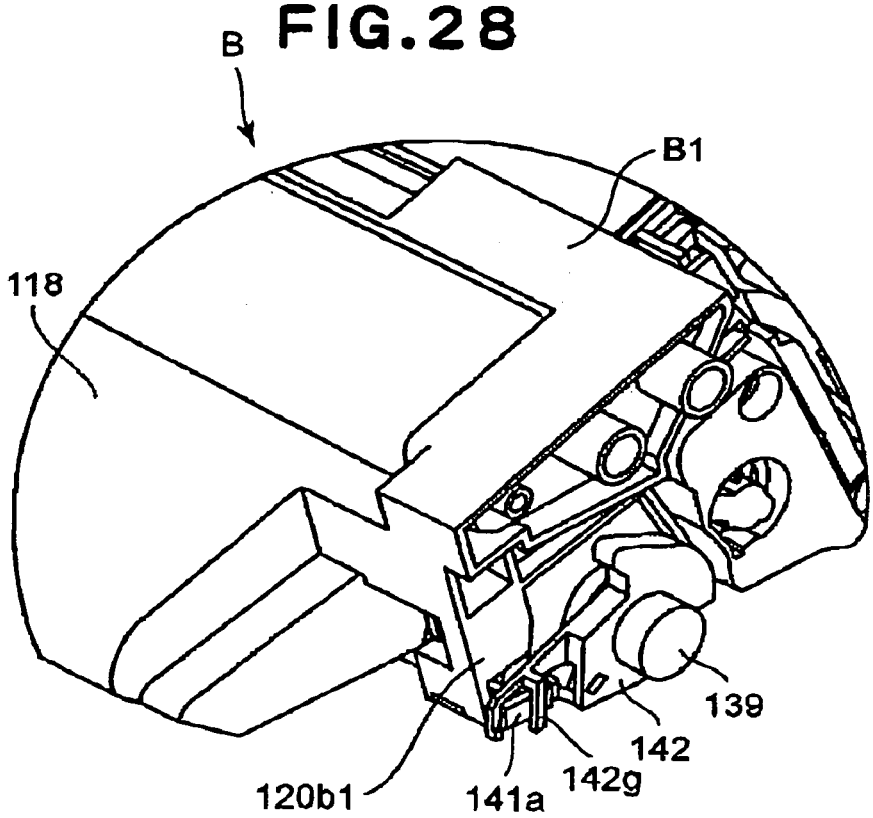
FIG. 29 is a schematic perspective view that illustrates a structure of the movable operation member of the process cartridge according to the embodiment of the present invention.

In the example shown in FIG. 29, the movable operation member 142 has a rib 142*g* so as to cover a part of the upper portion of the contact 141*a* in the stand-by state or position.

Figure 30:
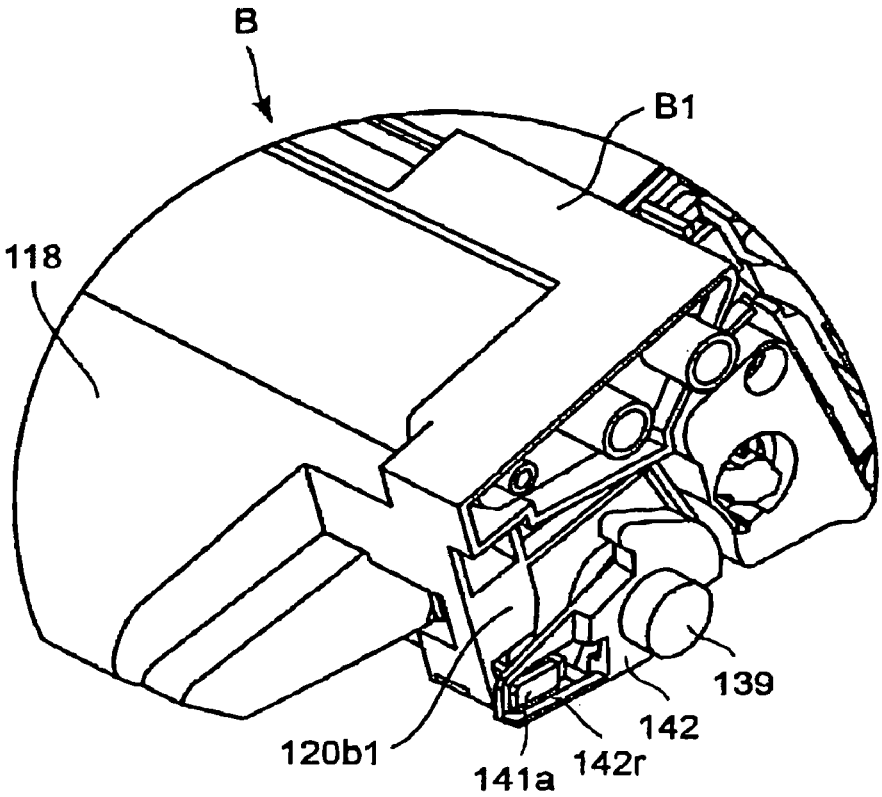
FIG. 30 is a schematic perspective view that illustrates a structure of the movable operation member of the process cartridge according to the embodiment of the present invention.
Figure 31:
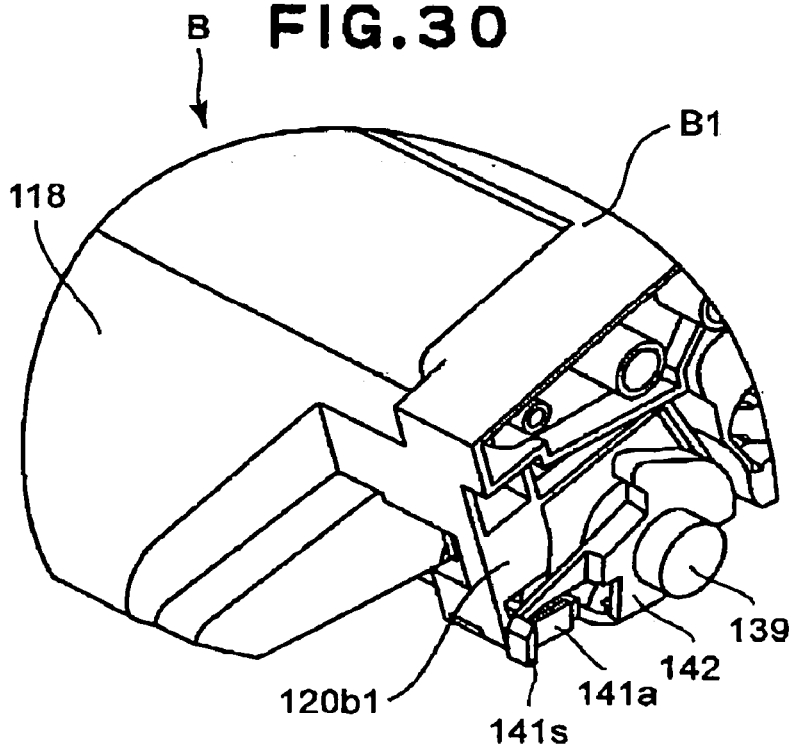
FIG. 31 is a schematic perspective view that illustrates a structure of the movable operation member of the process cartridge according to the embodiment of the present invention.
Figure 32:
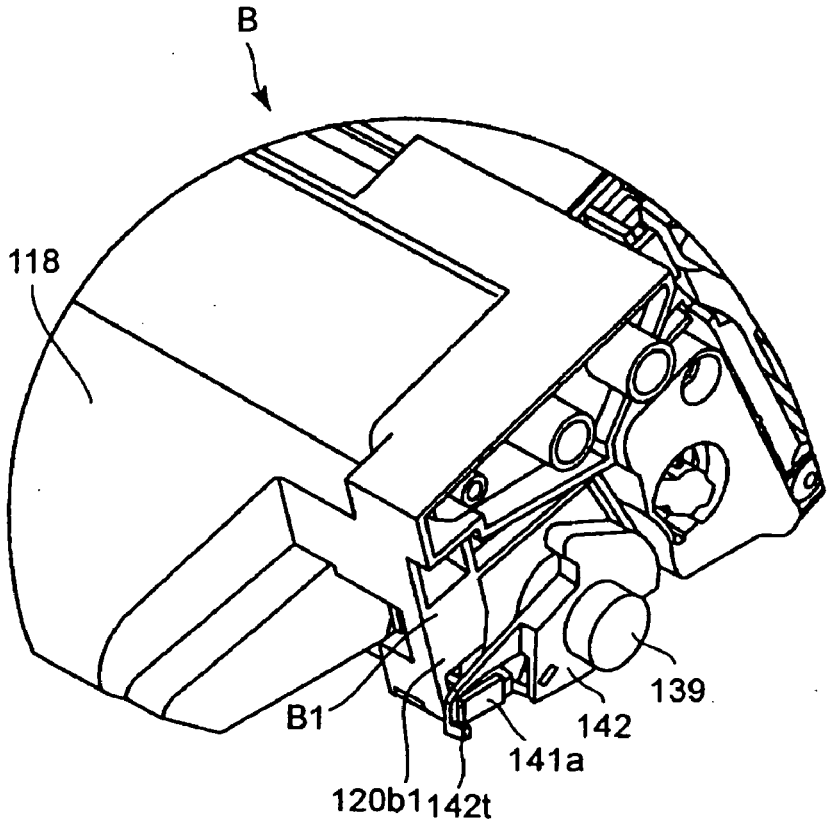
FIG. 32 is a schematic perspective view that illustrates a structure of the movable operation member of the process cartridge according to the embodiment of the present invention.

FIGS. 30, 31 and 32 show other examples. The movable operation member 142 in each of these examples is provided around a part of the contact 141*a* with a surface 142*r* (FIG. 30), 142*s* (FIG. 31) or 142*t* (FIG. 32), which is higher than the surface of the contact 141*a* in the stand-by state.

In the example of FIG. 30, the surface 142*r* of the operation member 142 is disposed below the contact 141*a* in the Figure. In the example of FIG. 31, the surface 142*s* of the operation member 142 is disposed at a side of the contact 141*a*. In the example of FIG. 32, the surface 142*t* of the operation member 142 is disposed at a lower corner portion of the contact 141*a*.

In these examples, similarly to Embodiment 4, a surface higher than the contact 141*a* surface is provided adjacent the contact 141*a* of the operation member 142. Therefore, there is provided a hard-to-touch electrical contact, so that operator does not inadvertently touch the contact. In this manner, the contact is protected from conduction defect which may otherwise be caused by the sweat, grease or the like of the user.

In this embodiment, the advantageous effects of the first embodiment are provided.

Embodiment 6

Referring to FIG. 33–FIG. 38, a sixth embodiment of the present invention will be described.

In this embodiment, the structure of the cartridge R and the image forming apparatus 100 are similar to those of Embodiment 1 which has been described in conjunction with FIGS. 1 and 2. The structures and functions of the operation member 142 are similar to those in Embodiment 2. The same reference numerals as those used for the Embodiments 1 and 2 are assigned to the elements having the corresponding functions, and the detailed descriptions for such elements are omitted for simplicity.

In Embodiment 2, in the stand-by state shown in FIG. 17(*a*), the input electrical contact 141*a* is covered by the operation member 142. In the operative state shown in FIG. 18, the contact 141*a* is exposed.

In the present embodiment, the operation member 142 of Embodiment 2 is modified. The operation member 142 is modified and is still effective to prevent the operator from inadvertently touching the input electrical contact 141*a*.

FIG. 33 to FIG. 38 show various examples of the operation member 142 according to this embodiment.

In these examples, an input electrical contact 141*a* is provided so as not Lo project beyond the surface of a drum frame rib 118*g* adjacent a longitudinal end at a leading side with respect to the mounting direction in which the cartridge B is mounted to the main assembly A of the apparatus. The input electrical contact member 141 is provided adjacent the corner portion with a region constituting a contact 141*a* for contact with the charging output contact is 144*a*. The operation member 142 is supported and positioned in the similar manner as with Embodiment 2.

Figure 33:
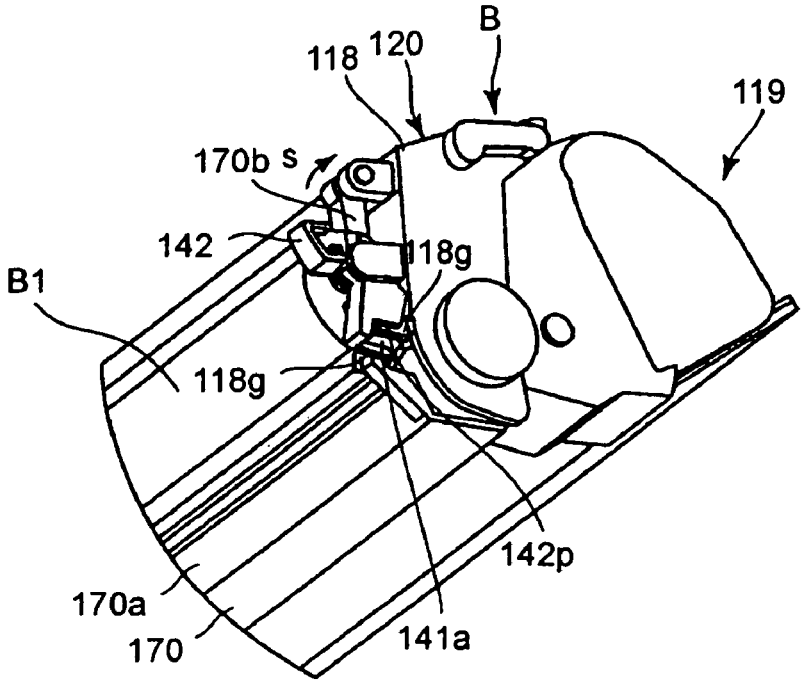
FIG. 33 is a schematic perspective view that illustrates a structure of the movable operation member of the process cartridge according to the embodiment of the present invention.

In the embodiment shown in FIG. 33, the operation member 142, similarly to Embodiment 2, is positioned such that it covers the contact 141*a*, in the stand-by state. However, unlike Embodiment 2, the area of the operation member 142 facing the contact 141*a* is provided with an opening 142*p*.

However, the contact 141*a* is surrounded by the rib 118*g*. Adjacent the contact 141*a*, the operation member 142 is disposed so as to substantially enclose the contact 141*a*. Therefore, the exposed input electrical contact 141*a* is protected from touch by the operator.

Figure 34:
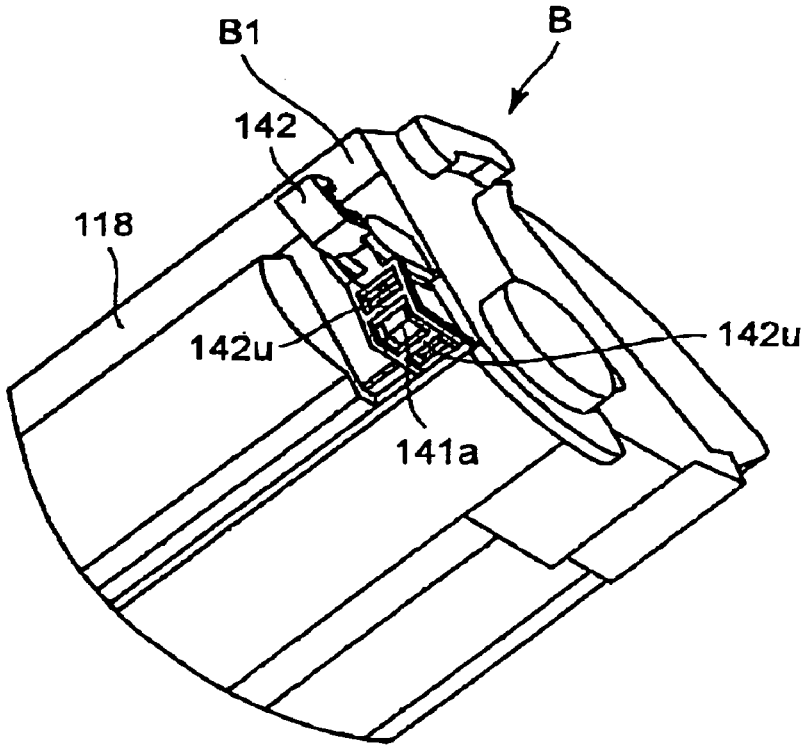
FIG. 34 is a schematic perspective view that illustrates a structure of the movable operation member of the process cartridge according to the embodiment of the present invention.

In the example of FIG. 34, the operation member 142 surrounds the circumference of the contact 141*a* in the stand-by state. In this embodiment, the portion of the operation member 142 surrounding the contact 141*a* has a skelton structure constituted by a plurality of bones 142*u*.

Figure 35:
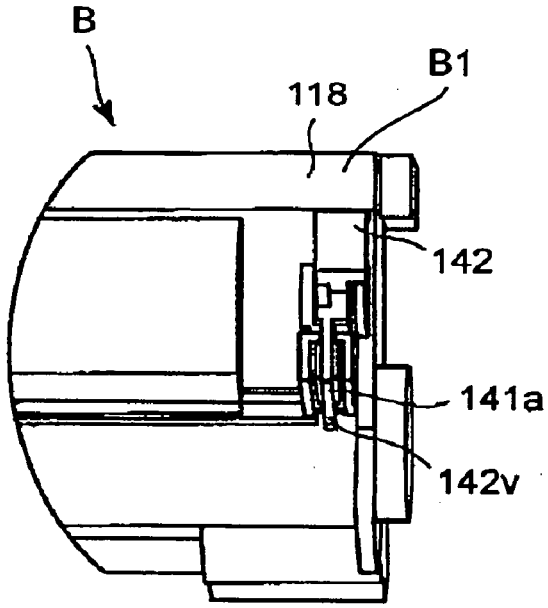
FIG. 35 is a schematic perspective view that illustrates a structure of the movable operation member of the process cartridge according to the embodiment of the present invention.

In the example shown in FIG. 35, the operation member 142 is provided with a rib 142*v* so as to cover a part of the upper portion of the contact 141*a* in the stand-by state.

Figure 36:
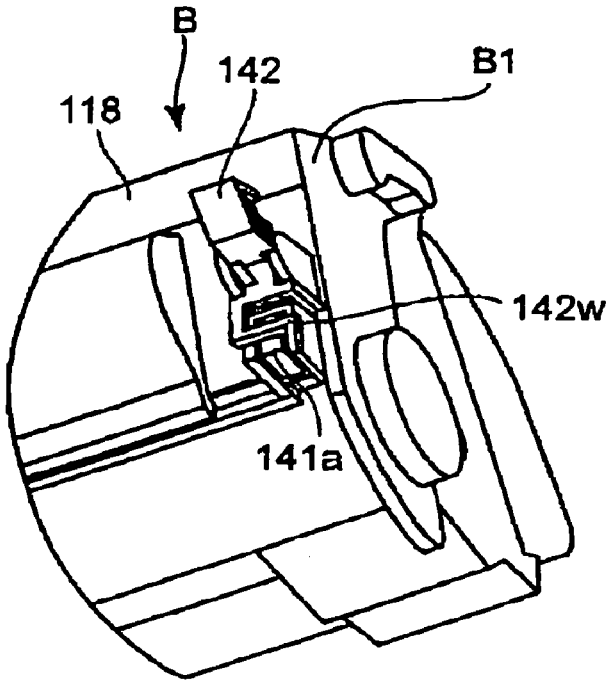
FIG. 36 is a schematic perspective view that illustrates a structure of the movable operation member of the process cartridge according to the embodiment of the present invention.
Figure 37:
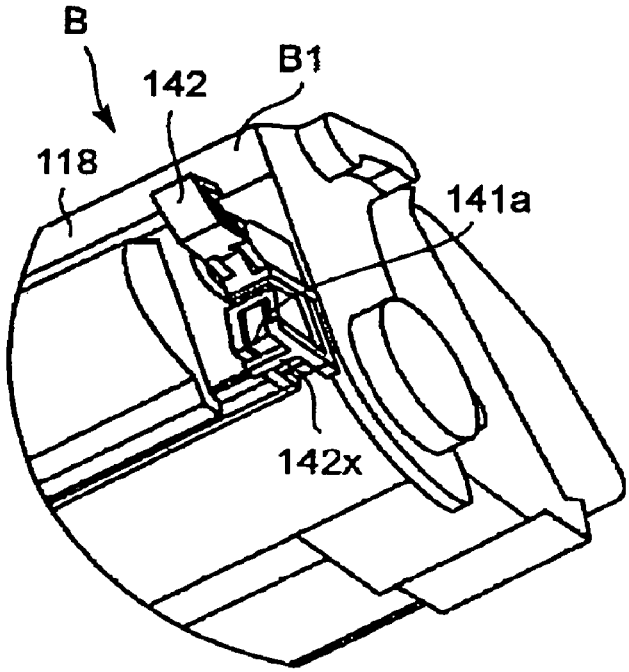
FIG. 37 is a schematic perspective view that illustrates a structure of the movable operation member of the process cartridge according to the embodiment of the present invention.
Figure 38:
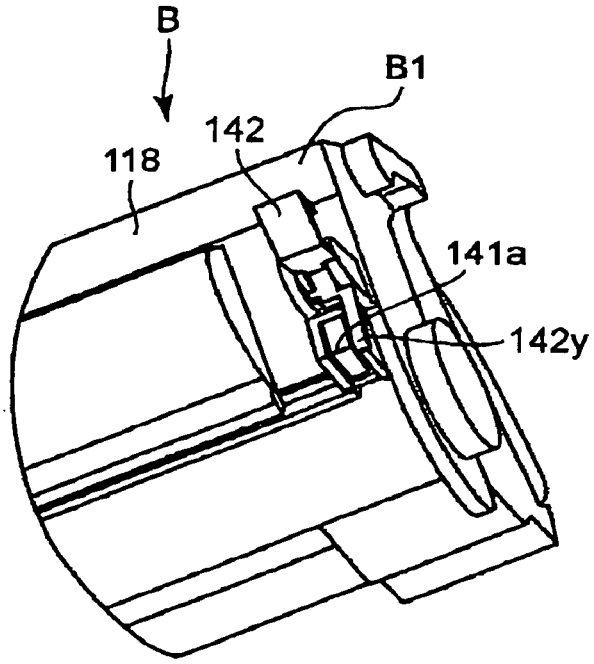
FIG. 38 is a schematic perspective view that illustrates a structure of the movable operation member of the process cartridge according to the embodiment of the present invention.

In the example of FIGS. 36, 37, and 38, the operation members 142 have respective surfaces 142*w*, 142*x*, 142*y* having heights larger than the surfaces of the contacts 141*a* in the stand-by state around a part of the circumference of the contact 141*a*.

Thus, in the embodiment of FIG. 36, the surface 142*w* of the operation member 142 is disposed above the contact 141*a* in the figure. In the example of FIG. 37, the surface 142*x* of the operation member 142 is disposed opposed to the contact 141*a* in the Figure. In the example of FIG. 38, the surface 142*y* of the operation member 142 is disposed at the side of the contact 141*a*.

In each of these examples of this embodiment, similarly to Embodiments 4 and 5, the movable operation member 142 is provided with a rib 142*u* or a rib 141*v* or a surface 142*w*, a surface 142*x* or a surface 142*y* having a larger height adjacent the contact 141*a*. Therefore, there is provided a hard-to-touch arrangement, and although the electrical contacts are exposed in Embodiments 4, 5, and 6, the probability of the operator inadvertently touching the electrical contact can be reduced. Thus, the contact 141*a* can be protected.

In this embodiment, the advantageous effects of the first embodiment are provided.

Embodiment 7

Figure 39:
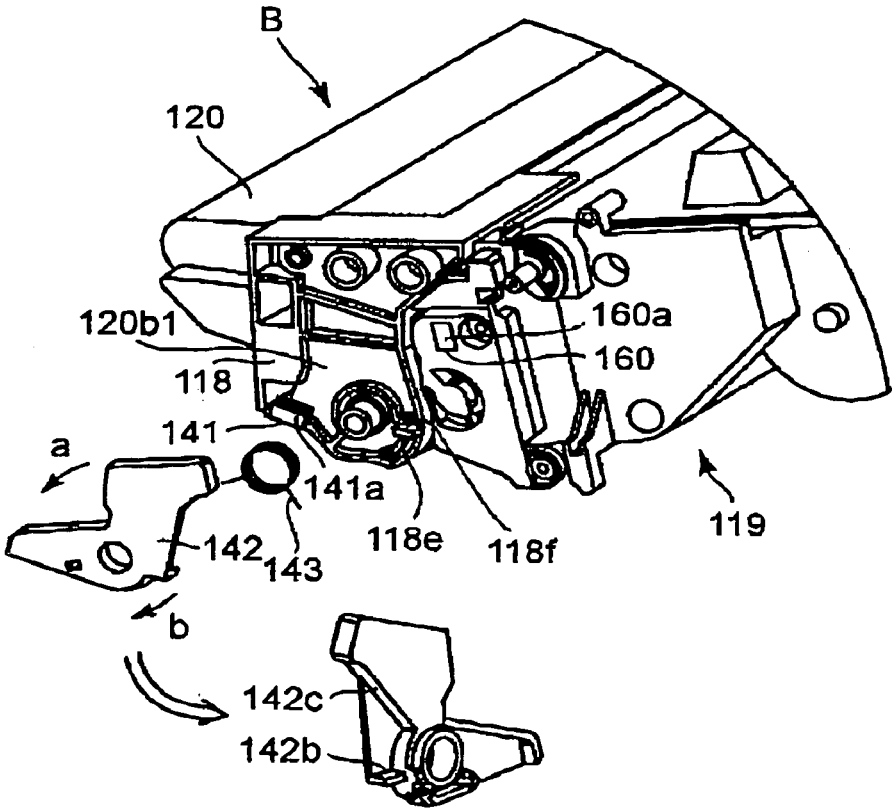
FIG. 39 is a schematic perspective view that illustrates a structure of the movable operation member of the process cartridge according to the embodiment of the present invention.

Referring to FIGS. 39, 40, 41(*a*), 41(*b*), 42(*a*), 42(*b*), 43(*a*), 43(*b*), 44(*a*), and 44(*b*), a seventh embodiment of the present invention will be described.

In this embodiment, the cartridge B is provided on the side surface with a charging input electrical contact 141*a* for applying a charging bias voltage to the charging roller 108.

In this embodiment, the side surface of the cartridge B is also provided with, in addition to the charging input electrical contact 141*a*, a development input electrical contact 160*a* which is a part of a development input electrical contact member 160 for applying a developing bias voltage to the developing roller 111 of the developing unit 119.

In this embodiment, the structure of the cartridge B and the image forming apparatus 100 are similar to those of Embodiment 1 which has been described in conjunction with FIGS. 1 and 2. The same reference numerals as with the Embodiment 1 are assigned to the elements having the corresponding functions, and the detailed descriptions for such elements are omitted for simplicity.

(1) Movable Operation Member of Cartridge B

FIG. 39 shows a cartridge B according to a seventh embodiment of the present invention. The cartridge B is provided on its side surface with a charging input electrical contact 141*a*. In this embodiment, the developing unit 119 is provided on the side surface with the contact 160*a* which is a part of the development input electrical contact member 160 for applying the developing bias voltage to the developing roller 110. The development input electrical contact member 160 is electrically connected with a developing roller 110 (unshown) in the developing unit 119.

The drum frame 118 has an operation member 142 which is rotatably mounted to the drum frame 118. The structure of the operation member 142 is similar to that of Embodiment 1.

FIGS. 40(*a*) and 40(*b*) show a state in which the operation member 142 rotates in the direction of an arrow a and in the direction of an arrow b.

As shown in FIG. 40(*a*), when the operation member 142 is positioned after being rotated in the direction of an arrow a, the charging input electrical contact 141*a* and the development input electrical contact 160*a* are covered by the operation member 142. As shown in FIG. 40(*b*), when the operation member 142 rotates in the direction of an arrow b, the charging input electrical contact 141*a* and the development input electrical contact 160*a* are exposed.

That is, when the cartridge B is not mounted into the main assembly A of the apparatus, the operation member 142 is as in the state shown in FIG. 40(*a*). In other words, the charging input electrical contact 141*a* and the development input electrical contact 160*a* are covered by the operation member 142. The contacts are protected in this manner.

(2) Charging Output Contact and Development Output Contact

Referring to FIGS. 41(*a*) and 41(*b*), a description will be provided as to the main assembly A of the apparatus to which the cartridge B is mountable.

Similarly to Embodiment 1, the side surface 145*e* of the inner side plate 145 of the main assembly A of the apparatus is provided with a charging output contact 144*a* for applying a charging bias voltage by contact with the charging input electrical contact 141*a* of the cartridge B. In this embodiment, also provided is the development output contact 161*a* for applying the developing bias voltage by contact with the development input electrical contact 160*a*.

In this embodiment, the structures and functions of the fixed engageable member 146 and the displaceable member 147 are similar to those of Embodiment 1.

Namely, the displaceable member 147, as shown in FIG. 41, moves in the direction of arrows c, d in interrelation with the mounting and demounting of the cartridge B. As shown in FIG. 41(*b*), when the cartridge B is mounted into the main assembly A of the apparatus, the displaceable member 147 is pushed in the direction of an arrow c by the operation member 142 (FIGS. 40(*a*) and 40(*b*)). In interrelation of the operation of the displaceable member 147, the charging output contact 144*a* and the development output contact 161*a* are projected through the openings 145*a*2 and 145*a*3 of the inner side plate 145, respectively. Then, they are brought into contact to the charging input electrical contact 141*a* and the development input electrical contact 160*a*, respectively.

(3) Movable Operation Member 142, Charging Output Contact Member 144 and Development Output Contact Member 161

A description will further be provided as to the operations of the operation member 142, the electrical contact member 144 and the electrical contact member 161.

Figure 42:
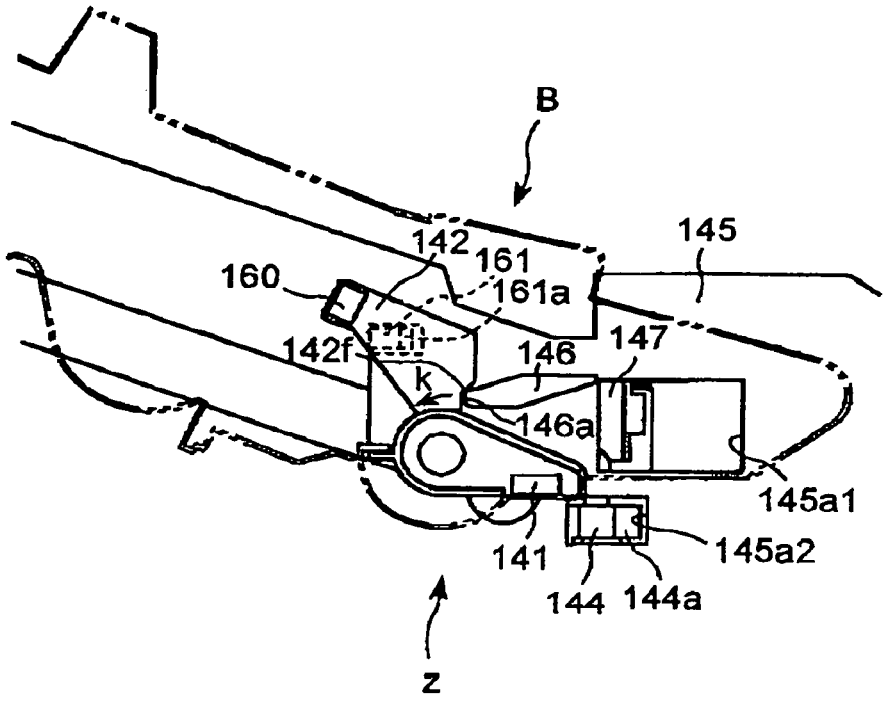
FIGS. 42(*a*) and 42(*b*) are schematic perspective views that illustrate structures of the movable operation member and the electrical contact of the image forming apparatus.
Figure 42:
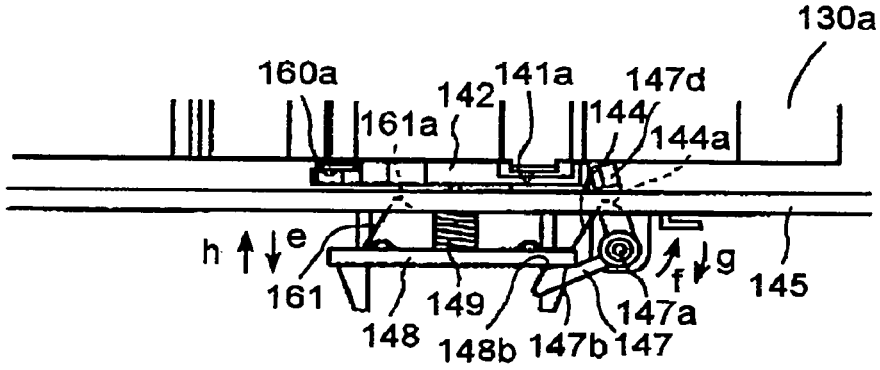

FIGS. 42(*a*), 42(*b*), 43(*a*), 43(*b*), 44(*a*) and 44(*b*) are schematic views illustrating the operations of insertion of the cartridge B into the main assembly A of the apparatus.

Figure 43:
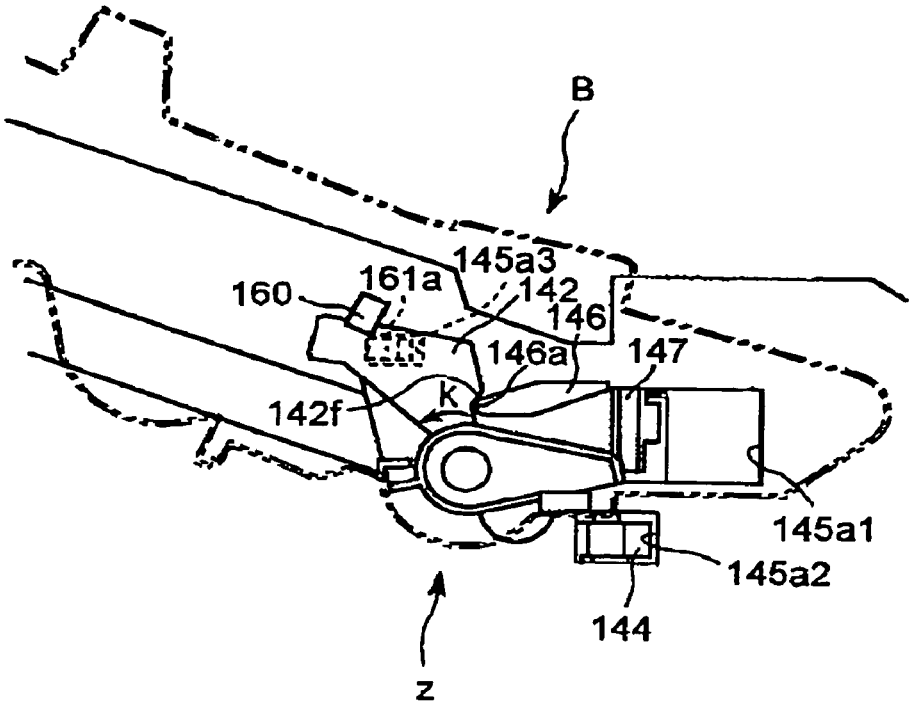
FIGS. 43(*a*) and 43(*b*) are schematic perspective views that illustrate structures of the movable operation member and the electrical contact or the image forming apparatus.
Figure 43:
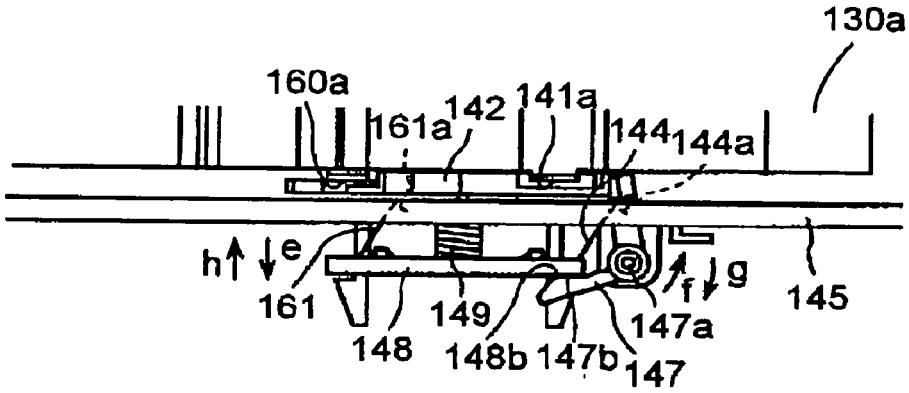
Figure 44:
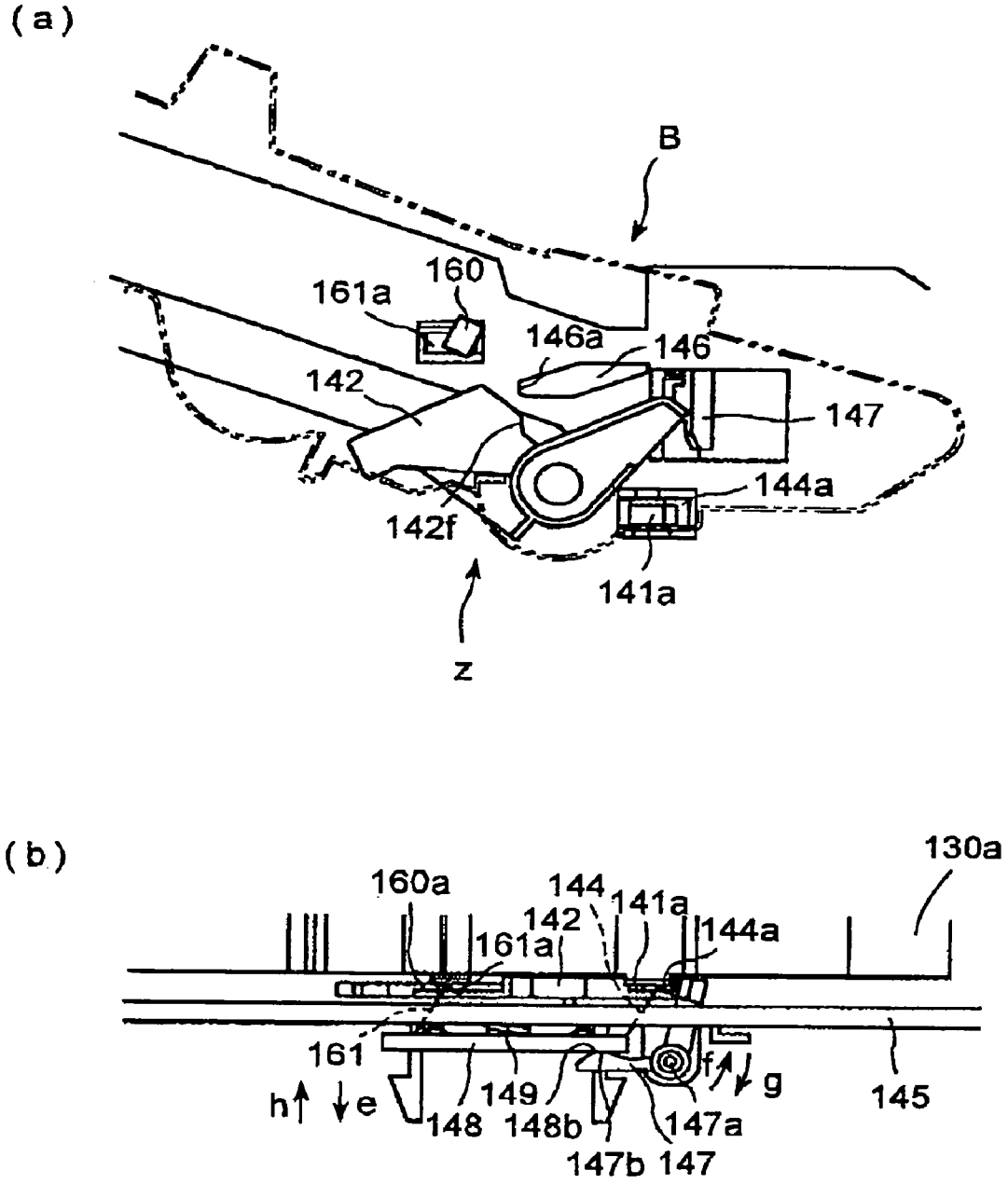
FIGS. 44(*a*) and 44(*b*) are schematic perspective views that illustrate structures of the movable operation member and the electrical contact of the image forming apparatus.

FIG. 42(*a*), FIG. 43(*a*) and FIG. 44(*a*) are views of an inner side plate 145 of a main assembly A of the apparatus as seen from the inside (the views as seen in the direction of an arrow Y in FIG. 41(*a*)); FIG. 42(*b*), FIG. 43(*b*) and FIG. 44(*b*) are views as seen in the direction of an arrow Z in FIG. 42(*a*), FIG. 43(*a*) and FIG. 44(*a*).

FIGS. 42(*a*) and 42(*b*) illustrate a state in the process of insertion of the cartridge B into the main assembly A of the apparatus; FIGS. 43(*a*) and 43(*b*) illustrate a state in which the cartridge B is further inserted from the position shown in FIGS. 42(*a*) and 42(*b*); FIGS. 44(*a*) and 44(*b*) illustrate a state in which the cartridge B is further inserted and is completely mounted to the main assembly A of the apparatus.

As shown in these figures, a displaceable member 147 is mounted on an outside of an inner side plate 145 for rotation about a shaft portion 147*a*. A contact member 144 and contact member 161 are mounted on a supporting member 148. The supporting member 148 is mounted on the inner side plate 145 for sliding motion in the directions of arrows e, h. The supporting member 148 is urged in the direction of an arrow e by a compression spring 149 functioning as an elastic function member.

The displaceable member 147 and the supporting member 148 are abutted to each other at the respective abutting portions 147*b* and 148*b* and are interrelated with each other.

When the supporting member 148 is urged in the direction of an arrow e, the displaceable member 147 rotates in the direction of an arrow f. Then, the abutting portion 147*d* abuts the edge of the opening 145*a*1 of the inner side plate 145. Thus, the displaceable member 147 is positioned in place. At this time, the contact 144*a* is in a retracted position where the contact 144*a* is not projected into the inside of the main assembly A of the apparatus through the opening 145*a*2 formed in the inner side plate 145.

Similarly to Embodiment 1, the first engaging portion 142*f* of the operation member 142 is brought into contact with the contact portion 146*a* of the fixed engageable member 146 by the mounting operation of the cartridge B into the main assembly A of the apparatus, too, in this embodiment. This rotates the operation member 142 in the direction of an arrow k. Then, the charging input electrical contact 141*a* and the development input electrical contact 160*a* are exposed. And, the operation member 142 rotates the displaceable member 147 in the direction of an arrow g. This moves the supporting member 148 in the direction of an arrow h. Thus, the contacts 144*a*, 161*a* are projected out of the inner side plate 145. And, the contacts 144*a*, 161*a* are contacted to the contacts 141*a*, 160*a*. A charging bias voltage and a developing bias voltage can now be applied from the main assembly A of the apparatus to the charging roller 108 and to the developing roller 110, respectively.

According to this embodiment, the charging input electrical contact 141*a* and the development input electrical contact 160*a* are covered by the operation member 142. Therefore, the electrical contacts 141*a*, 160*a* are protected from contact by the operator, when the operator handles the cartridge B. In this manner, the probability of the conduction defect which may otherwise be caused by the sweat, grease or the like can be reduced.

In the foregoing description of this embodiment, the operation member 142 covers the electrical contacts 141*a*, 160*a* in the stand-by state or position. However, the present invention is not limited to such a structure. For example, as has been described with respect to Embodiments 4 and 5, a surface or surfaces higher than the contacts 141*a*, 160*a* may be provided on the operation member 142. By doing so, hard-to-touch electrical contact structure is provided.

In this embodiment, the advantageous effects of the first embodiment are provided.

Embodiment 8

Figure 45:
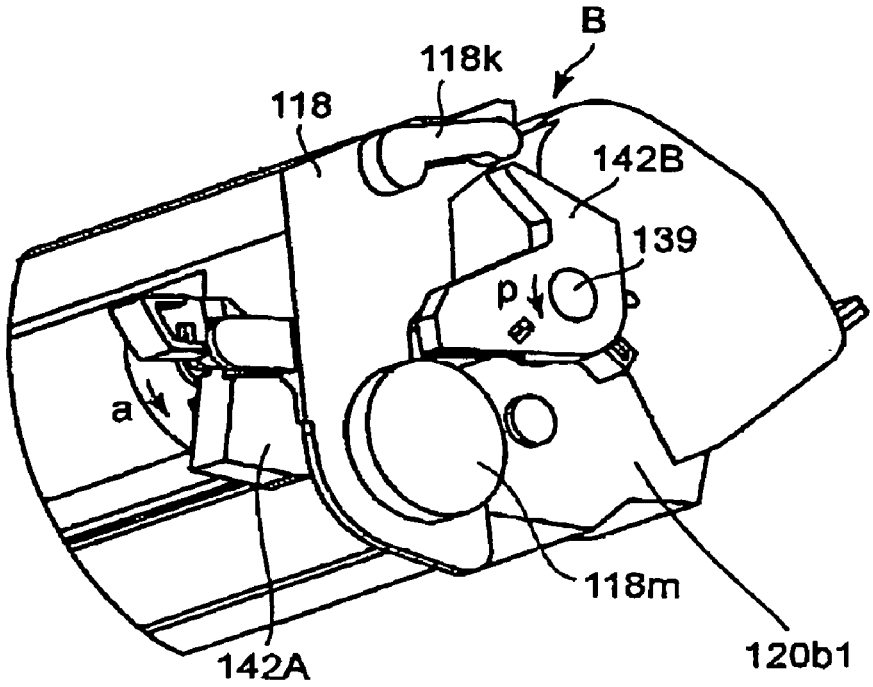
FIGS. 45(*a*) and 45(*b*) are schematic perspective views that illustrate a structure of the movable operation member of the process cartridge according to the embodiment of the present invention.
Figure 45:
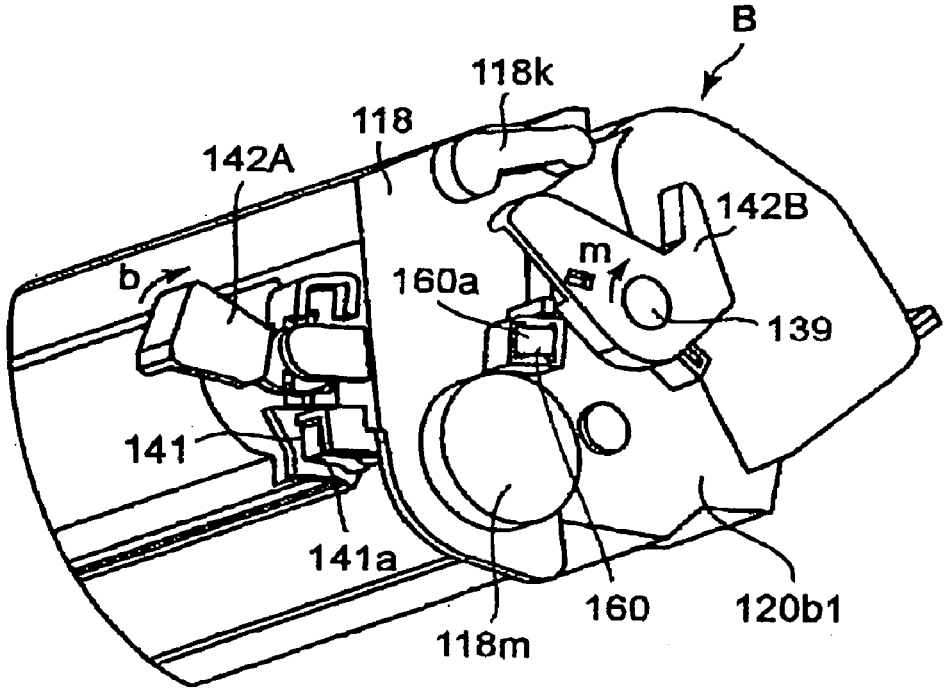

Referring to FIGS. 45(*a*), 45(*b*), 46(*a*), 46(*b*), 47(*a*), 47(*b*), 48(*a*), and 48(*b*), a description will be provided as to an eighth embodiment.

In Embodiment 3, a charging input electrical contact 141*a* is provided so as not to project beyond the surface of the drum frame 118*g* adjacent a longitudinal end at a leading side with respect to the mounting direction in which the cartridge B is mounted to the main assembly A of the apparatus.

In this embodiment, the side surface of the cartridge B is provided with a development input electrical contact 160*a*.

In this embodiment, the structure of the cartridge B and the image forming apparatus 100 are similar to those of Embodiment 1 which has been described in conjunction with FIGS. 1 and 2. The same reference numerals as with the foregoing embodiments are assigned to the elements having the corresponding functions, and the detailed descriptions for such elements are omitted for simplicity.

(1) Movable Operation Member of Cartridge B

FIGS. 45(*a*) and 45(*b*) show a cartridge B according to an eighth embodiment of the present invention.

In this embodiment, a charging input electrical contact 141*a* is provided adjacent a longitudinal end at a leading side with respect to the mounting direction in which the cartridge B is mounted to the main assembly A of the apparatus. The charging input electrical contact member 141 has a charging input electrical contact 141*a* adjacent the corner portion thereof. A first movable operation member 142A is mounted on the drum frame 118 with the supporting and positioning structures which are similarly to Embodiment 2.

On the other hand, the side surface of the cartridge B is provided with a development input electrical contact 160*a* for applying a developing bias voltage to the developing roller 110. The development input electrical contact member 160 is electrically connected with the developing roller 110 in the cartridge.

According to this embodiment, a second movable operation member 142B is mounted for rotation about the shaft portion 139 adjacent the development input electrical contact 160*a*. The operation member 142B is disposed outside, with respect to the longitudinal direction, guide portions 118*k* and 118*m* for guiding the cartridge B which is being inserted into the main assembly A of the apparatus. The operation member 142B is mounted in the structures similar to the operation member 142 of Embodiment 1. The operation member 142B is urged in the direction of an arrow p by a coil spring 143 functioning as an elastic function member.

As shown in FIG. 45(*a*), the operation member 142A rotates in the direction of the arrow a, and the operation member 142B rotates in the direction of an arrow p and is positioned, and in this state, the contact 141*a* and the contact 160*a* are covered by the operation member 142A and the operation member 142B, respectively.

As shown in FIG. 45(*b*), when the operation member 142A rotates in the direction of an arrow b, and the operation member 142B rotates in the direction of an arrow m, the contact 141*a* and the contact 160*a* are exposed. When the cartridge B is not mounted in the main assembly A of the apparatus, the operation member 142A and the operation member 142B are in the state as shown in FIG. 45(*a*). In this state, the contact 141*a* and the contact 160*a* are protected by being covered by the operation member 142A and the operation member 142B, respectively.

Figure 46:
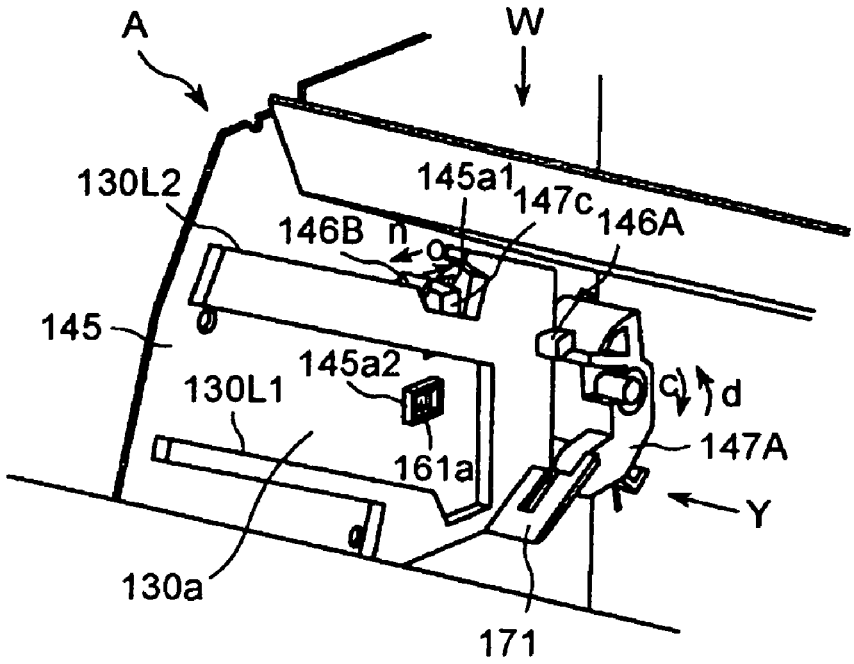
FIGS. 46(*a*) and 46(*b*) are schematic perspective views that illustrate a structure of an electrical contact portion in the main assembly of the image forming apparatus according to the embodiment of the present invention.
Figure 46:
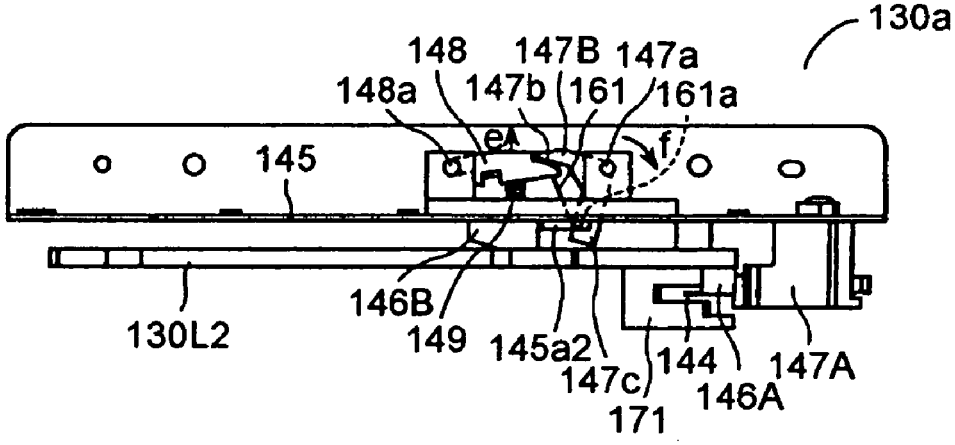

(2) Charging Output Contact 144*a* and Development Output Contact 161*a* in Main Assembly an of Apparatus Referring to FIGS. 46(*a*), 46(*b*), 47(*a*) and 47(*b*), a description will be provided as to the main assembly A of the apparatus into which the cartridge B is mountable.

Figure 47:
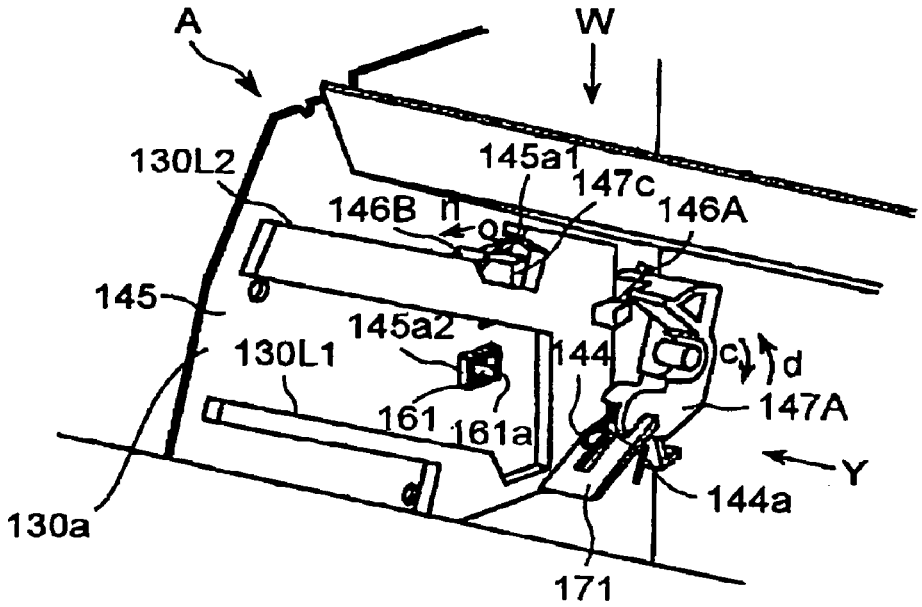
FIGS. 47(*a*) and 47(*b*) are schematic perspective views that illustrate a structure of an electrical contact portion in the main assembly of the image forming apparatus according to the embodiment of the present invention.
Figure 47:
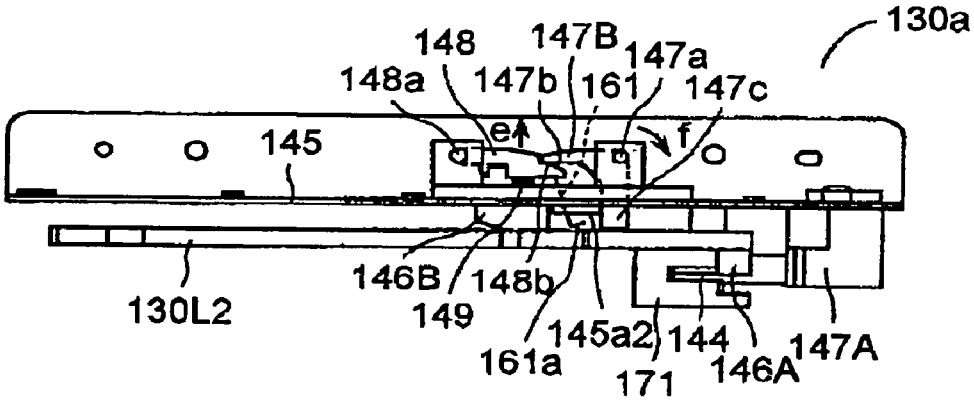

FIG. 46(*a*) and FIG. 47(*a*) are perspective views of the inside of the main assembly B of the image forming apparatus. FIG. 46(*b*) and FIG. 47(*b*) are views as seen in the direction of an arrow W in FIG. 46(*a*) and FIG. 47(*a*).

Similarly to Embodiment 2, the main assembly A of the apparatus is provided with a charging output contact member 144. The first fixed engageable member 146A and the first displaceable member 147A are mounted in the same structures in Embodiment 2.

The displaceable member 147A moves in the directions of arrows c, d in interrelation with mounting and demounting of the cartridge B. As shown in FIG. 47(*b*), when the cartridge B is inserted into the main assembly A of the apparatus, the displaceable member 147A is pushed by the operation member 142A (FIGS. 45(*a*) and 45(*b*)) and is rotated in the direction of the arrow c shown in FIG. 47(*a*). By this, the charging output contact 144*a* is projected out of the cover portion 171 and is brought into contact with the charging input electrical contact 141*a*.

The inner side surface of the main assembly A of the apparatus is provided with a development output contact 161*a* for applying the developing bias voltage through contact with the development input electrical contact 160*a*.

When the cartridge B is not mounted in the main assembly A of the apparatus, the contact 161*a* is kept at a position where it does not project through the opening rib 145*a*2 formed in the inner side plate 145. Between the inner side plate 145 and the main assembly guides 130L1, 130L2 (outside the main assembly guides 130L1 and 130L2 and inside of the inner side plate 145), a second fixed engageable member 146B is provided, which is an abutting portion for rotating the operation member 142B in interrelation with mounting of the cartridge B. One end portion 147*c* of a second displaceable member 147B is projected downstream of the fixed engageable member 146B with respect to the mounting direction of the cartridge B.

The displaceable member 147B moves in the directions of arrows n, o shown in FIG. 47(*a*) in interrelation with mounting and demounting of the cartridge B.

As shown in FIGS. 47(*a*) and 47(*b*), when the cartridge B is mounted in the main assembly A of the apparatus, the displaceable member 147B is pushed in the direction of the arrow o by the operation member 142B (FIG. 45) of the cartridge B. By this, the contact 161*a* is projected through an opening rib 145*a*2 provided on the inner side plate 145 in interrelation with the operation of the displaceable member 147B. And, the contact 161*a* is brought into contact with the developing device contact 160*a*.

The displaceable member 147B and the contact member 161 are mounted in the same manner as with Embodiment 1. Namely, the displaceable member 147B is mounted on an outside of the inner side plate 145 and is rotatable about the center of the shaft portion 147*a*. The contact member 161 is mounted on the supporting member 148. The supporting member 148 is mounted for rotation about the shaft portion 148*a*. The supporting member 148 is urged in the direction of an arrow e by a compression spring 149 functioning as an elastic function member. The displaceable member 147B and the supporting member 148 are abutted to each other at the respective abutting portions 147*b* and 148*b*, and are interrelated with each other.

When the supporting member 148 is urged in the direction of an arrow e, the displaceable member 147B rotates in the direction of an arrow f. It is positioned in place by the abutting portion 147*c* abutting the edge of the opening 145*a*1 formed in the inner side plate 145. At this time, the contact 161*a* is placed in a retracted position where it does not project into the main assembly A of the apparatus through the opening rib 145*a*2 formed in the inner side plate 145.

(3) Movable Operation Member, Charging Output Contact Member and Development Output Contact Member A description will be provided as to the operations of the operation member 142A, the operation member 142B, the charging output contact member 144 and the development output contact member 161.

Figure 48:
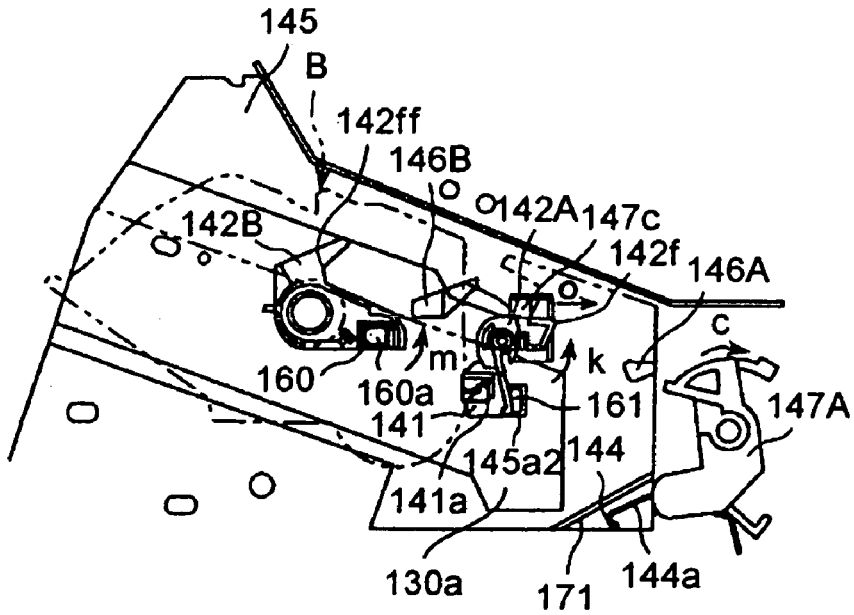
FIGS. 48(*a*) and 48(*b*) are schematic perspective views that illustrate structures of the movable operation member and the electrical contact or the image forming apparatus.
Figure 48:
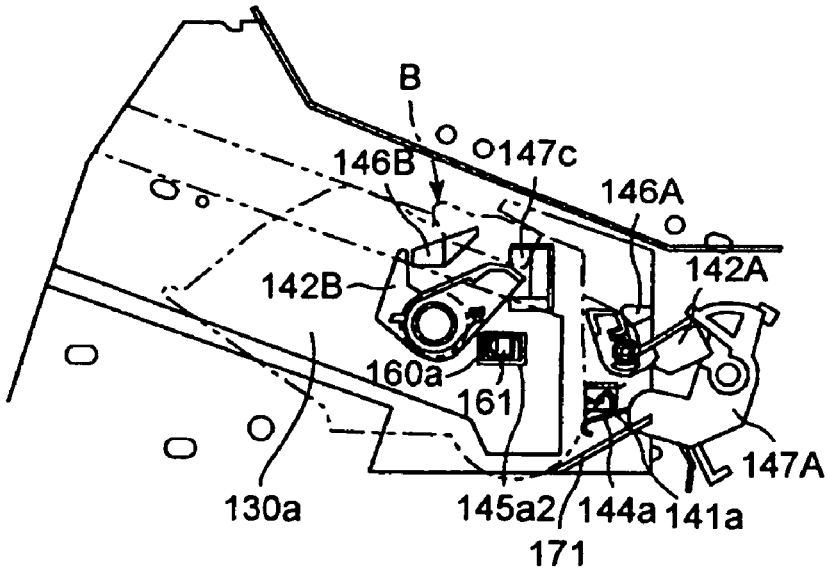

FIGS. 48(*a*) and 48(*b*) are a schematic views illustrating the operation when the cartridge B is inserted into the main assembly A or the apparatus.

FIGS. 48(*a*) and 48(*b*) are views of the inner side plate 145 as seen from an inside of the main assembly of the apparatus (as seen in the direction of the arrow Y in FIG. 46(*a*)); FIG. 48(*a*) illustrates a state in the process of insertion of the cartridge B into the main assembly A of the apparatus; FIG. 48(*b*) is a view in which the cartridge B has been mounted in place in the main assembly A of the apparatus.

As shown in these figures, the displaceable member 147A and the contact member 144 are positioned and supported in the similar manner as with Embodiment 2. That is, by the rotation of the displaceable member 147A, contact 144*a* is movable between an electrical connecting position where it projects through the cover portion 171 and a retracted position where it does not.

Similarly to Embodiment 2, the first engaging portion 142*f* of the operation member 142A is brought into contact with the first fixed engageable member 146A by the mounting operation of the cartridge B into the main assembly A of the apparatus. This rotates the operation member 142A in the direction of an arrow k. And, the charging input electrical contact 141*a* is exposed. The operation member 142A rotates the displaceable member 147A in the direction of the arrow c. By this, the charging output contact 144*a* is projected from the cover portion 171. By doing so, the charging output contact 144*a* is contacted by the charging input electrical contact 141*a* of the cartridge B. Therefore, the charging roller 108 can now be supplied with the charging bias voltage from the main assembly A of the apparatus.

The operation member 142B and the contact member 161 are operated with the same structure as the operation member 142 and the contact member 144 of Embodiment 1.

Namely, by the operation of mounting the cartridge B into the main assembly A of the apparatus, the first engaging portion 142*ff* of the operation member 142B is contacted to the second fixed engageable member 146B. This rotates the operation member 142B in the direction of an arrow m. By this, the development input electrical contact 160*a* (the backside surface of the development input electrical contact member 160 in FIG. 48(*a*) is exposed.

And, the operation member 142B pushes the abutting portion 147*c* of the displaceable member 147B in the direction of an arrow o. This rotates the supporting member 148. Then, the contact 161*a* is projected through the opening rib 145*a*2 of the inner side plate 145. This causes the contact 161*a* to contact to the contact 160*a*. Therefore, the developing bias voltage is now applicable to the developing roller 110 from the main assembly A of the apparatus.

According to this embodiment, the charging input electrical contact 141*a* and the development Input electrical contact 160*a* are covered by the operation members 142A and 142B. Therefore, the electrical contacts 141*a*, 160*a* are protected from contact by the operator, when the operator handles the cartridge B. In this manner, the probability of the occurrence of a conduction defect which may otherwise be caused by the sweat, grease or the like, can be reduced.

In the description of this embodiment, the operation members 142A, 142B cover the electrical contacts 141*a*, 160*a*, respectively in the stand-by states or positions. However, the present invention is not limited to such a structure. For example, as has been described with respect to Embodiments 4, 5 and 6, a surface or surfaces higher than the contacts 141*a*, 160*a* may be provided on the operation member 142. By doing so, hard-to-touch electrical contact structure is provided.

In this embodiment, the advantageous effects of the first and second embodiments are provided.

Embodiment 9

Figure 49:
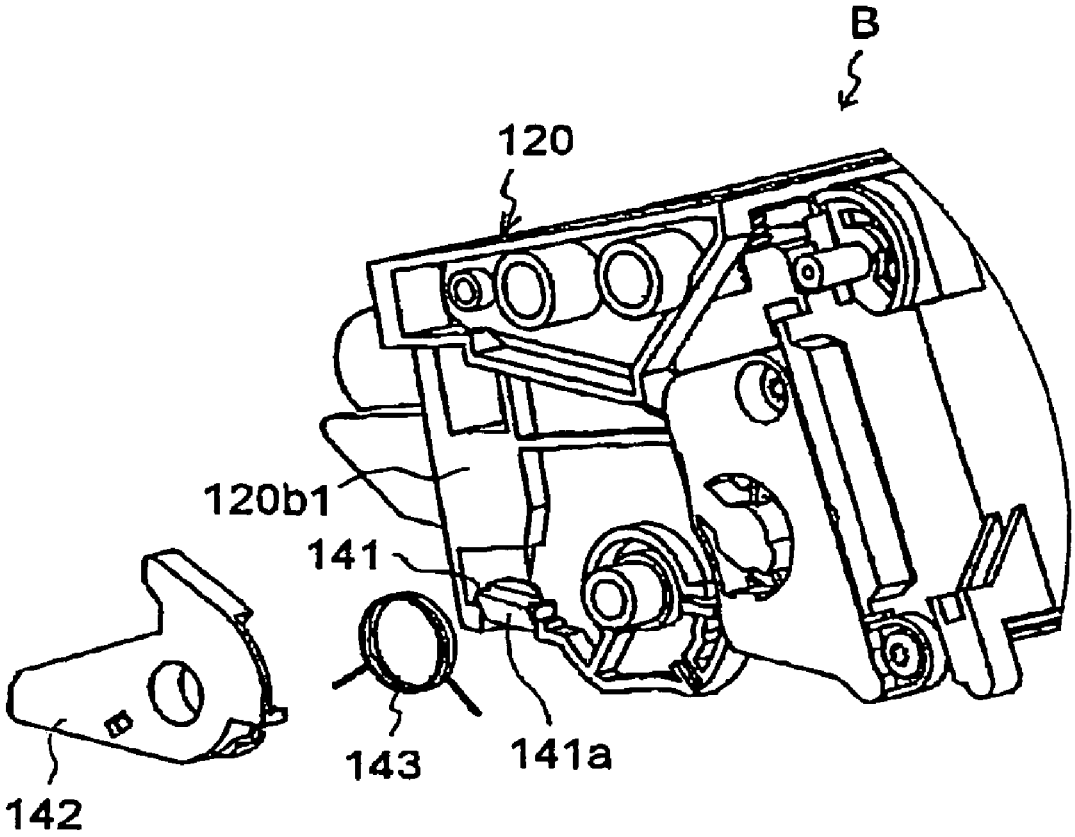
FIG. 49 illustrates a schematic perspective of structures of the movable operation member and the electrical contact according to the embodiment of the present invention.
Figure 50:
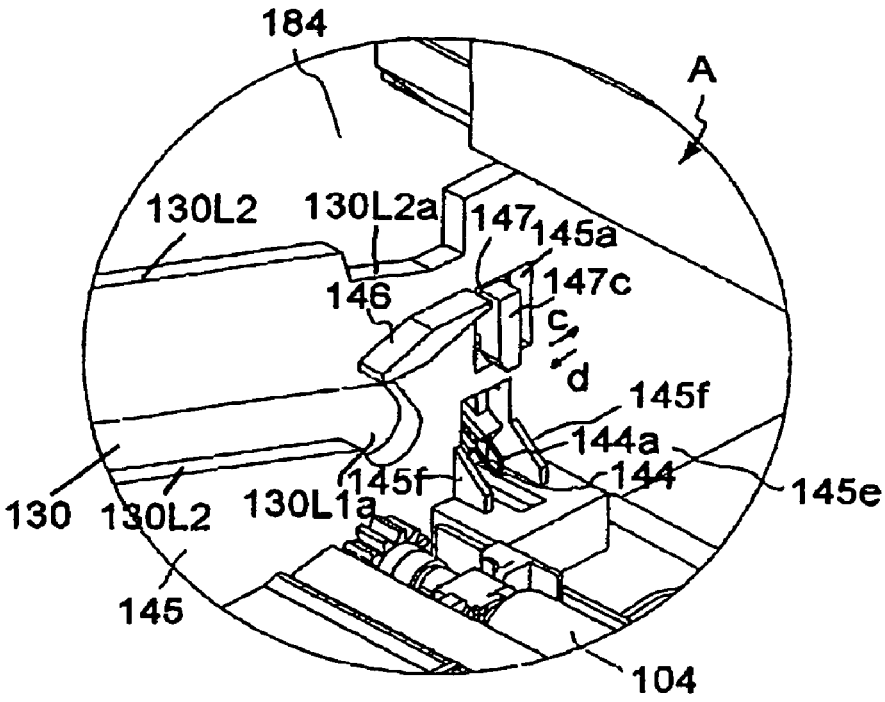
FIG. 50(*a*) illustrates a schematic view of a structure of the electrical contact portion in the main assembly of the image forming apparatus according to the embodiment of the present invention.
Figure 50:
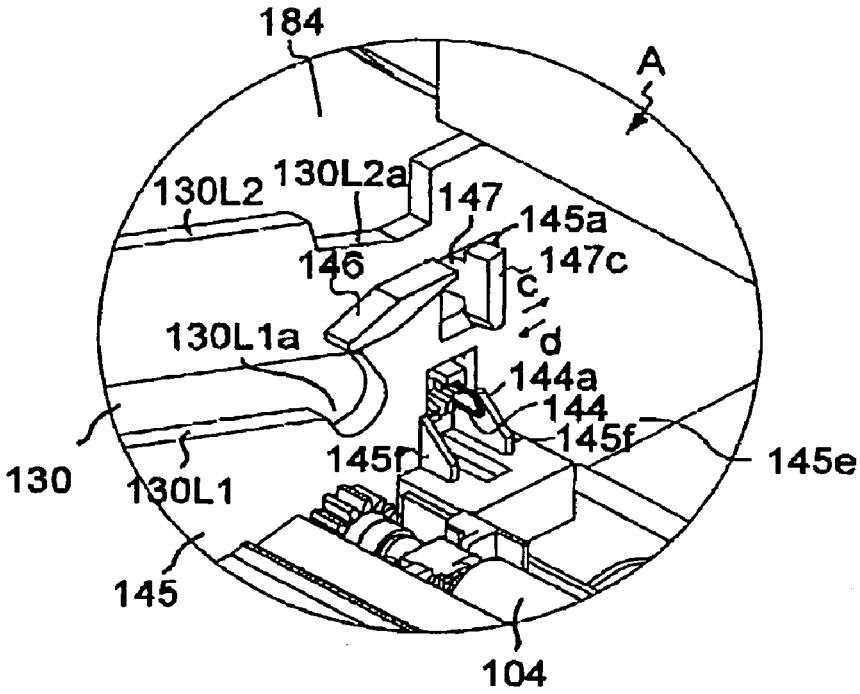

Referring to FIGS. 49, 50(*a*), 50(*b*), 51, 52(*a*), 52(*b*) and 53(*a*)–(*c*), description will be provided as to a ninth embodiment.

The same reference numerals as with the foregoing embodiments are assigned to the elements having the corresponding functions, and the detailed descriptions for such elements are omitted for simplicity.

The embodiment is different from Embodiment 1 in that when the cartridge B is not mounted in the main assembly A of the apparatus, the voltage source S and the output contact 144*a* are not electrically connected with each other. Therefore, the voltage from the voltage source S is not applied to the output contact 144*a*.

FIG. 49 illustrates a structure of the movable operation member 142 and the charging input electrical contact member 141 which are mounted on the cartridge B.

As shown in FIG. 49, a side of the drum unit 120 is provided with a movable operation member 142 and an input electrical contact member 141 which are mounted in the structure similar to Embodiment 1 (FIG. 8, 9). However, although the charging input electrical contact 141*a* of the input electrical contact member 141 is parallel with the side surface 120*b*1 of the cartridge B in Embodiment 1, it is inclined downward in the present embodiment.

A description will be provided as to the charging output contact member 144 provided in the main assembly A of the apparatus.

As shown in FIGS. 50(*a*) and (*b*), on an inside side plate 145 of the main assembly A of the apparatus is provided with a charging output contact member (output contact member), contacted to the input electrical contact 141*a*, for applying a charging voltage to the input electrical contact 141*a*. The side plate 145 is mounted on an inside of an outer plate 184 constituting a frame of the main assembly A of the apparatus. The outer plate 184 is covered by an outer casing C (FIG. 3).

The output contact member 144 is constituted by a wire. An output contact 144*a* which is a part thereof is contacted with the input electrical contact 141*a*. Here, the contact member 144 has a channel-like shape, and a corner portion thereof functions as the electrical contact 144*a*. When the cartridge B is not mounted in the main assembly A of the apparatus, the electrical contact 144*a* is placed in a position between the perpendicular plates 145*f* provided on an inner side surface 145*e* of the side plate 145 (FIG. 50(*a*)). The side plate 145 is provided with a fixed engageable member 146 and a displaceable member 147 having at an end thereof a displaceable engaging portion 147*c* having a similar structure to that in Embodiment 1. In other words, the perpendicular plates 145*f* are juxtaposed with a clearance therebetween and are extended perpendicular to the side plate 145. The electrical contact member 141 is disposed between them. Therefore, the hand of the operator or a tool or the like is not easily contactable to the contact member 144 when the operator carries out the maintenance operation for the main assembly of the apparatus. This is because the hand or the like is prevented by the perpendicular plates 145*f* from entering between the perpendicular plates 145*f*.

The displaceable member 147*c* moves in the directions of arrows c, d in interrelation with mounting and demounting of the cartridge B. When the cartridge B is inserted into the main assembly A of the apparatus, the displaceable engaging portion 147*c* is brought into contact with the operation member 142, and is pushed in the direction of an arrow c by the movement of the cartridge B in the mounting direction X (inserting direction). In interrelation With the movement of the displaceable engaging portion 147*c*, the displaceable member 147 moves. In interrelation with the operation of the displaceable member 147, the output contact 144*a* is projected upwardly from the perpendicular plate 145*f*. And, the output contact 144*a* is contacted with the input electrical contact 141*a* (FIG. 50(*b*)).

Figure 51:
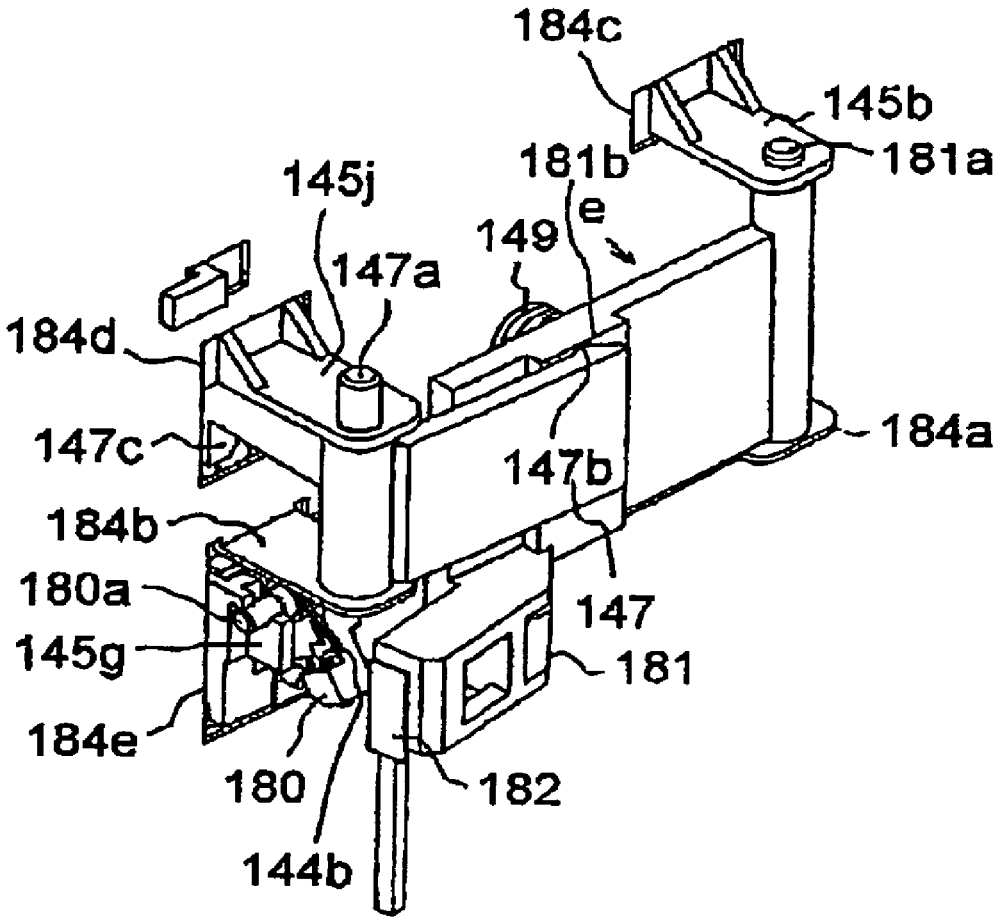
FIG. 51 is a schematic perspective view of a displaceable member and an output contact member in the image forming apparatus according to the embodiment of the present invention as seen from the outside of the outer plate.
Figure 52:
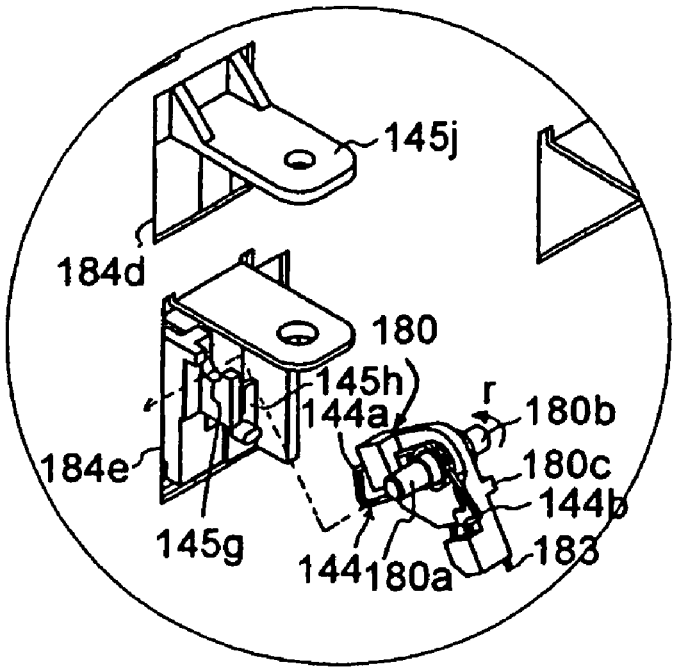
FIG. 52(*a*) is a schematic perspective view that illustrates a structure of the mounting portion of the output contact member in the image forming apparatus according to the embodiment of the present invention.
Figure 52:
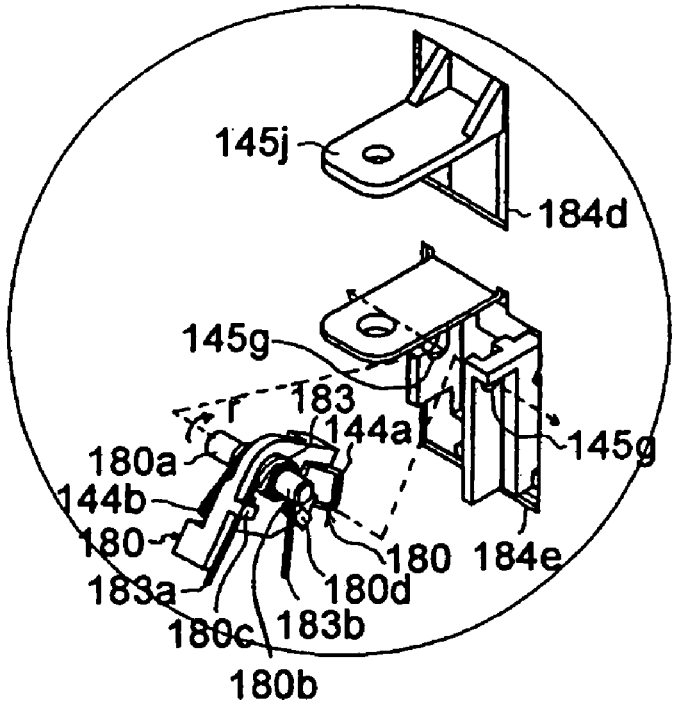

Referring to FIGS. 51, 52(*a*), 52(*b*), and 53(*a*)–53(*c*), a description will be provided as to the structure of the displaceable member 147 and the output contact member 144.

FIG. 51 is a view of the displaceable member 147 and the output contact member 144 as seen from the outside of the outer plate 184. FIGS. 52(*a*) and (*b*) illustrate a structure of a mounting portion of the output contact member 144.

As shown in these figures, the outer plate 184 has holes 184*c*, 184*d*, 184*c* formed therein. Through the hole 184*c*, a mounting portion 145*b* provided on the side plate 145 is projected outward. Similarly, through the hole 184*d*, a mounting portion 145*j* provided on the side plate 145 is projected outward. Similarly, through the hole 184*e*, a mounting portion 145*g* provided on the side plate 145 is projected outward.

Similar to Embodiment 1, the displaceable member 147 is mounted for rotation about a shaft portion 147*a* mounted on the outside of the side plate 145. One end of the shaft portion 147*a* is mounted on the mounting portion 145*j*. The other end of the shaft portion 147*a* i is mounted on the mounting portion 184*b*. The mounting portion 184*b* is extended outward from the outer plate 184.

A lever 181 is mounted for rotation about the shaft portion 181*a*. One end of the shaft portion 181*a* is mounted on the mounting portion 145*b*. The other end of the shaft portion 181*a* is mounted on the mounting portion 184*a*. The mounting portion 145*b* is provided on the side plate 145, and is projected outward through the hole 184*c* formed in the side plate 184. The mounting portion 184*a* is extended outward from the outer plate 184. The lever 181 is urged in the direction of an arrow e by an elastic function member (for example, a coil spring) 149. Therefore, by the elastic force of the elastic function member 149, the displaceable member 147 and the lever 181 are abutted to each other at the respective abutting portions 147*b*, 181*b*. Thus, the displaceable member 147 and the lever 181 are interrelated with each other.

In this embodiment, the lever 181 is provided with a main assembly electrical contact member 182. The main assembly electrical contact member 182 is electrically connected to an electric circuit (voltage source circuit) B of the circuit board EC provided in the main assembly A of the apparatus through lead lines or the like. The main assembly electrical contact member 182 is electrically contacted and connected with the output contact member 144 by the operation of the lever 181.

The output contact member 144 is mounted on the supporting member 180. The supporting member 180 is mounted on the mounting portion 145*g* of the side plate 145 for rotation about the shaft portions 180*a*, 180*b* (co-axial with each other).

The output contact member 144 comprises a coil spring having an arm portion which is provided with an output contact 144*a* and a second electrical contact 144*b*. The electrical contact member 144 is mounted on the shaft portion 180*a* of the supporting member 180.

To the shaft portion 180*b* of the supporting member 180, a coil spring 183 is mounted. The spring 183 is locked with a locking portion 180*c* of the supporting member 180 at the arm portion 183*a*. The arm portion 183*b* of the spring 183 is locked with a locking portion 145*h* of the side plate 145 (FIG. 52(*a*)). By doing so, the spring 183 urges the supporting member 180 in the direction of an arrow r. At this time, the projection 180*d* of the supporting member 180 is abuted to an abutting portion (unshown) which is provided inside the side plate 145. Thus, the position of the supporting member 180 with respect to the rotational direction is determined (the retracted position shown in FIG. 50(*a*) and FIG. 53(*c*), where the electrical contact 144*a* is retracted in the inside of the perpendicular plates 145*f*).

In FIGS. 52(*a*) and (*b*), the supporting member 180 is removed from the mounting portion 145*g* for better understanding.

Figure 53:
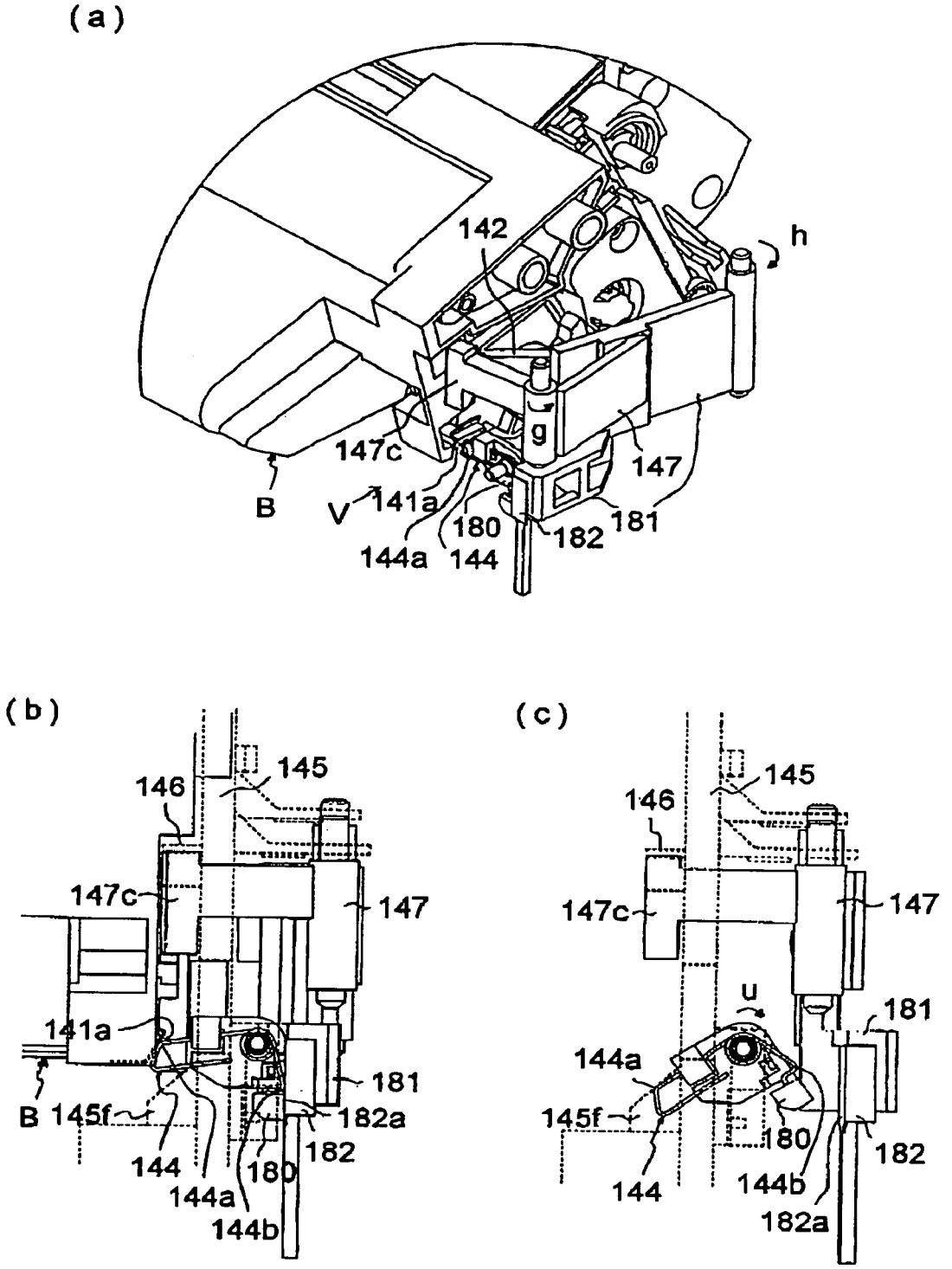
FIG. 53(*a*) is a schematic perspective view illustrating a relation between the input electrical contact member of the process cartridge and the displaceable member and the output contact member which-are provided in the main assembly of the image forming apparatus.

FIGS. 53(*a*) and (*b*) show states in which the cartridge B is mounted in place in the main assembly A of the apparatus. FIG. 53(*b*) and FIG. 53(*c*) are views as seen in the direction of an arrow V shown in FIG. 53(*a*). For better understanding, again, in FIG. 53(*a*), the side plate 145 and the outer plate 184 are omitted. In FIG. 53(*b*), the side plate 145 is indicated by broken lines. FIG. 53(*c*) shows a state in which the cartridge B is not mounted (same as with FIG. 50(*a*)).

When the cartridge B is inserted into the main assembly A of the mounting, the movable operation member 142 is brought into contact with the fixed engageable member 146. By this, the movable operation member 142, similarly to Embodiment 1 (FIG. 10(*b*)), is rotated in the direction of an indicated by the arrow b about the drum shaft 139. Thus, It is moved from the position and covering the electrical contact 141*a*. This exposes the input electrical contact 141*a*. Then, the movable operation member 142 is brought into contact with the displaceable engaging portion 147*c*. With further insertion of the cartridge B, the displaceable member 147 is rotated in the direction of the arrow g shown in FIG. 53(*a*). This is similar to Embodiment 1 (FIG. 13(*a*), FIG. 14(*a*) and FIG. 15(*a*)).

The displaceable member 147 is rotated in the direction of the arrow g. In interrelation with the rotation of the displaceable member 147, the lever 181 is rotated in the direction of the arrow h (FIG. 53(*a*)). This moves the main assembly electrical contact member 182 mounted on the lever 181 from the position shown in FIG. 53(*c*) to a position shown In FIG. 53(*b*). Then, the main assembly electrical contact member 182 is contacted to the supporting member 180. This rotates the supporting member 180 in the direction of an arrow u shown in FIG. 53(*c*). Then, the output contact 144*a* mounted on the supporting member 180 is projected upward to the input electrical contact 141*a* from between the perpendicular plates 145*f*. Thus, the electrical contact 144*a* is brought into contact with the input electrical contact 141*a* of the cartridge B which is now in the mounting portion 130*a*. At this time, the main assembly electrical contact 182*a* of the main assembly electrical contact member 182 and the second contact 144*b* of the output contact member 144 are contacted to each other and therefore are electrically connected with each other. By this, a voltage from the voltage source S (FIG. 16) is applicable to the charging roller 108 through the main assembly contact member 182, the main assembly electrical contact 182*a*, the output contact member 144 and the input electrical contact member 141. When the cartridge B is not mounted in the main assembly A of the apparatus, the main assembly electrical contact 182*a* and the second contact 144*b* of the output contact member 144 are disengaged from each other. Therefore, the voltage from the voltage source S is not applied to the output contact 144*a*. Accordingly, even if the operator inadvertently touches the output contact member 144 and/or the output contact 144*a* during a maintenance operation or the like, the electric circuit E is not damaged.

This embodiment also provides the advantageous effects similar to Embodiment 1.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an electrophotographic image forming apparatus, the main assembly including an output contact movable between an electrical connecting position and a retracted position retracted from the electrical connecting position, a displaceable member configured and positioned to move the output contact, and an elastic function member configured and positioned to elastically urge the displaceable member to urge the output contact toward the retracted position away from the electrical connecting position, said process cartridge comprising:

an electrophotographic photosensitive drum;

a process device actable on said electrophotographic photosensitive drum;

a movable operation member movable relative to a cartridge frame, wherein when said process cartridge is inserted into the main assembly of the apparatus, said movable operation member is engageable with a fixed engageable member fixed in the main assembly of the apparatus to move relative to the cartridge frame, and is engageable with a displaceable engaging portion of the displaceable member to move the output contact from the retracted position to the electrical connecting position against an elastic force of the elastic function member, after the engagement with the fixed engageable member; and an input electrical contact configured and positioned to receive a voltage for enabling said process device by engagement with the output contact moved to the electrical connecting position.

2. A process cartridge according to claim 1, further comprising an elastic function member configured and positioned to apply an elastic force to said movable operation member, wherein when said movable operation member is engaged with the fixed engageable member, said movable operation member moves relative to the cartridge frame against an elastic force of said elastic function member of said process cartridge.

3. A process cartridge according to claim 1 or 2, wherein said movable operation member includes a first engaging portion engageable with the fixed engageable member and a second engaging portion engageable with the displaceable engaging portion, wherein when said process cartridge is inserted into the main assembly of the apparatus, said first engaging portion of said movable operation member is engaged with the fixed engageable member to move said movable operation member relative to the cartridge frame, and after said first engaging portion is engaged with the fixed engageable member, said second engaging portion is engaged with the displaceable engaging portion to move the output contact from the retracted position to the electrical connecting position.

4. A process cartridge according to claim 3, wherein when said process cartridge is inserted into the main assembly of the electrophotographic image forming apparatus, said first engaging portion is engaged with the fixed engageable member to rotate so that said second engaging portion of said movable operation member is moved to a position for engagement with the displaceable engaging portion to engage with said displaceable engaging portion.

5. A process cartridge according to claim 4, wherein when said second engaging portion is engaged with the displaceable engaging portion, said movable operation member is out of engagement with the fixed engageable member and out of contact therewith.

6. A process cartridge according to claim 5, wherein said process device includes a charging member configured and positioned to electrically charge said electrophotographic photosensitive drum, and wherein said input electrical contact receives from the output contact a voltage for charging said electrophotographic photosensitive drum.

7. A process cartridge according to claim 5, wherein said process device includes a developing member configured and positioned to develop the electrostatic latent image formed on said electrophotographic photosensitive drum, and said input electrical contact receives from the output contact a voltage for developing the electrostatic latent image.

8. An electrophotographic image forming apparatus including a main assembly and a process cartridge detachably mounted to the main assembly, comprising:

said main assembly of said electrophotographic apparatus including:

an output contact movable between an electrical connecting position and a retracted position retracted from the electrical connecting position;

a displaceable member configured and positioned to move said output contact;

an elastic function member configured and positioned to elastically urge said displaceable member to urge said output contact toward the retracted position away from the electrical connecting position; and a fixed engageable member;

said process cartridge including:

an electrophotographic photosensitive drum;

a process device actable on said electrophotographic photosensitive drum;

an input electrical contact configured and positioned to receive a voltage for enabling said process device; and a movable operation member movable relative to a cartridge frame;

wherein when said process cartridge is inserted into the main assembly of said apparatus, said movable operation member is engaged with said fixed engageable member to move relative to the cartridge frame, and is engaged with a displaceable engaging portion of said displaceable member to move said output contact from the retracted position to the electrical connecting position to establish an electrical connection between said output contact and said input electrical contact, after the engagement with said fixed engageable member.

9. An apparatus according to claim 8, further comprising an elastic function member configured and positioned to apply an elastic force to said movable operation member, wherein when said movable operation member is engaged with said fixed engageable member, said movable operation member moves relative to the cartridge frame against an elastic force of said elastic function member configured and positioned to apply an elastic force to said movable operation member.

10. An apparatus according to claim 8 or 9, wherein said movable operation member includes a first engaging portion engageable with said fixed engageable member and a second engaging portion engageable with said displaceable engaging portion, wherein when said process cartridge is inserted into the main assembly of said apparatus, said first engaging portion of said movable operation member is engaged with said fixed engageable member to move said movable operation member relative to the cartridge frame, and after said first engaging portion is engaged with the fixed engageable member, said second engaging portion is engaged with said displaceable engaging portion to move said output contact from the retracted position to the electrical connecting position.

11. An apparatus according to claim 10, wherein when said process cartridge is inserted into the main assembly of said electrophotographic image forming apparatus, said first engaging portion is engaged with said fixed engageable member to rotate so that said second engaging portion of said movable operation member is moved to a position for engagement with said displaceable engaging portion to engage with said displaceable engaging portion.

12. An apparatus according to claim 10, wherein when said second engaging portion is engaged with said displaceable engaging portion, said movable operation member is out of engagement with said fixed engageable member and out of contact therewith.

13. An apparatus according to claim 12, wherein said main assembly of said electrophotographic image forming apparatus includes a voltage source and an electric circuit, wherein when said output contact is in the retracted position, said output contact is electrically disconnected from said voltage source, and when said output contact moves from the retracted position to the electrical connecting position, said output contact is electrically connected with said voltage source through said electric circuit.

14. An apparatus according to claim 13, wherein said process device includes a charging member configured and positioned to electrically charge said electrophotographic photosensitive drum, and wherein said input electrical contact receives from said output contact a voltage for charging said electrophotographic photosensitive drum.

15. An apparatus according to claim 13, wherein said process device includes a developing member configured and positioned to develop the electrostatic latent image formed on said electrophotographic photosensitive drum, and wherein said input electrical contact receives from said output contact a voltage for developing the electrostatic latent image.

16. A process cartridge detachably mountable to a main assembly of an electrophotographic image forming apparatus, wherein the main assembly of the electrophotographic image forming apparatus includes a cartridge mounting portion configured and positioned to detachably mount said process cartridge, a fixed engageable member, an output contact movable between an electrical connecting position and a retracted position retracted from the electrical connecting position, and a displaceable member having a displaceable engaging portion configured and positioned to move the output contact, wherein the displaceable engaging portion is disposed downstream of the fixed engageable member, and at least a part of the displaceable engaging portion overlaps the fixed engageable member with respect to a direction in which said process cartridge is inserted into the main assembly, and an elastic function member configured and positioned to elastically urge the displaceable member to urge the output contact toward the retracted position away from the electrical connecting position, said process cartridge comprising:

an electrophotographic photosensitive drum;

a process device actable on said electrophotographic photosensitive drum;

a movable operation member movable relative to a cartridge frame, wherein when said process cartridge is inserted into the main assembly of the electrophotographic image forming apparatus, said movable operation member is engageable with the fixed engageable member to move relative to the cartridge frame to a position with which said movable operation member is movable beyond the fixed engageable member to permit a further insertion of said process cartridge, and after engagement with the fixed engageable member, said movable operation member is engageable with the displaceable engaging portion to push the displaceable engaging portion to move the output contact from the retracted position to the electrical connecting position against an elastic force of the elastic function member; and an input electrical contact configured and positioned to engage the output contact moved to the electrical connecting position and to receive the voltage for enabling said process device.

17. A process cartridge according to claim 16, further comprising an elastic function member configured and positioned to apply an elastic force to said movable operation member, wherein when said movable operation member is engaged with the fixed engageable member, said movable operation member moves relative to the cartridge frame against an elastic force of said elastic function member configured and positioned to apply an elastic force to said movable operation member.

18. A process cartridge according to claim 16 or 17, wherein said movable operation member includes a first engaging portion engageable with the fixed engageable member and a second engaging portion engageable with the displaceable engaging portion, wherein when said process cartridge is inserted into the main assembly of the apparatus, said first engaging portion of said movable operation member is engaged with the fixed engageable member to move said movable operation member relative to the cartridge frame, and after said first engaging portion is engaged with the fixed engageable member, said second engaging portion is engaged with the displaceable engaging portion to move the output contact from the retracted position to the electrical connecting position.

19. A process cartridge according to claim 18, wherein when said process cartridge is inserted into the main assembly of the electrophotographic image forming apparatus, said first engaging portion is engaged with the fixed engageable member to rotate so that said second engaging portion of said movable operation member is moved to a position for engagement with the displaceable engaging portion to engage said displaceable engaging portion.

20. A process cartridge according to claim 19, wherein when said second engaging portion is engaged with the displaceable engaging portion, said movable operation member is out of engagement with the fixed engageable member and out of contact therewith.

21. A process cartridge according to claim 20, wherein said process device includes a charging member configured and positioned to electrically charge said electrophotographic photosensitive drum, and wherein said input electrical contact receives from the output contact the voltage for charging said electrophotographic photosensitive drum.

22. A process cartridge according to claim 20, wherein said process device includes a developing member configured and positioned to develop the electrostatic latent image formed on said electrophotographic photosensitive drum, and wherein said input electrical contact receives from the output contact a voltage for developing the electrostatic latent image.

23. An electrophotographic image forming apparatus including a main assembly and a process cartridge detachably mountable thereto, said main assembly including:

a cartridge mounting portion configured and positioned to detachably mount said process cartridge;

a fixed engageable member;

an output contact movable between an electrical connecting position and a retracted position retracted from the electrical connecting position; and a displaceable member having a displaceable engaging portion configured and positioned to move the output contact, wherein said displaceable engaging portion is disposed downstream of said fixed engageable member, and at least a part of said displaceable engaging portion overlaps said fixed engageable member with respect to a direction in which said process cartridge is inserted; and an elastic function member configured and positioned to elastically urge said displaceable member to urge said output contact toward the retracted position away from the electrical connecting position;

said process cartridge including:

an electrophotographic photosensitive drum;

a process device actable on said electrophotographic photosensitive drum;

a movable operation member movable relative to a cartridge frame, wherein when said process cartridge is inserted into said main assembly of said electrophotographic image forming apparatus, said movable operation member is engageable with said fixed engageable member to move relative to the cartridge frame to a position with which said movable operation member is movable beyond said fixed engageable member to permit a further insertion of said process cartridge, and after engagement with said fixed engageable member, said movable operation member is engageable with said displaceable engaging portion to push said displaceable engaging portion to move said output contact from the retracted position to the electrical connecting position against an elastic force of said elastic function member; and an input electrical contact configured and positioned to engage said output contact moved to the electrical connecting position and to receive the voltage for enabling said process device.

24. An apparatus according to claim 23, further comprising an elastic function member configured and positioned to apply an elastic force to said movable operation member, wherein when said movable operation member is engaged with said fixed engageable member, said movable operation member moves relative to the cartridge frame against an elastic force of said elastic function member configured and positioned to apply an elastic force to said movable operation member.

25. An apparatus according to claim 23 or 24, wherein said movable operation member includes a first engaging portion engageable with said fixed engageable member and a second engaging portion engageable with said displaceable engaging portion, wherein when said process cartridge is inserted into said main assembly of said apparatus, said first engaging portion of said movable operation member is engaged with said fixed engageable member to move said movable operation member relative to the cartridge frame, and after said first engaging portion is engaged with said fixed engageable member, said second engaging portion is engaged with said displaceable engaging portion to move said output contact from the retracted position to the electrical connecting position.

26. An apparatus according to claim 25, wherein when said process cartridge is inserted into said main assembly of said electrophotographic image forming apparatus, said first engaging portion is engaged with said fixed engageable member to rotate so that said second engaging portion of said movable operation member is moved to a position for engagement with said displaceable engaging portion to engage with said displaceable engaging portion.

27. An apparatus according to claim 26, wherein when said second engaging portion is engaged with said displaceable engaging portion, said movable operation member is out of engagement with said fixed engageable member and out of contact therewith.

28. An apparatus according to claim 27, wherein said main assembly of said electrophotographic image forming apparatus includes a voltage source and an electric circuit, wherein when said output contact is in the retracted position, said output contact is electrically disconnected from said voltage source, and when said output contact moves from the retracted position to the electrical connecting position, said output contact is electrically connected with said voltage source through said electric circuit.

29. An apparatus according to claim 28, wherein said process means includes a charging member configured and positioned to electrically charge said electrophotographic photosensitive drum, and said input electrical contact receives from said output contact the voltage for charging said electrophotographic photosensitive drum.

30. An apparatus according to claim 28, wherein said process device includes a developing member configured and positioned to develop the electrostatic latent image formed on said electrophotographic photosensitive drum, and wherein said input electrical contact receives from said output contact a voltage for developing the electrostatic latent image.

* * * * *

UNITED STATES PATENT AND TRADEMARK OFFICE

CERTIFICATE OF CORRECTION

PATENT NO. : 6,993,264 B2
APPLICATION NO. : 10/748330
DATED : January 31, 2006
INVENTOR(S) : Toru Oguma et al.

It is certified that error appears in the above-identified patent and that said Letters Patent is hereby corrected as shown below:

COLUMN 1
Line 10, “demountably” should read --detachably--.
Line 44, “so. The” should read --so, the--.

COLUMN 2
Line 28, “a” should be deleted.

COLUMN 4
Line 40, “that” should read --that illustrates--.

COLUMN 5
Line 49, “or” should read --of--.
Line 67, “or” should read --of--.

COLUMN 6
Line 27, “which-are” should read --which are--.
Line 32, “or” should read --of--.

COLUMN 8
Line 65, “is” (second occurrence) should read --the--.

COLUMN 9
Line 16, “130L1,” should read --130L1;--.
Line 55, “mounting” should read --mounted--.

COLUMN 10
Line 55, “manner. The” should read --manner, the--.

COLUMN 11
Line 10, “arrow a” should read --arrow a in--.
Line 59, “on” should be deleted.

COLUMN 13
Line 37, “an of” should read --of an--.
Line 64, “side” (second occurrence) should be deleted.

COLUMN 14
Line 40, “abuted” should read --abutted--.

UNITED STATES PATENT AND TRADEMARK OFFICE

CERTIFICATE OF CORRECTION

PATENT NO. : 6,993,264 B2
APPLICATION NO. : 10/748330
DATED : January 31, 2006
INVENTOR(S) : Toru Oguma et al.

It is certified that error appears in the above-identified patent and that said Letters Patent is hereby corrected as shown below:

COLUMN 15
Line 2, “not-projected” should read --not projected--.

COLUMN 16
Line 8, “engaged” (first occurrence) should read --engaged with--.

COLUMN 17
Line 3, “an” should read --and--.
Line 7, “or” should read --of--.

COLUMN 19
Line 4, “provides” should read --provide--.

COLUMN 20
Line 53, “coll” should read --coil--.

COLUMN 21
Line 1, “an of” should read --of an--.
Line 58, “bly A” should read --bly A.--.

COLUMN 23
Line 53, “or” should read --of--.
Line 55, “is” should be deleted.

COLUMN 24
Line 2, “numeral” should read --numerals--.
Line 4, “view” should read --views--.
Line 26, “the” (second occurrence) should be deleted.
Line 29, “an” should be deleted.

COLUMN 25
Line 7, “projection” should read --projected--.
Line 21, “abuted” should read --abutted--.
Line 35, “couterclockwise” should read --counterclockwise--.
Line 50, “movable-” should read --movable--.
Line 57, “engaged” (first occurrence) should read --engaged with--.

COLUMN 26
Line 21, “is” should be deleted.
Line 59, “In” should read --in--.

UNITED STATES PATENT AND TRADEMARK OFFICE

CERTIFICATE OF CORRECTION

PATENT NO. : 6,993,264 B2
APPLICATION NO. : 10/748330
DATED : January 31, 2006
INVENTOR(S) : Toru Oguma et al.

It is certified that error appears in the above-identified patent and that said Letters Patent is hereby corrected as shown below:

COLUMN 27
Line 1, “Input” should read --input--.
Line 11, “fifth” should read --a fifth--.
Line 21, “Is” should read --is--.
Line 65, “from” should read --from a--.

COLUMN 28
Line 27, “Lo” should read --to--.
Line 33, “is” should be deleted.
Line 53, “skelton” should read --skeleton--.

COLUMN 31
Line 40, “hard-to-touch” should read --a hard-to-touch--.

COLUMN 32
Line 7, “similarly” should read --similar--.
Line 42, “an of” should read --of an--.
Line 54, “in” should read --as in--.

COLUMN 33
Line 56, “a” should be deleted.
Line 58, “or” should read --of--.

COLUMN 34
Line 33, “FIG. 48(a)” should read --FIG. 48(a))--.
Line 43, “Input” should read --input--.

COLUMN 35
Line 23, “on” should be deleted.
Line 61, “With” should read --with--.

COLUMN 36
Line 21, “i s” should read --is--.
Line 65, “abuted” should read --abutted--.

UNITED STATES PATENT AND TRADEMARK OFFICE

CERTIFICATE OF CORRECTION

PATENT NO. : 6,993,264 B2
APPLICATION NO. : 10/748330
DATED : January 31, 2006
INVENTOR(S) : Toru Oguma et al.

It is certified that error appears in the above-identified patent and that said Letters Patent is hereby corrected as shown below:

COLUMN 37
Line 20, "of an" should be deleted.
Line 21, "It" should read --it--.
Line 22, "and" should be deleted.
Line 36, "In" should read --in--.

Signed and Sealed this

Eighth Day of August, 2006

JON W. DUDAS
*Director of the United States Patent and Trademark Office*